US007784926B2

(12) United States Patent
Watanabe

(10) Patent No.: US 7,784,926 B2
(45) Date of Patent: Aug. 31, 2010

(54) LIQUID CONTAINER, LIQUID SUPPLYING SYSTEM EQUIPPED WITH LIQUID CONTAINER

(75) Inventor: Kenjiro Watanabe, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 774 days.

(21) Appl. No.: 11/798,951

(22) Filed: May 18, 2007

(65) Prior Publication Data

US 2007/0268325 A1 Nov. 22, 2007

(30) Foreign Application Priority Data

May 19, 2006 (JP) ..... 2006-140086

(51) Int. Cl.
*B41J 2/175* (2006.01)

(52) U.S. Cl. ..... 347/86; 347/19; 347/5

(58) Field of Classification Search ..... 347/1, 347/5, 19, 86

See application file for complete search history.

(56) References Cited

U.S. PATENT DOCUMENTS

| | | | | |
|---|---|---|---|---|
| 5,050,001 | A | 9/1991 | Hatanaka et al. | 358/302 |
| 6,062,667 | A * | 5/2000 | Matsui et al. | 347/19 |
| 6,302,535 | B1 | 10/2001 | Sturgeon et al. | 347/86 |
| 7,213,914 | B2 | 5/2007 | Anma et al. | 347/86 |
| 7,237,881 | B2 | 7/2007 | Hayasaki et al. | 347/86 |
| 7,566,120 | B2 * | 7/2009 | Ishizawa et al. | 347/86 |
| 2005/0007420 | A1 * | 1/2005 | Ogawa et al. | 347/50 |
| 2005/0179750 | A1 * | 8/2005 | Hayasaki et al. | 347/86 |
| 2005/0219303 | A1 | 10/2005 | Matsumoto et al. | 347/19 |
| 2006/0139422 | A1 | 6/2006 | Hatasa et al. | 347/86 |
| 2006/0244795 | A1 | 11/2006 | Hayasaki et al. | 347/86 |
| 2008/0001985 | A1 | 1/2008 | Hatasa et al. | 347/19 |

FOREIGN PATENT DOCUMENTS

| | | |
|---|---|---|
| EP | 1650033 | 4/2006 |
| JP | 4-275156 | 9/1992 |
| JP | 2001-253087 | 9/2001 |
| JP | 2002-301829 | 10/2002 |
| WO | 2006/043718 | 4/2006 |
| WO | 2006/129882 | 12/2006 |

OTHER PUBLICATIONS

European Search Report dated Jul. 17, 2009 from corresponding European Application No. 07108347.

* cited by examiner

*Primary Examiner*—Ellen Kim
(74) *Attorney, Agent, or Firm*—Fitzpatrick, Cella, Harper & Scinto

(57) ABSTRACT

A liquid container detachably mountable to a recording apparatus to which a plurality of liquid containers are mountable at different positions, an apparatus side communicating portion, a light emitting portion, position detecting means for detecting a position of said liquid container where liquid container is mounted by receiving light from said liquid container, said liquid container includes a container side communicating portion capable of information communication with the apparatus side communicating portion; an information storing portion capable of storing at least individuality information of the liquid container; displaying means, including a light passing/blocking portion for passing or blocking the light from the light emitting portion provided in said apparatus, for releasing the light passed by the light passing/blocking portion; and a controller for releasing the light by said displaying means by controlling said light passing/blocking portion when information indicated by a signal relating to the individuality information inputted from said communicating portion and the individuality information stored in said information storing portion, are the same.

13 Claims, 32 Drawing Sheets

(a)

(b)

(c)

LIQUID CONTAINER, LIQUID SUPPLYING SYSTEM EQUIPPED WITH LIQUID CONTAINER

FIELD OF THE INVENTION AND RELATED ART

The present invention relates to a liquid container, a liquid supply system using liquid container, a manufacturing method for the liquid container, an electrical circuit board for the liquid container, a recording apparatus using the liquid container and a liquid accommodating cartridge. More particularly, it relates to the container, system, method, electrical circuit board, the recording apparatus and the cartridge, wherein information of a state of the liquid container such as ink remaining amount of the ink container and the position of the mounted liquid container is notified using light.

With recent wider use of digital camera, the demand is increasing for printing with the digital camera being directly connected with a printer (recording device). In addition, an information memory medium of a card type which is an information memory medium detachably mountable to a digital camera is directly mounted into a printer, and the data is transferred to the printer to effect print. This type of printing is also increasing.

In a known system, the remaining amount of the ink container in the printer is usually confirmed on the computer display through the personal computer. There is an increasing demand toward a system in which the remaining amount of the ink in the ink container can be known not through the computer, in the case that the printing is effected without using the personal computer. For example, if the user is aware of the fact the ink remaining amount in the ink container is small, the ink container is replaced with a new one, by which the wasteful printing (only to half way to a recording material, for example) due to the shortage of the ink can be avoided beforehand.

In a conventional example, a display element such as LED is used to notify the user of the state of the ink container. For example, Japanese Laid-open Patent Application Hei 4-275156 discloses that ink container which is integral with a recording head is provided with two LED elements, which are switched on depending on the ink remaining amount in two steps.

Similarly, Japanese Laid-open Patent Application 2002-301829 discloses provision, on the ink container, of a lamp. The same also discloses that four ink containers used with one recording device are provided with said lamps, respectively.

In addition, in order to meet a demand for high image quality, light magenta ink, light cyan ink and so on become used in addition to the conventional four color (black, yellow, magenta and cyan) inks. In such a case, seven—eight color ink containers are used individually in an ink jet printer. Then, a mechanism for preventing the ink containers from being mounted at erroneous positions is desired. Japanese Laid-open Patent Application 2001-253087 (U.S. Pat. No. 6,302,535 B1) discloses that configurations of the engaging portion of ink containers engageable with carrying portion of the carriage are made different depending on the colors of the ink containers, so that mounting of ink containers on erroneous position are prevented.

Even when the ink container is provided with a lamp, as disclosed in Japanese Laid-open Patent Application 2002-301829, the main assembly side controller has to identify the ink container which is recognized as containing less ink. To do this, it is necessary to identify the ink container to which the signal for turning the right lamp on. If, for example, the ink container is mounted on a wrong position, there is a liability that small ink remaining amount is displayed for another ink container which contains a sufficient amount of the ink. Therefore, for the emission control of the displaying device such as a lamp or the like, it is a premise that mounted of the ink container is specified.

As for the structure for specified the mounted position of the ink container, it is known that configurations of the engaging positions of ink containers are made different depending on the colors of the ink containers. However, in such a case, it is required that ink containers having configurations depending on the colors of the ink to contain with the result of disadvantage in the manufacturing cost.

As for another structure, it would be considered that a single line in a circuit closed by contact between the container side electrical contact and the main assembly site the electrical contact on the carriage or the like is provided for each of the mounting two positions. For example, the signal line for controlling actuation of the lamp in accordance with the color information of the ink container read out is provided for each of the ink container mounting positions. By doing so, it is possible that if the color information read out does not properly match the mounted position of the ink container, the erroneous positioning opening container can be discriminated.

However, in this case, the number of the signal lines is large. In consideration of the recent tendency of increasing the image quality of the prints by increasing the number of kinds of used ink, the increased number of the signal lines results in the cost of the printer. On the other hand, use of a common signal line will be effective to reduce the number of lines. However, with simply use of such a common signal line (bus line), the mounted position could not be determined.

In addition, in order to reduce or completely eliminate the signal lines, it would be effective to use a wireless publication system such as RFID. However, with simple use of such a communication system, the mounted position of the ink container could not still be determined.

SUMMARY OF THE INVENTION

The present invention was made to solve the problems such as those described above. Thus, the primary object of the present invention, which relates a means for disseminating the information regarding the condition of each of the liquid containers in an ink jet printer, with the use of light which the light emitting portion of the main assembly of the ink jet printer emits, is to substantially reduce the number of signal wires, compared to that in a conventional information displaying means (means in accordance with prior art), while ensuring that the information disseminating means can disseminate the information regarding the liquid container in the liquid container slot specified by the main assembly of the printer.

Another object of the present invention is to provide an optical information disseminating means for an ink jet recording apparatus, which is substantially smaller, in the amount of the electric power with which a liquid container needs to be supplied, than a conventional optical information disseminating means for an ink jet recording apparatus.

According to an aspect of the present invention, there is provided a liquid container detachably mountable to a recording apparatus to which a plurality of liquid containers are mountable at different positions, an apparatus side communicating portion, a light emitting portion, position detecting means for detecting a position of said liquid container where liquid container is mounted by receiving light from said liquid container, said liquid container comprising a container side communicating portion capable of information communication with the apparatus side communicating portion; an information storing portion capable of storing at least individuality information of the liquid container; displaying means, including a light passing/blocking portion for passing or blocking the light from the light emitting portion provided in said apparatus, for releasing the light passed by the light passing/blocking portion; and a controller for releasing the light by said displaying means by controlling said light passing/blocking portion when information indicated by a signal relating to the individuality information inputted from said communicating portion and the individuality information stored in said information storing portion, are the same.

According to the present invention, the manner in which light is projected from an information disseminating means is controlled by controlling a transmitting-blocking portion capable of transmitting or blocking the light from the light emitting portion of the main assembly of an ink jet recording apparatus, based on the signals inputted through the communication portion of the main assembly of a recording apparatus and the communicating portion of each ink container, and the information unique to each liquid container. Therefore, even though the control signals which the multiple liquid containers in the recording apparatus receive are common to all the liquid containers, only the liquid container whose unique information matches the information in the common control signals is allowed to control the manner in which light is projected from its information disseminating means. Therefore, it is possible to provide an optical information disseminating means for an ink jet recording apparatus, which disseminating the information regarding each liquid container in the recording apparatus with the use of the light emitted by the light emitting portion of the main assembly of the recording apparatus, and which is substantially smaller in the number of signal lines than a conventional optical information disseminating means, and yet, is capable of disseminating the information regarding a specific liquid container in a specific liquid container slot in the main assembly of the recording apparatus.

Further, according to the present invention, an ink container is not provided with a light emitting portion made up of an LED or the like. Instead, the main assembly of a printer is provided with the light emitting portion, and the information regarding each ink container in the apparatus main assembly is disseminated by turning on or off the portion of each ink container, which is capable of transmitting or blocking the light which the light emitting portion emits. Further, the portion of each ink container, which can transmit or block light, is made up of a liquid crystal element. Therefore, it is unnecessary to send a large amount of electric power to each liquid container, or to provide each ink container with a power circuit with a relatively large capacity.

These and other objects, features, and advantages of the present invention will become more apparent upon consideration of the following description of the preferred embodiments of the present invention, taken in conjunction with the accompanying drawings.

DETAILED DESCRIPTION OF THE PREFERRED EMBODIMENTS

Hereinafter, the preferred embodiments of the present invention will be described in detail with reference to the appended drawings.

1. Mechanical Structure

Figure 2:
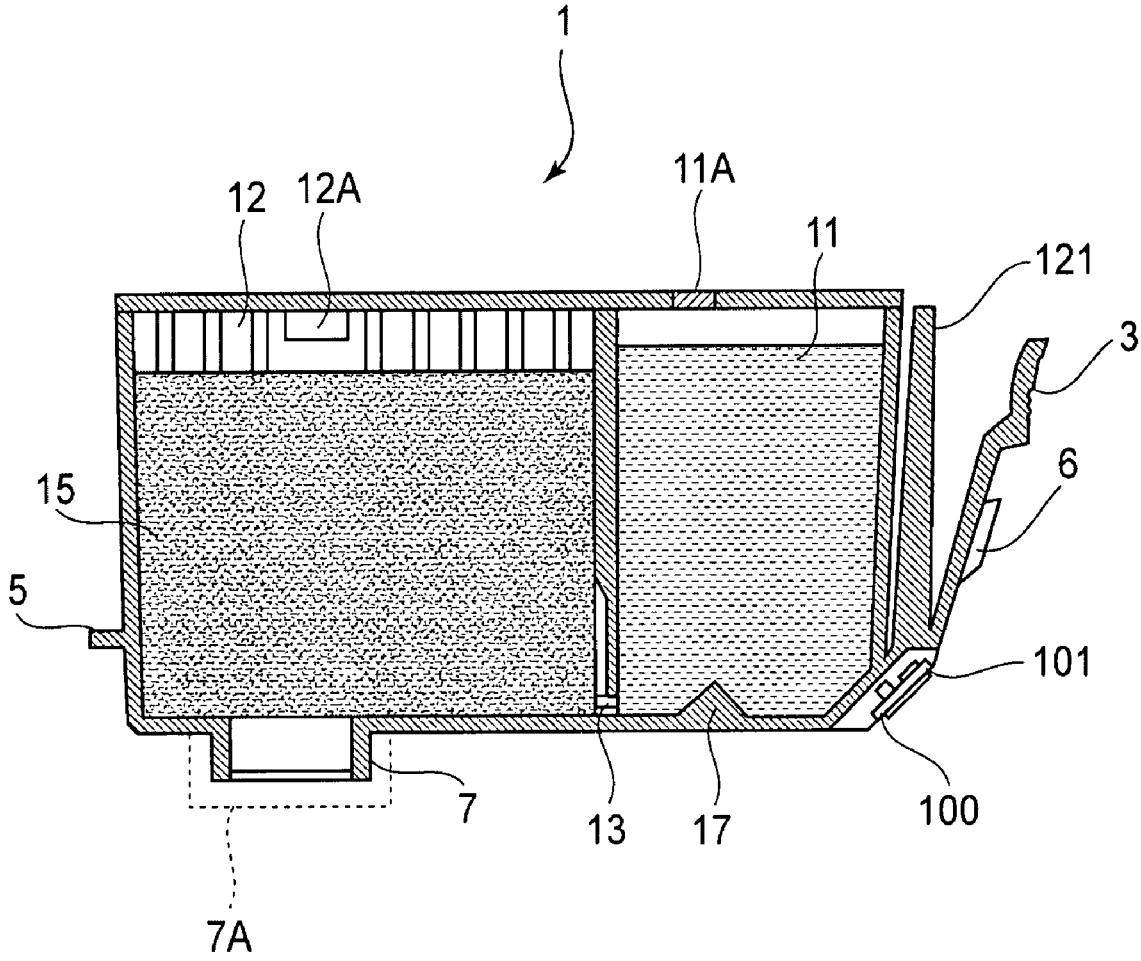
FIG. 2 is a sectional view of the ink container, at a plane parallel to the lateral walls of the ink container.
Figure 3:
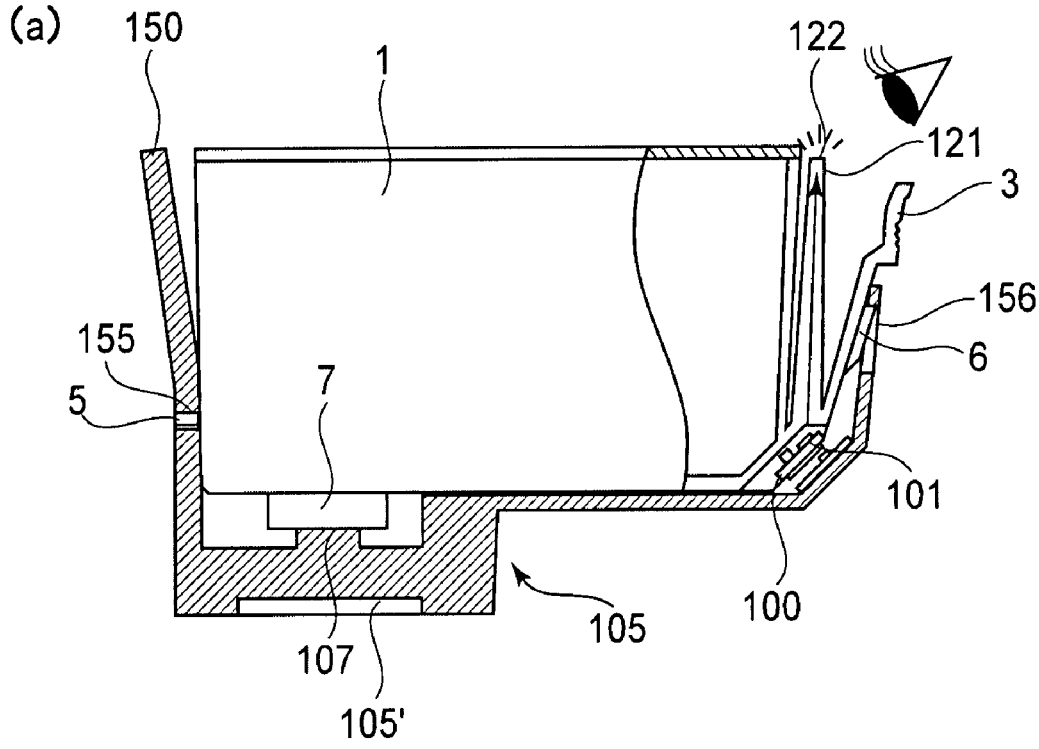
FIG. 3(*a*) is a sectional view of the ink container in the first embodiment of the present invention, which is in the proper position in the ink container holder, at a plane parallel to the lateral walls of the ink container, showing the general functions of the control chip with which the ink container is provided, and FIG. 3(*b*) is an enlargement of the essential portion of FIG. 3(*a*).
Figure 3:
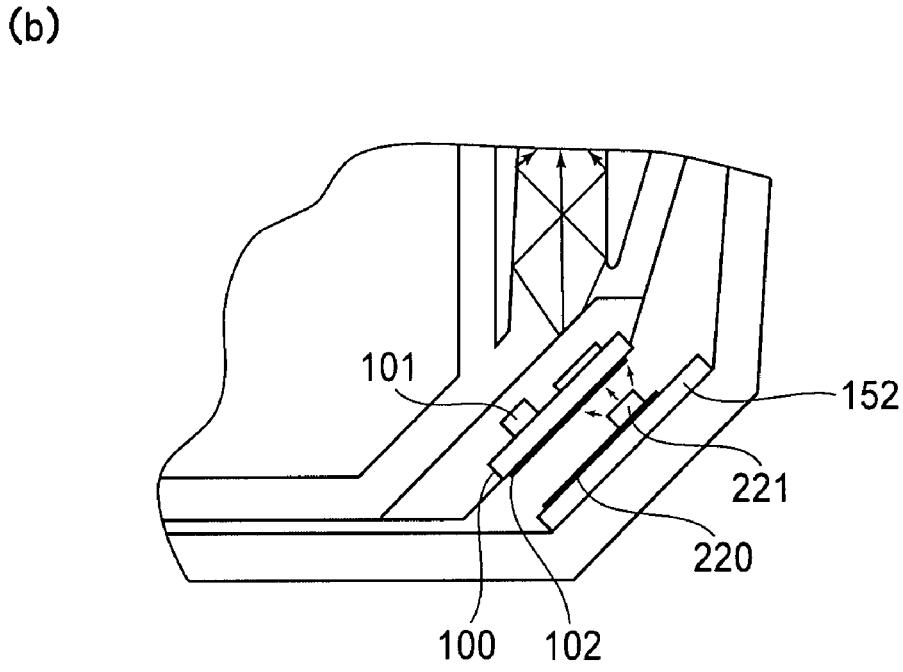

1-1. Ink Container (FIGS. 1-3)

Figure 1:
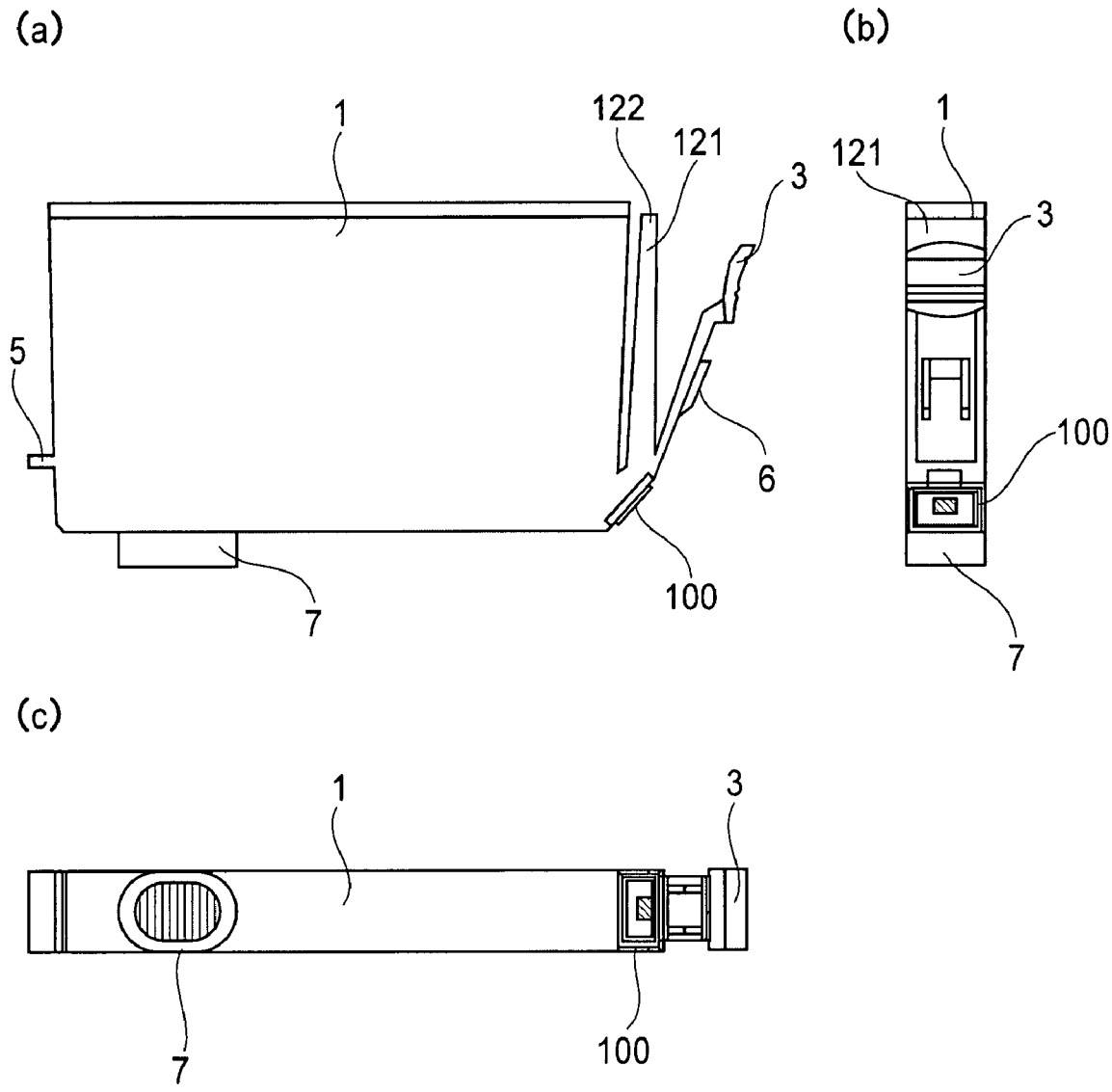
FIGS. 1(*a*), 1(*b*), and 1(*c*) are side, front, and bottom views, respectively, of the ink container in the first embodiment of the present invention.

FIGS. 1(*a*), 1(*b*), and 1(*c*) are side, front, and bottom views, respectively, of the ink container in the first embodiment of the present invention. In the following descriptions of the preferred embodiments of the present invention, the front surface of an ink container means the surface of the ink container, which is to be made to face toward a user to make it possible for the user to operate (for mounting or dismounting ink container) the ink container, and to make the information regarding the ink container accessible to the user.

The ink container 1 in this embodiment has a supporting member 3, which extends diagonally upward from the bottom portion of the front end of the ink container 1. The supporting member 3 is an integral part of the external shell of the ink container 1, and is formed of a resinous substance, together with the external shell. Its structure is such that when the ink container 1 is mounted into an ink container holder (which will be described later), or removed from the ink container holder, it deforms in a manner to rotate about its base portion, that is, the portion next to the external shell. The ink container 1 is provided with first and second engaging portions 5 and 6, which are on the front and rear sides of the ink container 1, respectively, and capable of engaging with the corresponding engaging portions of the ink container (second engaging portion 6 is an integral part of supporting member 3). These engaging portions make it possible for the ink container 1 to be secured to the ink container holder. The operation for mounting the ink container 1 into the ink container holder will be described later with reference to FIGS. 7(*a*)-7(*c*).

The bottom wall of the ink container 1 is provided with an ink outlet 7, which couples with the ink inlet of a recording head (which will be described later) to make it possible to supply the recording head with ink, when the ink container 1 is mounted into the ink container holder. The ink container 1 is also provided with a circuit chip, which constitutes one of the essential portions of the ink container in this embodiment. The circuit chip is on the outward side of the ink container, and is on the portion of the external shell of the ink container 1, which is between the base portion of the supporting member 3, and the front end of the bottom wall of the external shell; it is located at the intersection of the front and bottom walls of the external shell of the ink container 1. Hereafter, the circuit chip of the ink container 1 in this embodiment will be referred to as control chip 100.

Further, the ink container 1 is provided with a light guiding member 121, which extends upward from the intersection of the bottom and front walls of the ink container 1. The light guiding member 121 is also an integral part of the shell of the ink container 1. It catches the light emitted from a light emitting portion on a carriage, which will be described later, and guides the light upward to project the light from the light projecting portion 122, which is the tip portion of the light guiding member 121.

FIG. 2 is a sectional view of the ink container 1, at a plane parallel to the lateral walls of the ink container 1. The ink container 1 has an ink storage chamber 11 and a negative pressure generating member storage chamber 12, which are separated by a partitioning wall. The ink storage chamber 11 is on the front side of the ink container 1, that is, the side on which the supporting member 3 and circuit chip 100 are located. The negative pressure generating member storage chamber 12 is located on the rear side and is in connected with the ink outlet 7. The chambers 11 and 12 are in connection with each other through a hole 13. The ink storage chamber 11 directly stores ink, whereas the negative pressure generating member storage chamber 12 stores an ink absorbing member 15 (which hereafter may be referred to as porous member, for convenience), such as a piece of sponge, a bundle of fiber, or the like, which is capable of absorbing and retaining ink. The porous member 15 is for generating a proper amount of negative pressure, that is, such an amount of negative pressure that is sufficient to prevent ink from leaking from the ink jetting portions of the recording head, by equilibrating with the ink retaining force of the meniscus formed in the ink jetting nozzle portions of the recording head, but is in the range in which the recording head is allowed to jet ink.

In order to keep the internal negative pressure of the ink container 1 within a preset desired range, the top wall of the negative pressure generating member storage chamber 12 is provided with an air vent 12A, which is for guiding external air into the ink container 1 to counter the increase in negative pressure, which occurs in the ink container 1 as the ink in the ink container 1 is supplied to the recording head.

The ink container 1 shown in FIG. 2 can be manufactured by injecting ink into the main assembly of the ink container 1 after the completion of the main assembly. In order to use this manufacturing method, the ink container 1 may be provided with an ink inlet for ink injection, which can be made as a part of the top wall of the ink storage chamber 11, for example. This ink inlet for ink injection is to be sealed with a sealing member 11A after the injection of ink into the ink container 1.

The sealing member 11A can be removed or destroyed to reopen the inlet for ink injection. Thus, as the amount of ink in the ink container is reduced to virtually zero by consumption, ink can be injected into the ink container with the use of a syringe or the like by reopening the inlet for ink injection. The reopened inlet may be sealed with the removed sealing member 1A or its replacement. Further, instead of using the original inlet for ink injection, another inlet (hole) may be made in the top wall of the ink storage chamber 11, for example, to inject ink into the virtually empty ink container 1. Obviously, the new inlet can be sealed with a sealing member, such as the original sealing member 11A or the like. The method for manufacturing the ink container in accordance with the present invention includes this method of refilling (re-injection) ink into the ink container 1 after the amount of the ink therein becomes virtually zero as described above.

It is possible for the ink in the ink container 1 to leak during the shipment of the ink container, or while the ink container 1 is in storage, after the manufacture of the ink container. Thus, in order to prevent the ink from leaking from the ink container 1, the ink container 1 may be kept sealed with a sealing member 7A, which is removably attachable to the ink outlet 7. The sealing member 7A may be in any shape or form, for example, a cap or a piece of tape, as long as it is removable when the ink container 1 is attached to the recording head. Further, the sealing member 7A may be designed so that after the ink container 1 is removed from the recording head, the ink outlet 7 can be resealed with the original sealing member 7A or its replacement.

Incidentally, it is not mandatory that the internal structure of the ink container 1 is as described above, that is, it is not mandatory that the internal space of the ink container 1 is divided into a porous member chamber, and an ink chamber in which ink is directly stored, as described above. For example, the ink container 1 may be structured so that practically the entirety of the internal space of the ink container 1 is filled with a porous member. Further, the means for generating negative pressure does not need to be a porous member. For example, the ink container 1 may be provided with an ink bladder formed of an elastic substance such as rubber. In such a case, the ink bladder is formed so that the elasticity (resiliency) of the elastic material acts in the direction to increase the internal space (volume) of the bladder, and ink is directly filled into the bladder. Thus, as the ink in the bladder is consumed, negative pressure is generated in the bladder by the tension which the bladder generates. Further, the internal negative pressure for the ink container 1 may be generated by forming at least a part of the shell of the ink storage, of flexible substance. In such a case, the negative pressure is generated by applying pressure to the flexible portion with use of a spring or the like. Also in the case of the ink containers structured as described above, they can be manufactured by injecting ink into them in the same manner as the manner described above. The ink containers of the above described types are provided with an air vent, which is for introducing the external air into the ink storage space in order to counter the increase in the negative pressure in the ink storage space, which occurs as the ink is supplied to the recording head. Thus, ink may be injected into the ink containers through their air vents.

The bottom wall of the ink storage chamber 11 is provided with an ink absence detection portion 17, which is positioned so that when the ink container 1 is in its proper position in the recording apparatus after the placement of the ink container 1 in the recording apparatus, it opposes an ink remainder amount detection sensor (which will be described later) with which the main assembly of the recording apparatus is provided. In this embodiment, the ink remainder amount detection sensor is a light sensor having a light emitting portion and a light receiving portion. The ink absence detection portion 17 is formed of a transparent or semitransparent substance, and is in the form of a prism, the angles of which are such that when no ink is in the ink container 1, it reflects the light emitted from the light emitting portion, back to the light receiving portion (which will be described later).

Figure 4:
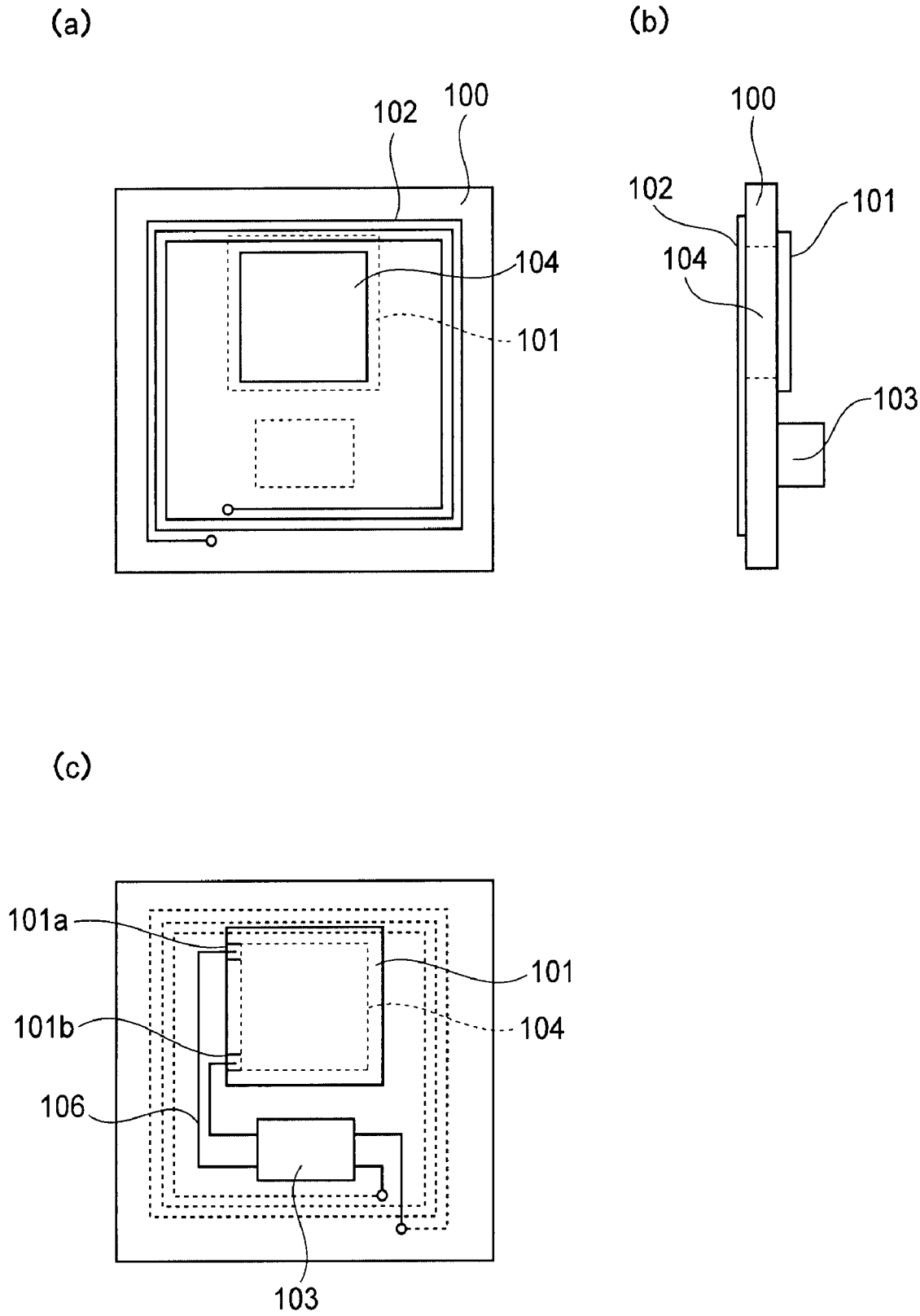
FIGS. 4(*a*), 4(*b*), and 4(*c*) are front, side, and back views, respectively, of an example of the control circuit chip which is to be attached to the ink container in this embodiment.
Figure 5:
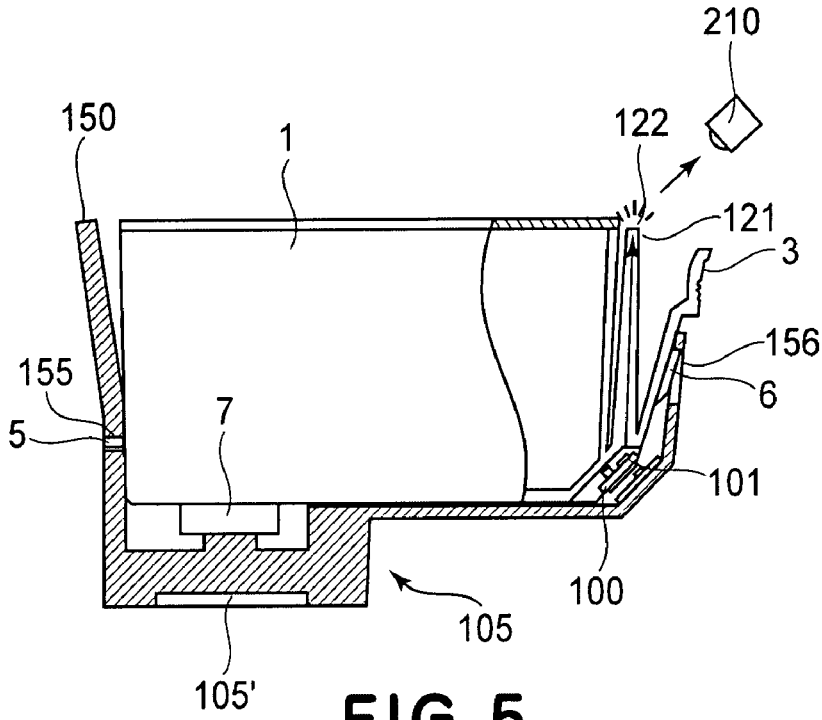
FIG. 5 is a schematic sectional view of the ink container and ink container holder, which is similar to FIG. 3(*a*), except for the position of the ink container.

Next, referring to FIGS. 3-5, the structure and functions of the ink container in this embodiment will be described in more detail. FIGS. 3(*a*) and 3(*b*) are for describing the gist of the control circuit chip with which the ink container in this embodiment is provided. FIG. 3(*a*) is a schematic sectional view of the ink container which is in the proper position in the ink container holder, and the ink container holder, at a plane parallel to the lateral walls of the ink container. FIG. 3(*b*) is an enlargement of the portion of FIG. 3(*a*), which depicts the essential portions of the ink container and ink container holder. FIGS. 4(*a*), 4(*b*), and 4(*c*) are front, side, and bottom views, respectively, of an example of the control circuit chip 100 which is to be attached to the ink container in this embodiment. FIG. 5 is a schematic sectional view of the ink container, which is similar to FIG. 3(*a*), except that FIG. 5 is different in ink container position from FIG. 3.

An ink container holder 150 (which hereafter will be referred to simply as holder 150), which is an integral part of a recording head unit 105 having a recording head 105' is provided with first and second engaging portions 155 and 156. As the ink container 1 is mounted into the holder 150, the first and second engaging portions 5 and 6 engage with the first and second engaging portions 155 and 156 of the holder 150, firmly securing thereby the ink container 1 to the holder 150. The holder 150 is provided with an antenna chip 152, whereas the control circuit chip 100 (which hereafter may be referred to as control chip 100) of the ink container 1 is provided with an antenna 102 (FIG. 4(*a*)), which is in the form of a loop and is an outwardly facing part of the patterned wiring of the control chip 100. Thus, as the ink container 1 is mounted into the holder 150, the antenna 102 is placed next to the antenna chip 152 in a manner to directly oppose the antenna chip 152, making it possible for the ink container 1 to communicate with the main assembly.

The control chip 100 is provided with a liquid crystal element 101, and a control element 103. The liquid crystal element 101 is an element which can transmit or block light, and is on the surface of the control chip 100, which faces inward of the ink container 1. The control element 103 controls the liquid crystal element 101. More specifically, it turns on or off the liquid crystal element 101, transmitting or blocking light, in response to an electrical signal which is transmitted from the antenna chip 152 and is received by the control chip 100 through its antenna 102 which faces the ink container 1.

The antenna chip 152 is provided with a single antenna 220 and multiple LEDs 221, which are on the surface which faces the ink container 1. The antenna 220 is common for the multiple antennas 102 on the ink container side. The multiple LEDs 221 correspond one for one to the multiple liquid crystal elements 101 on the ink container side. Each LED 221 is positioned so that when the corresponding ink container 1 is in the proper position in the holder 150 (FIG. 3(*b*)), it squarely opposes the liquid crystal element 101 of the control chip 100 of the corresponding ink container 1. The control chip 100 is provided with a hole 104, the position of which is such that when the ink container 1 is in the proper position in the holder 150, it aligns with the corresponding LED 221. Thus, the light from the LED 221 directly reaches the liquid crystal element 101. When the liquid crystal element 101 is in the state in which it transmits light, the light from the LED 221 passes the liquid crystal element 101, enters the bottom portion of the light guiding member 121, is guided through the light guiding member 121 to the light projecting portion 122, and projects outward from the light projecting portion 122, realizing thereby display function. In other words, in this embodiment, the liquid crystal element 101, which transmits or blocks the light from the LED 221, and light guiding member 121, which guides the light having arrived from the LED 221 and projects the light from its light projecting portion 122, make up a displaying means.

Referring to FIG. 4(*a*), the antenna 102, which is a part of the patterned wiring and is in the form of a loop, is on the surface (front) of the control chip 100, which faces outward of the ink container 1. Referring to FIG. 4(*c*), the surface (rear) of the control chip 100, which faces inward of the ink container 1, is provided with an control element 103 and the abovementioned liquid crystal element 101 (single bit element). The control element 103 is in connection with the antenna 102. The liquid crystal element 101 is in connection with the control element 103, and is controlled by the control element 103. The control chip 100 is provided with the hole 104, which is on the inward side of the liquid crystal element 101, as described before. Thus, the light from the LED 221 can be received by the liquid crystal element 101. The liquid crystal element 101 is provided with connective terminals 101*a* and 101*b*, which are connected to the patterned wiring 106 of the control chip 100, with the use of electrically conductive connective members (unshown). In this embodiment, the liquid crystal element 101 is on the rear side of the control chip 100. However, it may be placed on the front side of the control chip 100.

With the use of the control chip 100 structured and positioned as described above, not only can the preselected information regarding the ink container 1 be displayed to a user through a recording apparatus (and also, host apparatus, such as computer, with which recording apparatus is in connection), but also, can be directly displayed to a user by utilizing the liquid crystal element 101. More specifically, referring to FIG. 5, the light receiving portion 210 is placed on a spot, which corresponds to the top right corner of the drawing and the end of the moving range of the carriage which carries the holder 150, and the liquid crystal element 101 is controlled when the carriage is at this end of its moving range. Thus, it is possible for the main assembly of the recording apparatus to obtain the preselected information regarding the ink container 1, from the data carried by the light which the light receiving portion 210 receives. That is, referring to FIG. 3(*a*), as the liquid crystal element 101 is controlled, with the carriage positioned at the center, for example, of its moving range, a user can obtain the preselected information regarding the ink container 1 by looking at the light projecting portion 122, that is, from the manner in which light projected from the light projecting portion 122.

The preselected information regarding the ink container 1 is such information as the state of the positioning of the ink container 1 relative to the ink container holder 150 (whether or not positioning of ink container is proper), whether or not the position of the ink container 1 is proper, whether or not there is still ink in the ink container 1, etc. These pieces of information can be presented in the form of a code, for example, whether or not light is projected from the light projecting portion 122, in what manner light is projected from the light projecting portion 122 (whether light is continuously projected or intermittently). The manner in which the liquid crystal element 101 is controlled, and the manner in which the information is disseminated by controlling the liquid crystal element, will be described in detail in the section of this specification, in which the control system is described.

Figure 7:
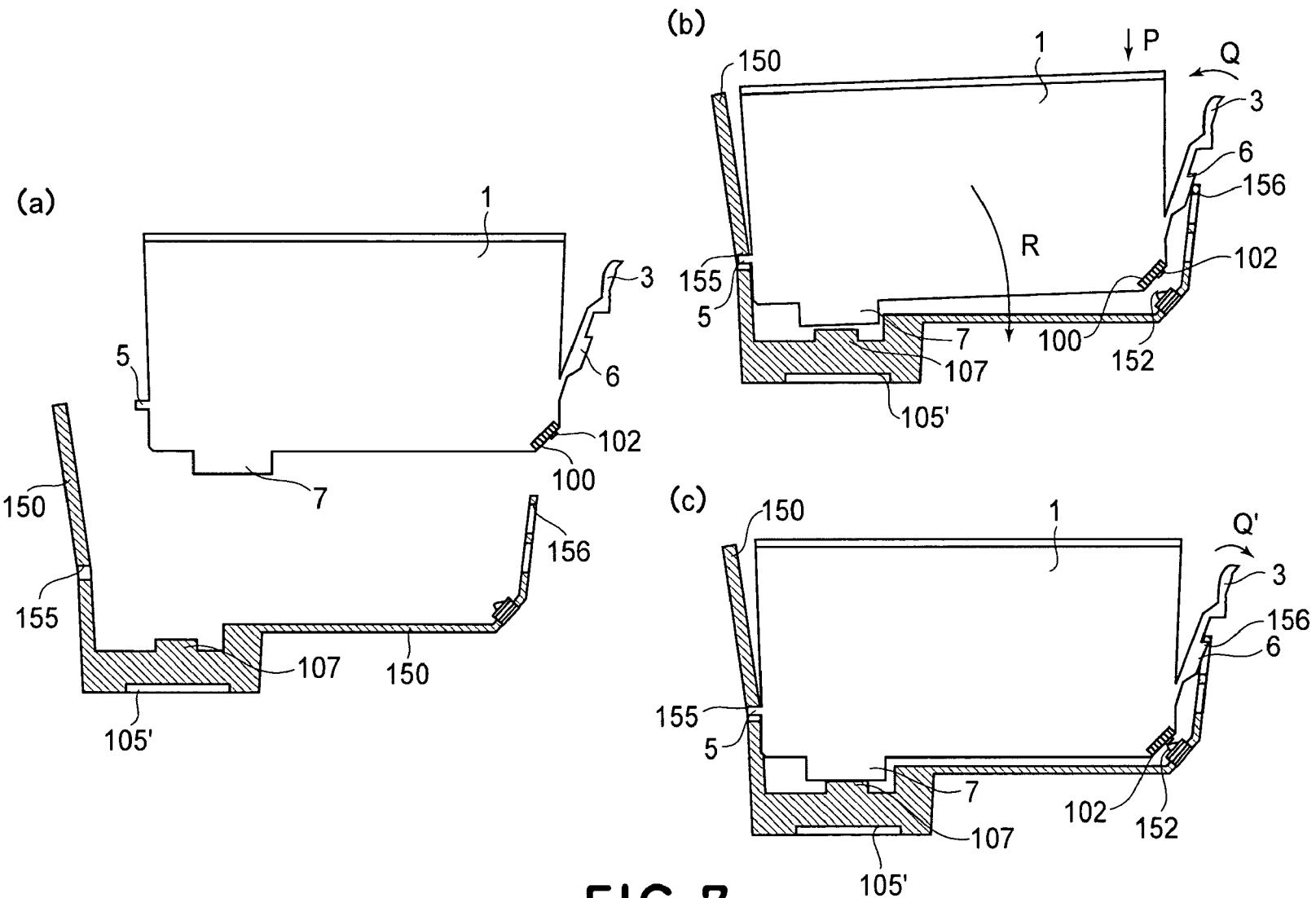
FIGS. 7(*a*)-7(*c*) are schematic sectional views of the ink container and holder in the first embodiment, at a plane parallel to the lateral walls of the ink container, showing the operation for mounting the ink container into the holder, or dismounting the ink container from the holder.
Figure 8:
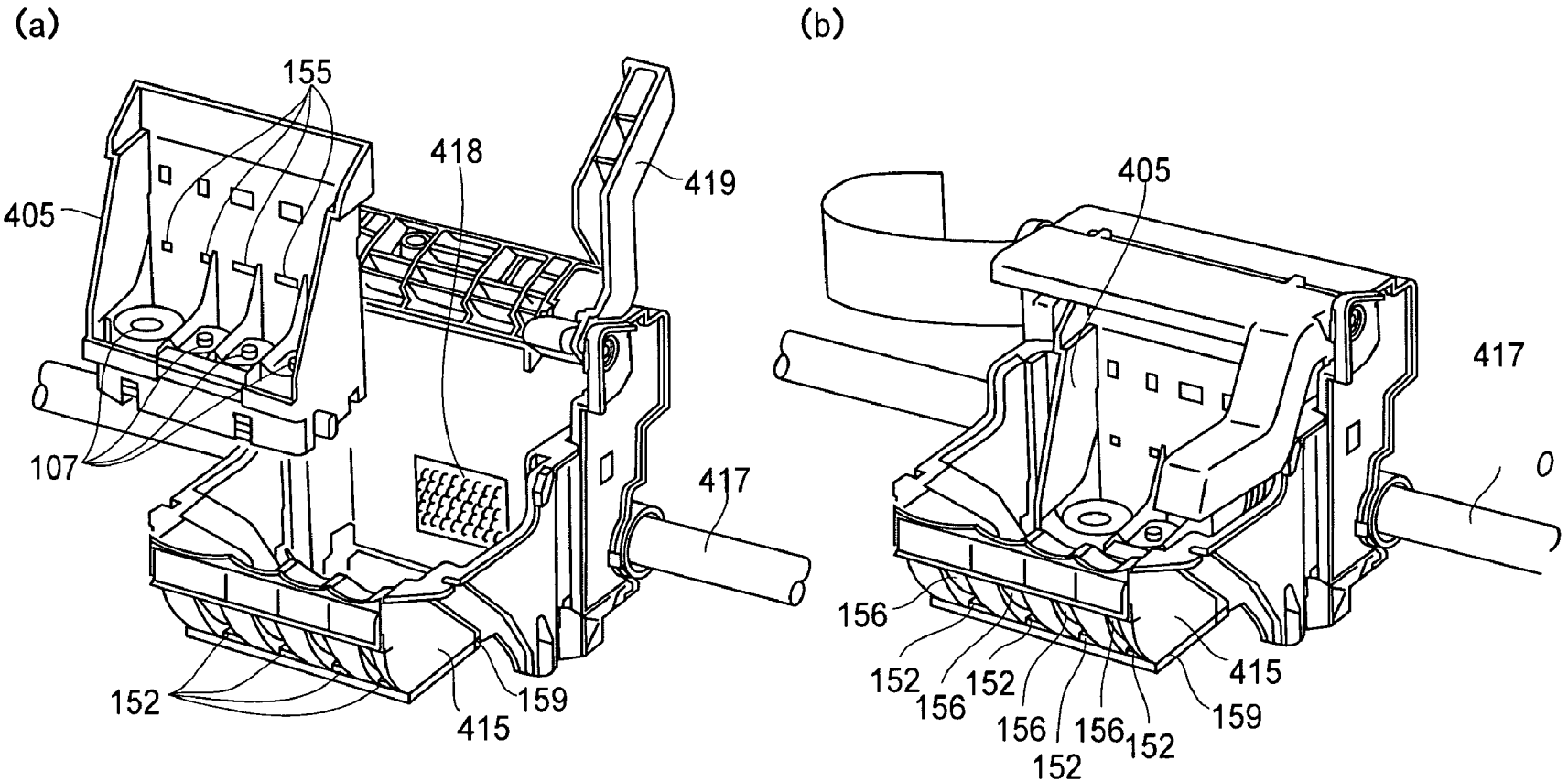
FIGS. 8(*a*) and 8(*b*) are perspective views of another example of the portion of the ink jet recording apparatus, to which the ink container in the first embodiment is attachable.

1.2. Ink Container Holder (FIGS. 6-8)

Figure 6:
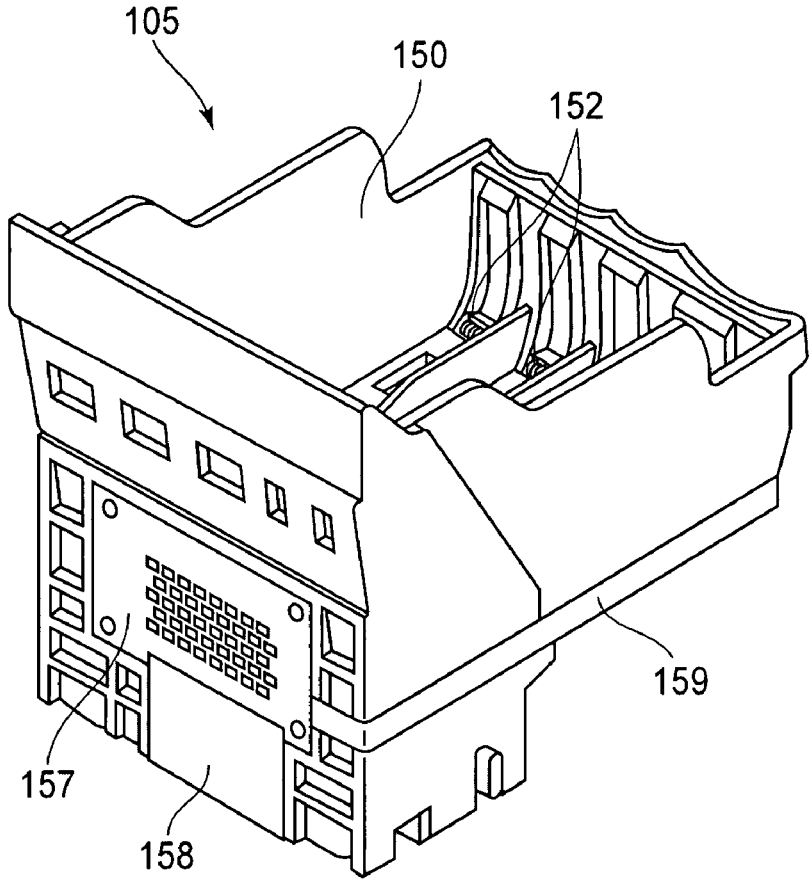
FIG. 6 is a perspective view of an example of a recording head unit having a holder into which the ink container in the first embodiment is placed.

FIG. 6 is a perspective view of an example of the recording head unit structured so that the ink container in the first embodiment can be removably mountable in the recording head unit. FIGS. 7(*a*)-7(*c*) are sectional views of the ink container 1 and ink container holder 150, which were drawn to describe the operation for mounting the ink container 1 into the recording head unit.

Generally, the recording head unit 105 is made up of the holder 150, in which multiple (four in this embodiment) ink containers are removably mountable, and the recording head 105' (which is not shown in FIG. 6) which is on the bottom side of the holder 150. As the ink container 1 is mounted into the holder 150, the ink inlet 107 of the recording head 105', which is at the bottom of the holder 150, couples with the ink outlet 7 of the ink container 1, forming an ink passage between the ink container 1 and recording head.

As the recording head 105', a recording head which employs electro-thermal transducing elements, which are placed in liquid passages which serve as ink jetting nozzles, may be employed. In the case of a recording head which employs electro-thermal transducing elements, a recording signal, which is in the form of an electrical pulse, is given to a given electro-thermal transducing element to apply thermal energy to ink to change the ink in phase, and the pressure generated by the change in the phase of ink is used to jet ink.

The carriage 205, which will be described later, is provided with an electrical contact portion (unshown) for electrical signal transmission, whereas the recording head unit 105 is provided with an electrical contact portion 157. As the recording head 105 is mounted on the carriage, the electrical contact 157 comes into contact with the electrical contact portion of the carriage, making it possible for recording signals to be transmitted to the electro-thermal transducer element driving circuit of the recording head 105 through a wiring portion 158. There is a wiring portion 159 which extends from the electrical contact portion 157 to the antenna chip 152.

When mounting the ink container 1 into the recording head unit 105, the ink container 1 is to be positioned above the holder 150 (FIG. 7(*a*)). Then, the first engaging portion 5 of the ink container 1, which protrudes rearward from the rear surface of the ink container 1, is to be inserted into the first engaging portion 155 of the holder 150, which is a through hole in the rear wall of the holder 150. Then, the ink container 1 is to be pressed down by its top front end in the direction indicated by an arrow mark P while keeping the first engaging portion 5 in the first engaging portion 155 (FIG. 7(*b*)). As the ink container 1 is pressed downward by its top front end, the ink container 1 rotates in the direction indicated by an arrow mark R about the contact area between the first engaging portion 5 and first engaging portion 155, so that the front end of the ink container 1 displaces downward. During this process, the supporting member 3 also displaces downward in the direction indicated by an arrow mark Q, while remaining under the pressure applied upon the front surface of the second engaging portion 6 of the supporting member 3 by the second engaging portion 156 with which the front wall of the holder 150 is provided.

Then, as the top surface of the second engaging portion 6 reaches the bottom surface of the second engaging portion 156, the supporting member 3 is displaced in the direction indicated by an arrow mark Q' by its own elasticity. In other words, the second engaging portion 6 becomes engaged with the second engaging portion 156. When the ink container 1 and holder 150 are in this state (FIG. 7(*c*)), the second engaging portion 156 continuously and elastically presses the ink container 1 in the horizontal direction through the supporting member 3, keeping thereby the rear surface of the ink container 1 in contact with the front surface of the rear wall of the holder 150. Further, the ink container 1 is prevented from displacing upward, by the first engaging portion 155 which is in engagement with the first engaging portion 5, and the second engaging portion 156 which is in engagement with the second engaging portion 6. That is, the state of the ink container 1, which is shown in FIG. 7(*c*), is the state in which the ink container 1 is at the end of the operation for mounting the ink container 1 into the holder 150. In this state, the ink outlet 7 and ink inlet 107 are in connection with each other; they couple with each other at the end of the operation. Further, at the end of the ink container mounting operation, the antenna 102 on the control chip 100 of the ink container 1 is positioned next to the antenna 220 of the antenna chip 152 of the main assembly of the recording apparatus, in a manner to directly oppose the antenna 220.

Comparing the movement of the ink container 1 to the movement of a lever, while the ink container 1 is moved as shown in FIG. 7(*b*), the contact point between the first engaging portion 5 and first engaging portion 155 functions as the fulcrum, and the front end of the ink container 1 functions as the force application point. The contact area between the ink outlet 7 and ink inlet 107 is the point of action, which is desired to be between the point of force application and the fulcrum, preferably, near the fulcrum. Therefore, as the front end of the ink container 1 is pressed downward, the ink outlet 7 is pressed upon the ink inlet 107 by a substantially greater amount of force than that is applied to the front end of the ink container 1 to press downward the front end of the ink container 1. In order to ensure that ink is reliably supplied from the ink container 1 to the recording head, either the portion of the ink outlet 7, which comes into contact with the ink inlet 107, or the portion of the ink inlet 107, which comes into contact with the ink outlet 7, or both of them, are provided with a filter, an absorbent member, a seal (relatively flexible elastic member), etc.

In consideration of the purposes for which the filter, absorbent member, seal, etc., are provided, structuring the ink container 1 and holder 150 as described above so that the ink container 1 is to be mounted through the steps described above in order to elastically deform these components, is desirable. After the completion of the mounting of the ink container 1, the first engaging portion 155 with which the first engaging portion 5 is in engagement, and the second engaging portion 156 with which the second engaging portion 6 is in engagement, prevent the ink container 1 from being lifted by the elasticity of these components, preventing thereby the abovementioned elastic members from regaining their original forms. In other words, these elastic members are kept in the properly deformed state.

The structural arrangement which is involved in the mounting of the ink container 1 into the holder 150 and the securing the ink container 1 to the holder 150 does not need to be limited to that in this embodiment, that is, the structural arrangement shown in FIG. 6. In other words, the structural arrangement may be different from that shown in FIG. 6.

One of the structural arrangements which are involved in the mounting of the ink container 1 into the main assembly of the recording head unit, and which are different from the one shown in FIG. 6, will be described with reference to FIG. 8. FIG. 8(*a*) is a perspective view of the recording head unit (which is supplied with the ink from the ink container 1 to records images), which is different from the recording head unit described above, and a carriage into which the recording head unit is mounted, and shows their structures. FIG. 8(*b*) is a perspective view of the recording head unit and carriage, shown in FIG. 8(*a*), which are in connection with each other.

This recording head unit 405 is different from the recording head unit 105 described above, in that it does not have a portion equivalent to the portion of the holder 150, which opposes the front side of the ink container 1, and the second engaging portion, antenna chip, etc., which this portion of the holder 150 has. (FIG. 8(*a*)). Otherwise, this recording head unit 405 is roughly the same as the recording head unit 105. That is, the bottom wall of the recording head unit 405 is provided with the ink inlet 107 which is to be coupled with the ink outlet 7. The rear wall of the recording head unit 405 is provided with the first engaging portion 155, and its rear surface is provided with electrical contact portion (unshown) for signal transmission.

Referring to FIG. 8(*b*), on the other hand, a carriage 415, which is movable along a shaft 417, is provided with a lever 419 for firmly securing the recording head unit 405 to the carriage 415 after the mounting of the recording head unit 405 into the carriage 415, and an electrical contact portion 418 which is in contact with the electrical contact portion of the recording head. The carriage 415 is also provided with a holder portion, the structure of which matches that of the front side of the ink container 1. That is, the second engaging portion 156, antenna chip 152, and wiring portion 159 for connector, which the holder 150 has in the case of the structural arrangement described above, are on the carriage side.

In this structural arrangement, as the recording head unit 405 is mounted into the carriage 415 as shown in FIG. 8(*b*), a structure similar to the entirety of the holder 150 is realized. Thus, as the ink container 1 is mounted into this structure similar to the holder 150 through the steps in the operation for mounting the ink container 1 into the holder 150, which are shown in FIG. 7, the ink outlet 7 is engaged with the ink inlet 107, and the antenna 102 is placed next to the antenna chip 152 of the main assembly in a manner to oppose the antenna 152, ending thereby the operation for mounting the ink container 1.

1.3. Recording Apparatus (FIGS. 9 and 10)

Figure 9:
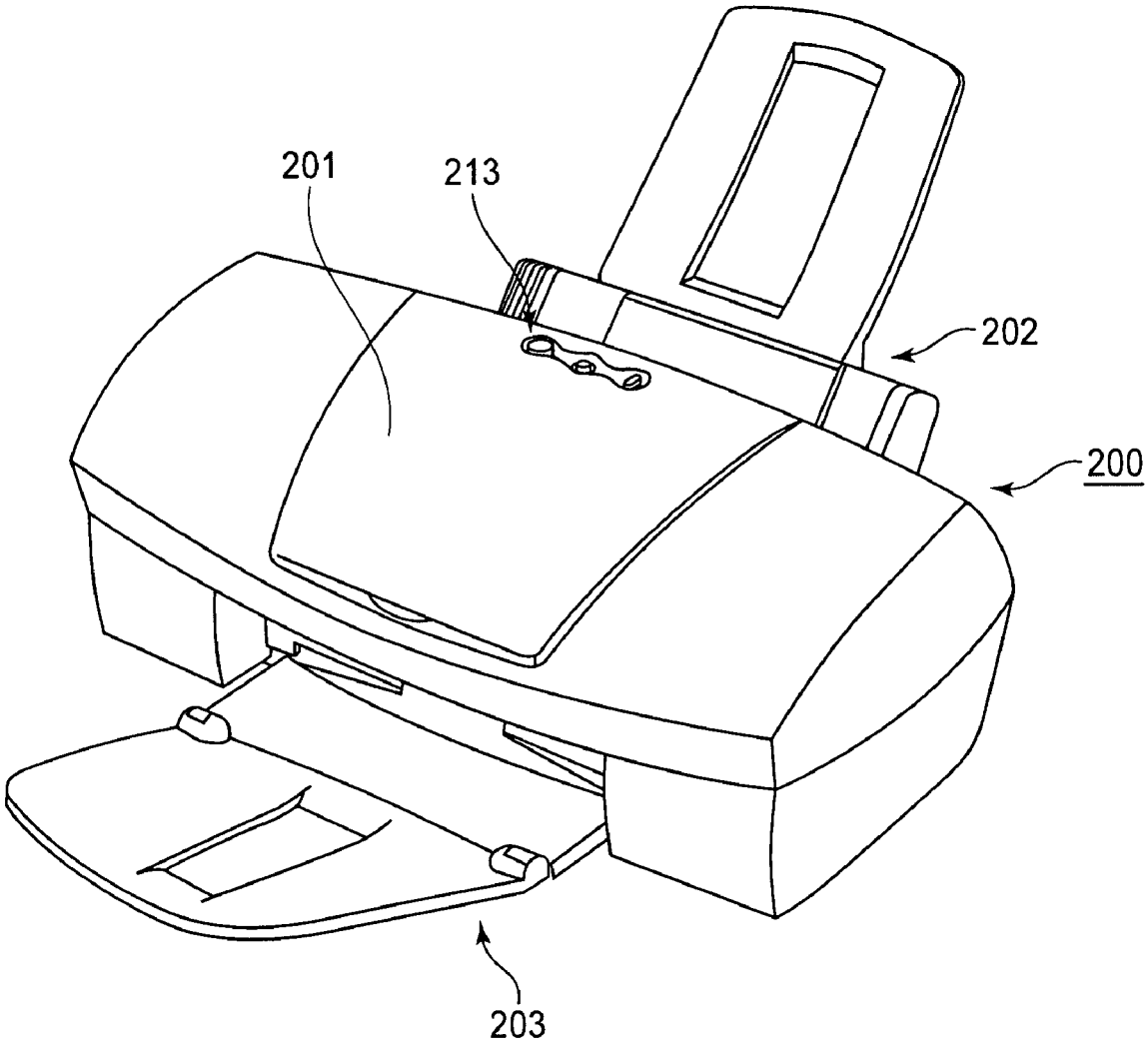
FIG. 9 is an external perspective view of an example of an ink jet printer, in which the ink container(s) in the first embodiment is mounted for recording.

FIG. 9 is an external perspective view of the ink jet recording apparatus 200 (which hereafter will be referred to as printer) in which the ink container described above is mounted to record images. FIG. 10 is an external perspective view of the same printer as that in FIG. 9, except that in FIG. 10, the main assembly cover 201 of the printer is open.

Referring to FIG. 9, the printer 200 in this embodiment has a main assembly, which constitutes the primary portion of the printer and is made up of a carriage which carries a recording head and ink containers, and a mechanism for moving the carriage in a manner to scan recording medium to record images. The printer main assembly is covered with an external shell, which includes the main assembly cover 201. The printer 200 is provided with a delivery tray 203 and an automatic sheet feeding apparatus 202, which are on the front and rear sides of the printer main assembly, respectively. The printer 200 is also provided with a control panel 213 which has a display screen for showing the state of the printer, an electric power switch, and a reset switch, and which can be used whether the main assembly cover 201 is open or closed.

Figure 10:
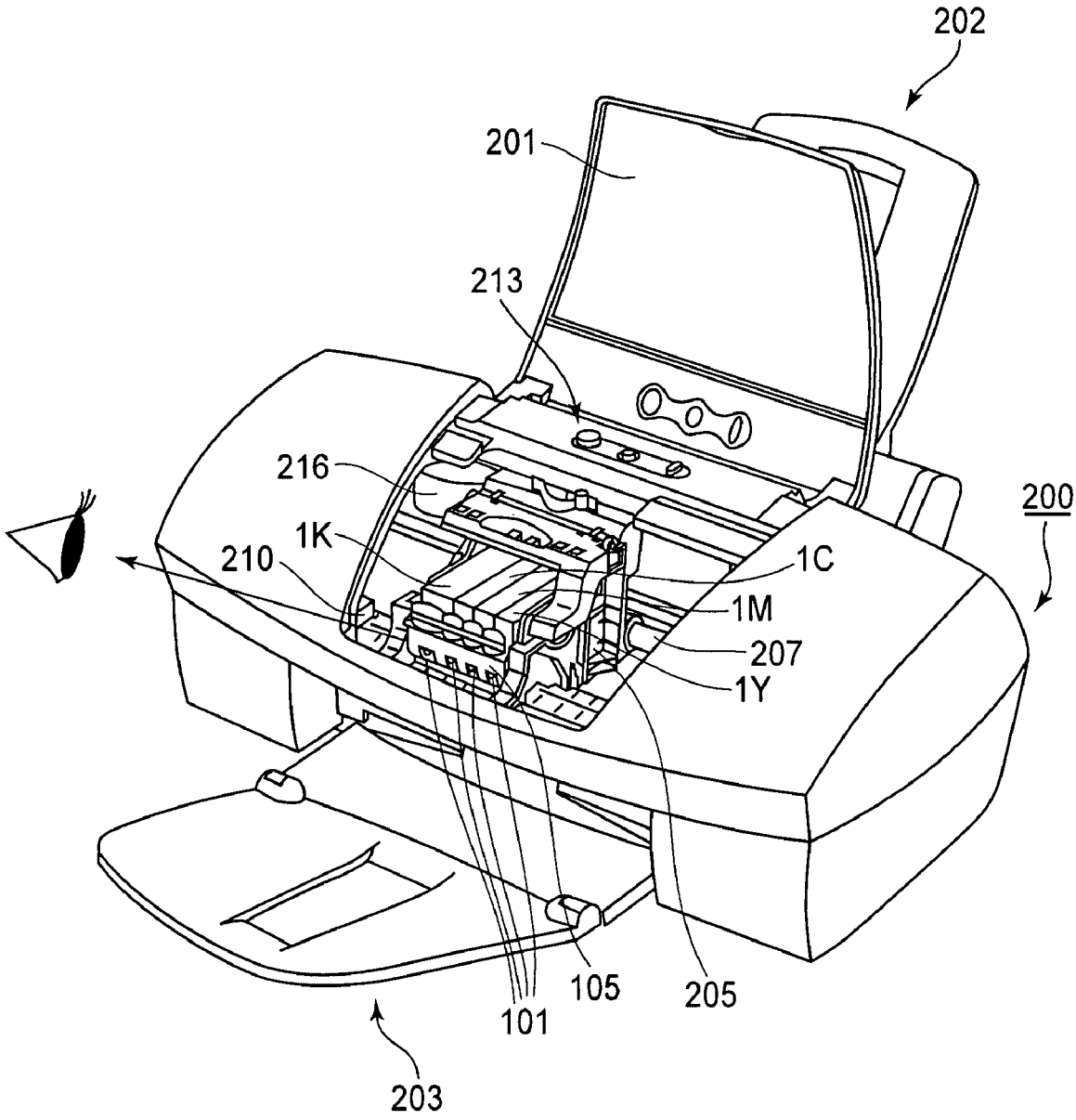
FIG. 10 is an external perspective view of the same ink jet printer as the one in FIG. 9, except that the cover of its main assembly is open.

When the main assembly cover 201 is open as shown in FIG. 10, the range in which the carriage 205 moves while carrying the recording head unit 105 and ink containers 1K, 1Y, 1M, and 1C, and the adjacencies of the range, are visible to a user. In the following sections of this specification, the ink containers 1K, 1Y, 1M, and 1C may sometimes be referred to simply as ink container 1. In reality, as the main assembly cover 201 is opened, the sequence for automatically moving the carriage 205 to roughly the center of the printer main assembly (which hereafter may be referred to as "ink container replacement position"), where a user can replace any or all of the ink containers on the carriage 205 and/or carry out the operation related to the cartridge replacement.

The printer in this embodiment employs multiple recording heads (unshown) which correspond one for one to the multiple inks different in color, and which are mounted in the recording head unit 105. As the carriage 205 is moved in a manner to scan recording medium, such as paper, while carrying these recording heads, which are different in the color of the ink they jet, the recording heads move with the carriage 205 in a manner to scan the recording medium, while jetting ink onto the recording medium. As a result, recording is made on the recording medium; an image is effected on the recording medium. More specifically, the carriage 205 is in engagement with a guiding shaft 207, which extends in the moving direction of the carriage 205. The carriage 205 is slidably movable on the guiding shaft 207 by a carriage motor and a driving force transmission mechanism which is in connection with the carriage motor and carriage 205. The multiple recording heads, which correspond to K, Y, M, and C inks one for one, jet ink based on the data (for jetting ink) sent from the control circuit on the printer main assembly side, through a flexible cable 206. The printer main assembly is also provided with a paper conveying mechanism made up of paper conveyance rollers, paper discharge rollers, etc., making it possible for the recording medium (unshown) fed from the automatic sheet feeding apparatus 202, to be conveyed to the delivery tray 203. The recording head unit 105 has an ink container holder portion, which is integrally formed with the recording head unit 105. The recording head unit 105 is removably mountable. Each of the multiple ink containers different in the color of the ink they jet is removably mountable in the recording head unit 105. In other words, it is possible to mount each of the ink containers 1 in the recording head unit 105 after mounting the recording head unit 105 into the carriage 205. That is, in this embodiment, the ink containers are removably mountable in the carriage 205, with the presence of the recording head unit 105 between the ink containers 1 and carriage 205. Further, mounting the ink container 1 into the recording head unit 105 completes one of the examples of the liquid supplying system in accordance with the present invention.

The recording operation by this recording apparatus is as follows: Each of the recording heads 1 jets ink onto recording medium while the recording heads are moved in a manner to scan the recording medium as described above. As a result, a portion of an intended image, the width of which in terms of the recording medium conveyance direction matches the length of a row of ink jetting orifices the recording head, is effected on the recording medium. Before the recording heads begin to be moved again in a manner to scan the recording medium, the recording medium is conveyed by the abovementioned sheet conveyance mechanism, by the preset distance, which equals to the length of the row of ink jetting orifices. This process of conveying the recording medium by the preset distance, and the abovementioned process of causing the recording heads to jet ink while moving them in a manner to scan the recording medium, are alternately repeated until the entirety of the intended image is completed. Further, the printer main assembly is provided with a recording head performance recovery unit, which is located at one end of the range in which the recording heads are moved by the movement of the carriage. The recording head performance recovery unit is made up of caps, or the like, which cover the surface of each recording head, which has the opening of each of the ink jetting orifices. Thus, the recording heads are moved to the location of the recovery unit, with preset intervals, to be subjected to a performance recovery process, such as the preparatory jetting of ink.

The recording unit 105 which has the holder portion for the ink containers 1, is provided with the antenna chip 152, as described before. As each of the ink containers 1 is mounted into the ink container holder portion of the recording unit 105, the antenna 102 of the control chip 100 of the ink container 1 is placed close to the antenna 220 on the antenna chip 152, making it possible to control the liquid crystal element 101 of the ink container 1, following the sequence, which will be described later with reference to FIGS. 19-21, to transmit or block the light emitted by the LED 221, that is, to allow the light to be projected (which hereafter may be referred to as "left on"), or not to allow the light to be projected (which hereafter may be referred to as "left off").

More concretely, as the amount of the ink remainder in a given ink container falls below a preset level, the liquid crystal element 101 of the given ink container 1 is controlled to transmit or block the light from the LED 221, to continuously or intermittently illuminate the light projecting portion 122, when the carriage 205 is at the abovementioned ink container replacement position. Further, the printer main assembly in this embodiment is provided with a first light receiving portion 210, which is in the adjacencies of the opposite end of the moving range of the carriage 205 from the recovery unit described above, and which has a light receiving element. Thus, when the liquid crystal element 101 of each of the ink containers 1 on the carriage 205 is moved across the area in front the first light receiving portion by the movement of the carriage 205, the liquid crystal element 101 is controlled so that it transmits light. Therefore, the light from the LED 221 is projected from the light projecting portion 122. Thus, the position of the given ink container 1 relative to the carriage 205 can be determined based on where the carriage 205 is when the light projected from the light projecting portion 122 is received by the first light receiving portion 210. As for another way of controlling the liquid crystal element 101, when the carriage 205 is at the abovementioned ink container replacement position, the liquid crystal element 101 may be controlled so that it transmits light to keep the light projecting portion 122 illuminated, if a given ink container 1 is correctly mounted. These controls are executed based on the control data (control signals), which are wirelessly transmitted to each of the ink containers 1 from the control circuit on the printer main assembly side through the flexible cable 206, as are the control of the ink jetting operation, or the like, of the recording head.

2. Structure of Control System

2.1. General Structure (FIG. 11)

Figure 11:
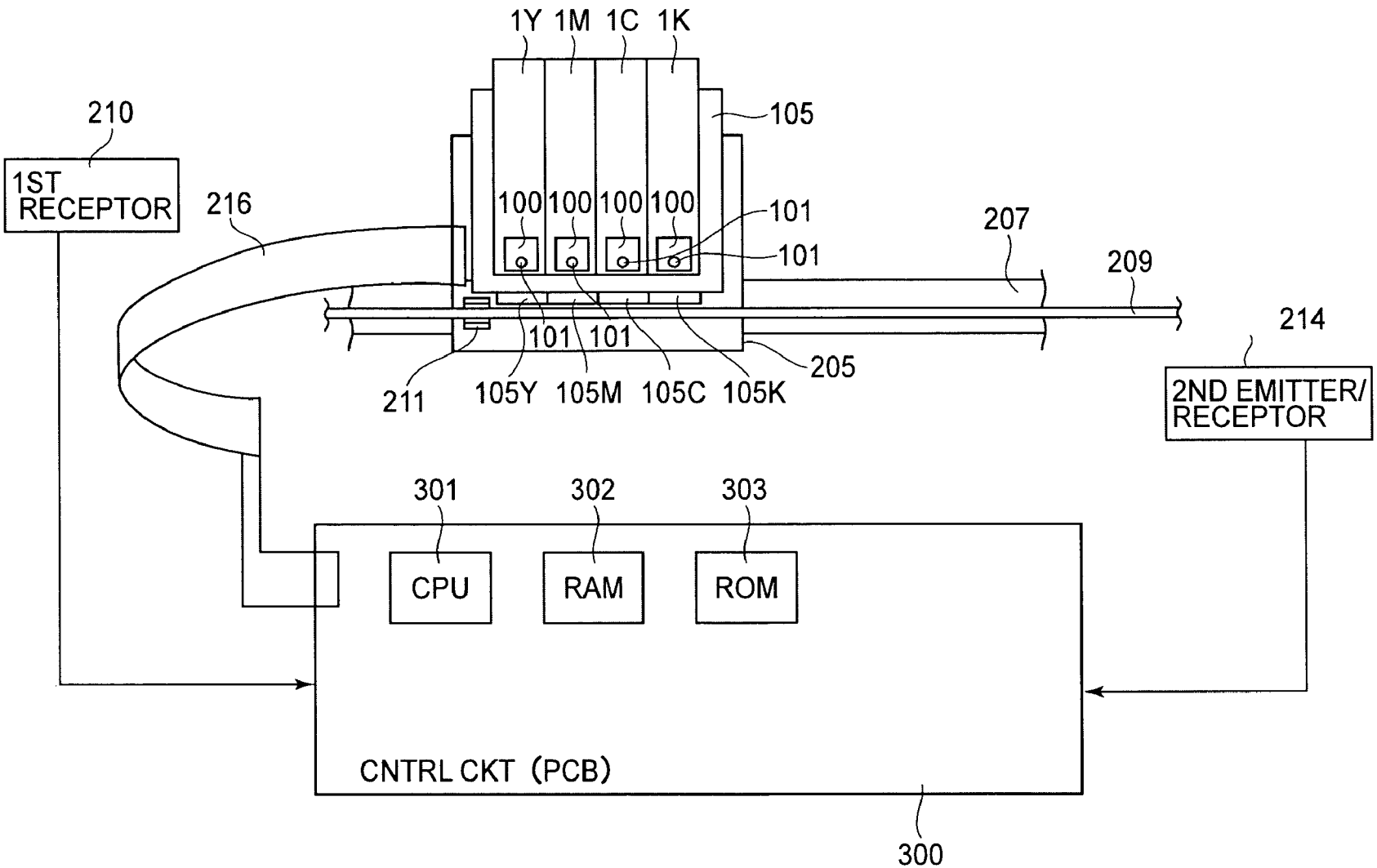
FIG. 11 is a block diagram of the control system of the ink jet printer in the first embodiment, showing the structure of the control system.

FIG. 11 is a block diagram of an example of the structure of the control system of the ink jet printer described above. This drawing primarily shows the control circuit of the printer main assembly, which is in the form of a PCB (printed circuit board), and the structural components involved in the control of the liquid crystal element of the ink container, which are controlled by the control circuit.

Referring to FIG. 11, the control circuit 300 processes the data regarding this printer, and also, controls various operations of the printer. More concretely, a CPU 301 carries out the processes, which will be described later with reference to FIGS. 19-21, following the programs stored in a ROM 303. A RAM 302 is used as a work area when the abovementioned processes are carried out by the CPU 301.

The recording head 105 in the carriage 205 is holding recording heads 105K, 105Y, 105M, and 105C, as schematically shown in FIG. 11. The recording heads 105K 105Y, 105M, and 105C have multiple orifices for jetting black (K), yellow (Y), magenta (M), and cyan (C) inks, respectively. The ink containers 1K, 1Y, 1M, and 1C are removably mounted in the ink container holder of the recording head unit 105 so that their positions correspond to those of the recording heads 105K, 105Y, 105M, and 105C, respectively.

Each ink container 1 has the control chip 100 made up of the liquid crystal element 101, control circuit 103, antenna 102, etc., as described before. As the ink container 1 is properly mounted into the recording head unit 105, the antenna 102 on the control chip 100 is placed close to the antenna chip 152, which has the antenna on the recording head unit 105 side and is common for all the antenna 102, being structured to oppose all the ink containers 1. Further, the connector (unshown) with which the carriage 205 is provided becomes indirectly connected to the control circuit 300 of the printer main assembly, through the flexible cable 206, making it possible for electrical signals to be transmitted between the control chip 100 and control circuit 300. Further, as the recording head unit 105 is mounted into the carriage 205, the abovementioned connector of the carriage 205 becomes connected to the abovementioned connector of the recording head unit 105, making it possible for electrical signals to be transmitted between the two sides. The provision of the above described connective structure and communicational structure makes it possible for electrical signals to be exchanged between the control circuit 300 of the printer main assembly and the control chip 100 of the ink container 1. Therefore, it becomes possible for the control circuit 300 to control the operation for continuously or intermittently illuminate the light projecting portion 122, following the control sequence which will be described later with reference to FIGS. 19-21.

The ink jetting operation carried out by each of the recording heads 105K, 105Y, 105M, and 105C is also controlled in the same manner as described above. That is, the driver circuit, etc., with which the recording head is provided, are indirectly connected with the control circuit 300 of the printer main assembly, through the flexible cable 206, connector of the carriage, and connector of the recording head unit, making it possible for electrical signals to be exchanged between the driver circuit, etc. of the recording head and the control circuit 300. Therefore, the control circuit 300 can control various operations of the recording head, such as the ink jetting operation.

The first light receiving portion 210, which is in the adjacencies of one end of the moving range of the carriage 205, receives the light projected from the light projecting portion 122, according to the setting of the liquid crystal element 101 of the ink container 1, and outputs a signal which corresponds to the light from the light projecting portion 122, to the control circuit 300. Based on this signal, the control circuit 300 can determine the position of each of the ink containers 1 on the carriage 205 relative to the carriage 205, as will be described later. The printer main assembly is also provided with an encoder scale 209, which extends along the moving range of the carriage 205, whereas the carriage 205 is provided with an encoder 211. The output signal of this sensor is inputted into the control circuit 300 through the flexible cable 206, making it possible for the control circuit 300 to determine the position of the carriage 205. Not only is this information regarding the carriage position used for controlling the jetting of ink by each recording head, but also, for the process for optically verifying the ink container position relative to the carriage 205, which will be described later with reference to FIG. 19, etc. The printer main assembly is also provided with a second light emitting-receiving portion 214, which is in the adjacencies of a preselected point in the moving range of the carriage 205, that is, a location at which the second light emitting-receiving portion 214 opposes the ink absence detection member 17 of the ink container 1, which is in the form of a prism. The light emitting-receiving portion 214 has a light emitting element and a light receiving element. The light receiving element outputs signals which carry the information regarding the amount of the ink remainder in each of the ink containers 1 on the carriage 205, to the control circuit 300. Based on these signals, the control circuit 300 can determine the amount of the ink remainder in each ink container 1.

2.2. Display Control (FIGS. 12-18)

Figure 12:
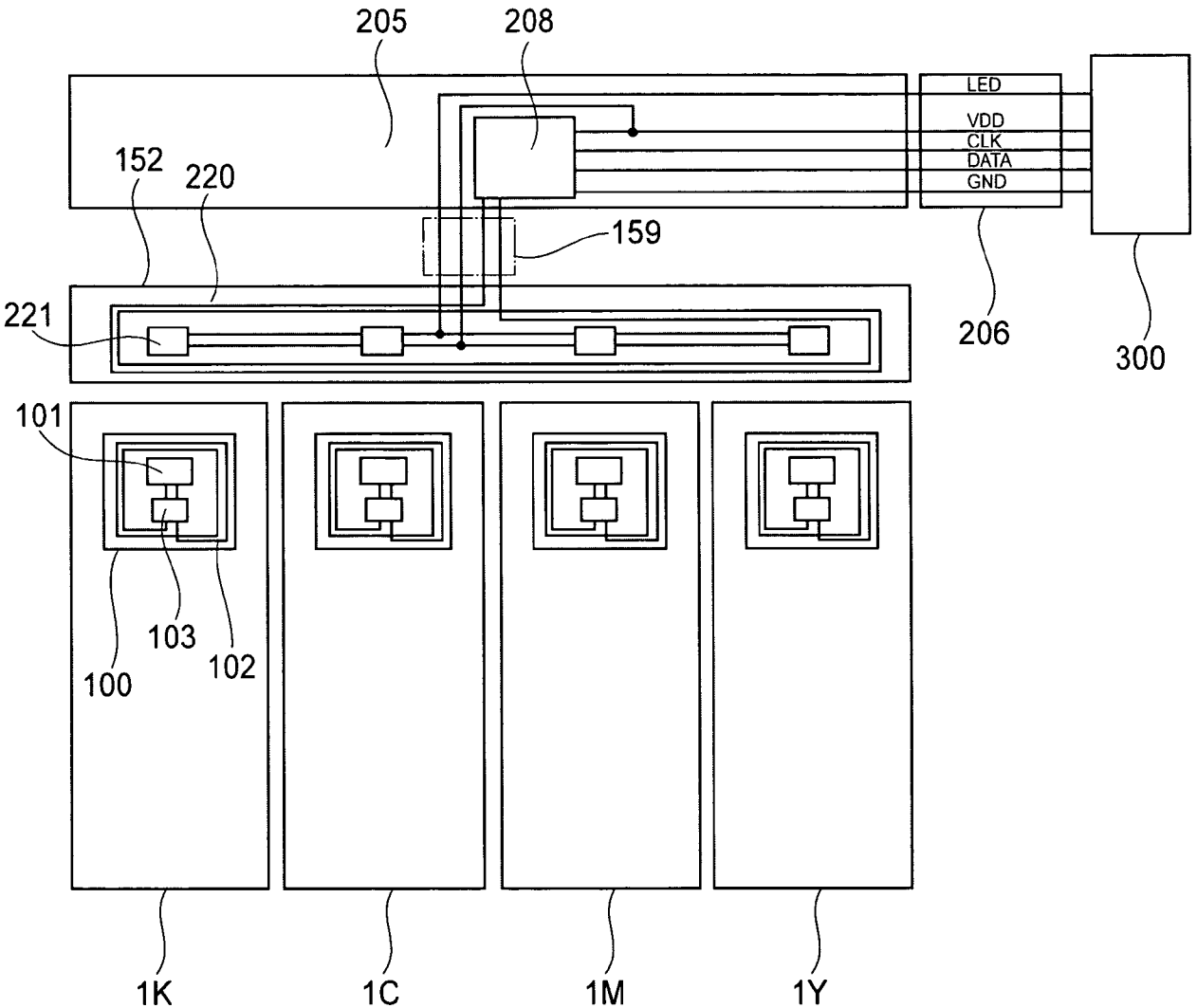
FIG. 12 is a wiring diagram which shows the relationship among the signal wires of the flexible cable of the ink jet printer, and the antenna chip of each ink container in the main assembly of the ink jet printer.

FIG. 12 is a wiring diagram which shows the structure of the signal wiring which makes it possible for the control circuit 300 to wirelessly communicate with each of the ink containers 1 on the carriage 205, in particular, the relationship between the control circuit 300 and the control chip 100 of each ink container 1.

Referring to FIG. 12, there is a control circuit 208 on the carriage 205. The signal wiring which connects the control circuit 300, that is, the control circuit on the main assembly side, to the control circuit 208, has signal wires 206 for transmitting five different signals, such as the following signals:

1) electric power signal regarding electric power supply (VDD), 2) ground signal (GND), 3) data signal (DATA) for sending from the control circuit 300, the control signals (control data), or the like, regarding the operation for turning on or off the liquid crystal element 101 to make the light projecting portion 122 continuously or intermittently illuminate, 4) clock signal (CLK), and 5) driver signal (LED) for driving the LED 221, that is, the light emitting portion of the printer main assembly. This embodiment is described with reference to these five types of signals. However, the five types of signal are not intended to limit the present invention in scope. That is, the selection of control signal type and the signal wire therefor are optional; control signals and the signal wires therefor, which are different from those mentioned above, may be provided as necessary.

The control circuit 208 is made up of a high frequency wave modulation-demodulation circuit for wirelessly transmitting primarily "DATA" and "CLK", and is in connection with the antenna 220 on the antenna chip 152, which is in the form of a loop, through the wiring 159. From the antenna 220, electromagnetic wave, which is the short-wave range, for example, is sent out to the antenna 102, or the antenna on the ink container side. Incidentally, the control circuit 208 in this embodiment is on the carriage 205. However, it may be placed on the antenna chip 152.

On the other hand, the control chip 100 of each ink container 1 is provided with: the antenna 102 for allowing the control chip 100 to wirelessly communicate with the main assembly; control portion 103 for processing the received high frequency wave signals, or processing high frequency wave signals to transmit them; and liquid crystal element 101 which is controlled by the received signals.

Figure 13:
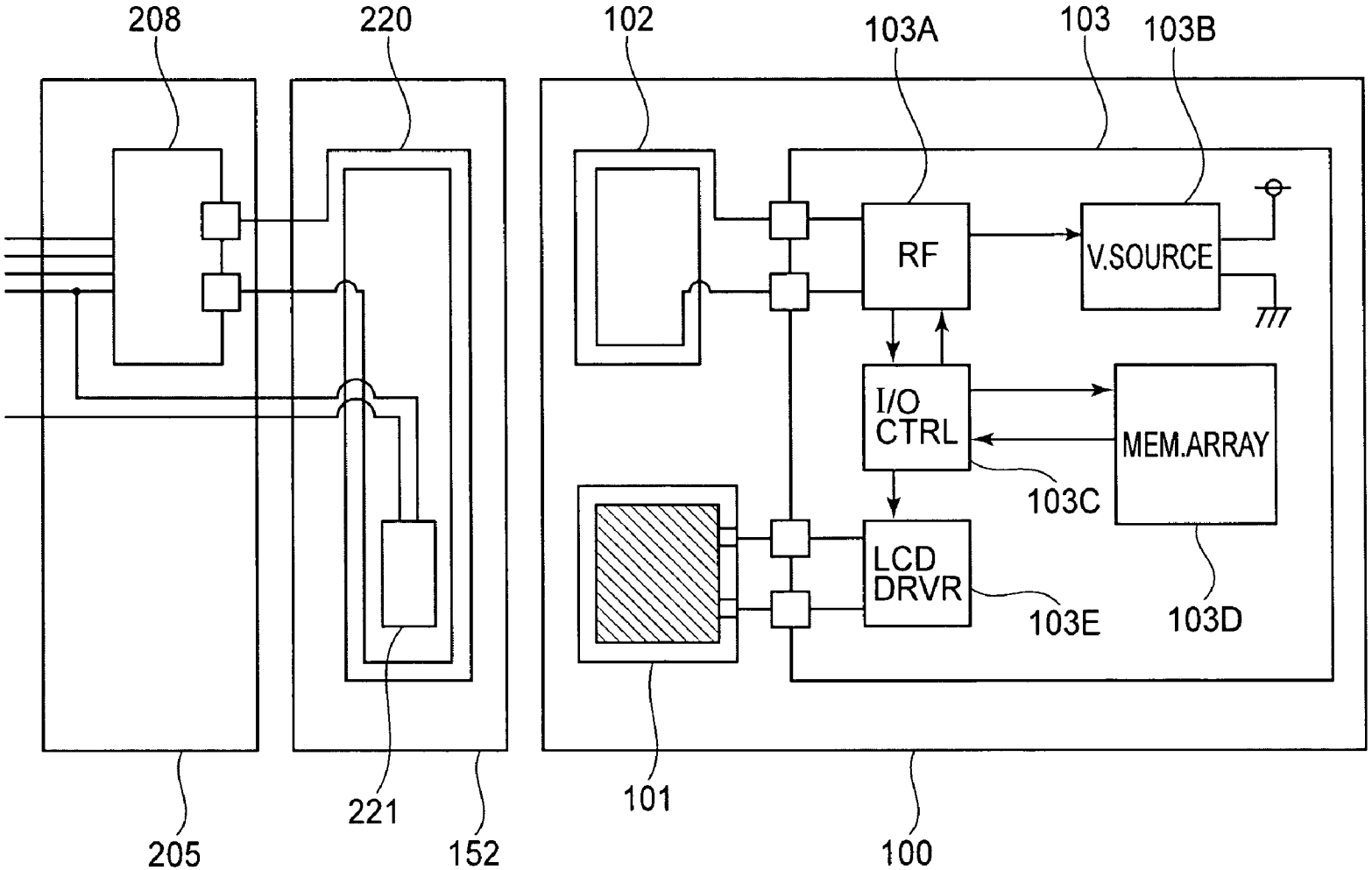
FIG. 13 is a block diagram of the control chip of the ink container, the antenna chip on the main assembly side, and carriage 205, showing the details of the control chip.

FIG. 13 is a block diagram which shows the details of the control chip 100 made up of the abovementioned control portion 103, etc. The control portion 103 is made up of the high frequency wave modulation-demodulation circuit 103A, power circuit 103B, input-output control circuit 103C (I/O CTRL), memory array 103D, and LCD driver 103E, as shown in FIG. 13.

The high frequency wave modulation-demodulation circuit 103A has the function of obtaining "DATA" and "CLK" by demodulating the high frequency wave signals which it receives from the antenna 220, that is, the antenna on the main assembly side. The high frequency wave modulation-demodulation circuit 103A also has the function of generating electromagnetic wave from the antenna 102 by modulating the high frequency wave with the signals which carry the information obtained from the memory array 103D, in order to transmit the information to the main assembly side. The power circuit 103B generates electric power from the incoming electromagnetic wave, in order to supply the input-output control circuit 103C (I/O CTRL), memory array 103D, LCD driver 103E, and liquid crystal element 101, with electric power.

The input-output control circuit 103C controls the driving of the liquid crystal element 101, writing of data into the memory array 103D, and reading of the data in the memory array 103D, in response to the control data obtained by demodulation. The memory array 103D in this embodiment is an EEPROM, or the like, and can store the amount of the ink remainder in the ink container 1, color of the ink in the ink container 1, information unique to the ink container 1, such as serial number, production lot number, and the like information related to ink container production. Incidentally, the ink color information is written into a preselected address in the memory array 103D, according to the color of the ink in each ink container 1, at the time of the shipment of each ink container from the factory, or during the manufacture of each ink container. For example, this ink color information is used as the information (information unique to each ink container) for identifying each ink container, as will be described with reference to FIGS. 14 and 15. With the use of this information, it is possible to select a specific ink container, write data into the memory array 103D of the selected ink container, read the data in the memory array 103D of the selected ink container, and control the liquid crystal element 101 of the selected ink container to disseminate the information regarding the selected ink container.

The data which are written into, or read from, the memory array 103D, are the data regarding the amount of the ink remainder in an ink container, for example. The ink container in this embodiment is provided with a prism, which is a part of the bottom wall of the ink container shell, as described above. When the amount of the ink remainder in an ink container is less than a predetermined value (level), this information can be optically obtained with the use of this prism. In this embodiment, not only does the control circuit 300 determine the amount of the ink remainder in each of the ink containers 1 as described above, but also, it counts the number of times each recording head jetted ink, based on the data regarding the jetting of ink, and calculates the amount of the ink remaining in each ink container. Further, it writes the information regarding the amount of ink remainder into the memory array 103D of the corresponding ink container, and also, reads the information, in the memory array 103D, regarding the amount of ink remainder. Therefore, the memory array 103D stores the information regarding the current amount of the ink remainder in an ink container. This information is used in conjunction with the amount of the ink remainder obtained with the use of the abovementioned prism in order to more precisely determine the amount of the ink remainder, and to determine whether or not a given ink container on the carriage 205 is a brand-new or a remounted used one, for example.

The LED driver 103E applies driving voltage to the liquid crystal element 101 when the signal outputted from the input-output control circuit 103C is "ON", turning on thereby the liquid crystal element 101. Thus, when the signal outputted from the input-output control circuit 103C is "ON", the liquid crystal element 101 remains turned on (transparent), allowing the light from the LED 221 on the antenna chip 152 on the main assembly side, to reach the light guiding member 121 through the liquid crystal element 101. Therefore, the light projecting portion 122 appears lit. On the other hand, when the abovementioned signal is OFF, the liquid crystal element 101 remains turned off (blocks light), blocking the light from the LED 221 on the antenna chip 152 on the main assembly side, preventing thereby the light from reaching the light guiding member 121 through the liquid crystal element 101. Therefore, the light projecting portion 122 appears unlit.

Incidentally, in this embodiment, a liquid crystal element which normally appears black, that is, a liquid crystal element which is transparent while electricity is flowing through the element is employed. However, a liquid crystal element which normally appears white, that is, a liquid crystal element which blocks light while electricity is flowing through the element, may be employed. If a "normally white" liquid crystal element is employed, all that is necessary is to reverse the ON/OFF logic for the driving signal.

Figure 14:
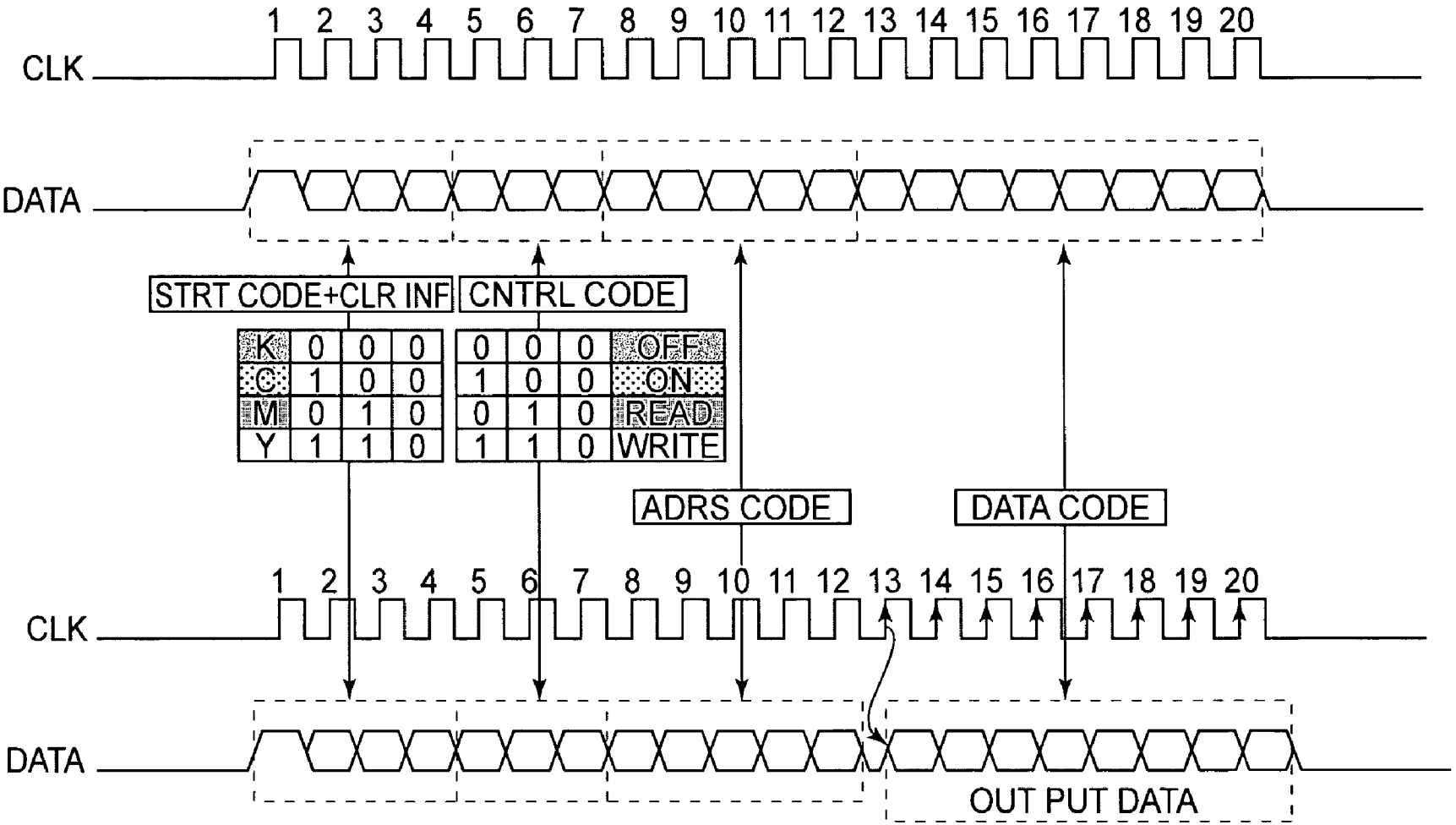
FIG. 14 is a timing chart for the operation for writing data into the memory array with which the circuit board of each ink container is provided, and the operation for reading the data in the memory array.
Figure 15:
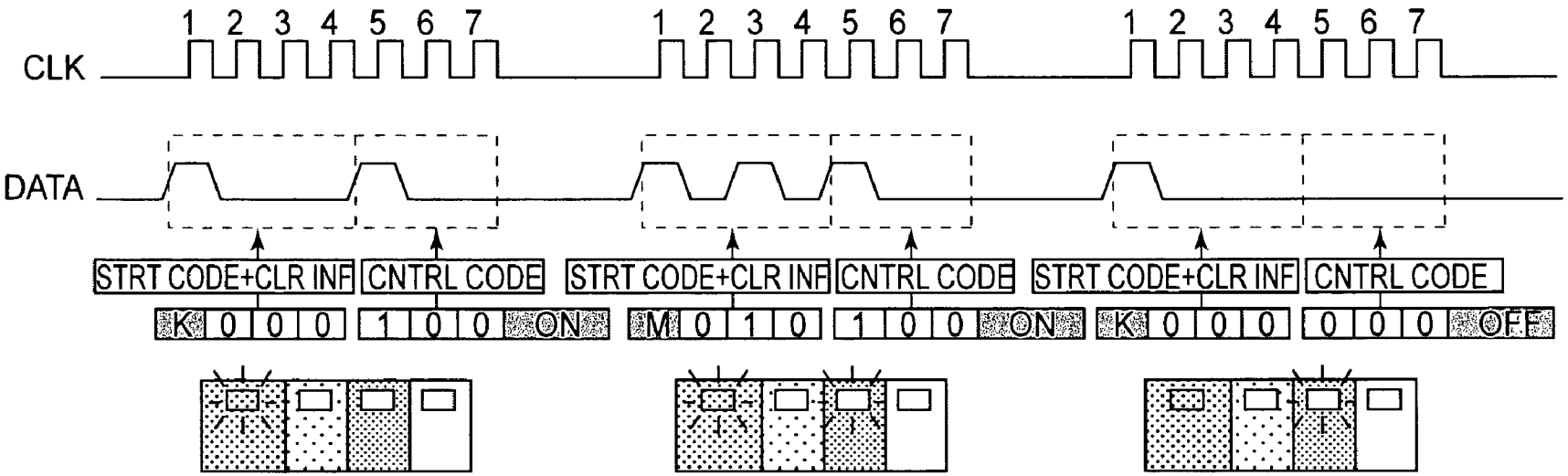
FIG. 15 is a timing chart for the operation for turning on or off the liquid crystal elements of each ink container.

FIG. 14 is a timing chart for the abovementioned operation for writing data into the memory array 103D, and operation for reading the data in the memory array 103D. FIG. 15 is a timing chart for the operation for turning on or off the liquid crystal element 101.

Referring to FIG. 14, when data are written into the memory array 103D, the following data signals are sent to the input-output control circuit 103C from the control circuit 300, that is, the control circuit on the main assembly side, through the antennas 220 and 102. That is, such data signals as "START code+COLOR information", "CONTROL code", "ADDRESS code", and "DATA code" are sequentially sent in the listed order. The "START code" portion of "START code+Color information" means the starting point of the data signal sequence, and the "COLOR information" portion specifies the ink container as the object of the incoming data signal sequence. Incidentally, "COLOR information" in this case includes not only the ink color, such as Y, M, C, etc., but also, different levels of ink density.

Also referring to the same drawing, "COLOR information" includes multiple codes, which correspond to multiple ink colors "K", "C", "M", and "Y". The input-output control circuit 103C compares the color information, which these codes indicate, with the color information stored in the memory array 103D. Then, only if they match, the input-output control circuit 103C carries out the process for taking in the rest of the data signal sequence. If they do not match, the input-output control circuit 103C carries out the process for ignoring the rest of the data signal sequence. Therefore, even though "DATA", that is, common data signals, are sent from the apparatus main assembly side to all the ink containers on the carriage 205 through the antennas, one of the ink containers on the carriage 205 is specified because of "COLOR information" included in "START code+COLOR information". Therefore, the processes which are to be carried out based on the rest of the data signal sequence, such as writing, reading, turning on or off the liquid crystal element 101, etc., are carried out only for the specified ink container. In other words, the operational processes, such as the writing of data, reading of data, turning on or off the liquid crystal element 101, etc., can be individually carried out for each ink container, based on the data included in the common data signal sequence sent to all of the four ink containers, making it possible to reduce the number of signals necessary to control these processes.

Referring to FIG. 14, the "CONTROL code" in this embodiment has: "ON" code and "OFF" code, which are used for controlling the operation for turning on or off the liquid crystal element 101; and "READ" code and "WRITE" code, which are used for controlling the operation for writing data into the memory array 103D and reading the data in the memory array 103D, respectively. In the writing operation, "WRITE" code follows the abovementioned "COLOR" code which specifies an ink container. The next code, that is, "ADDRESS" code, indicates the address of the memory array 103D into which data are to be written. The last code, that is, "DATA" code, represents the contents to be written into the memory array 103D.

Needless to say, the contents of the "CONTROL code" do not need to be limited to those described above. For example, "VERIFY" command, "CONTINUOUS READ" command, etc., may be included in addition to those described above.

In terms of the structure of data signal sequence, the reading operation is the same as the writing operation described above. Also in the reading operation, "START code+COLOR information" is taken in by the input-output control circuits 103C of all the ink containers, and the rest of the data signal sequence is taken in only by the input-output control circuit 103C of the ink container, which matches "CONTROL code" in "COLOR information".

Referring to FIG. 15, in the operation for turning on or off the liquid crystal element 101, first, the portion of the data signal sequence, which corresponds to "START code+COLOR information" is sent from the main assembly side to the input-output control circuit 103C through the antennas, as in the operations described above. Then, one of the ink containers is specified based on the "COLOR information" as described above, and the operation for turning on or off the liquid crystal element 101 based on "CONTROL code" sent thereafter, is carried out only for the specified ink container. "CONTROL code" which is involved in turning on or off the liquid crystal element 101, includes "ON" or "OFF" code, as described above. The liquid crystal element 101 is turned on, being enabled to transmit light, by "ON" code, and is turned off by "OFF" code, being enable to block light. That is, if "CONTROL" code has "ON" code, the input-output control circuit 103C continuously outputs an "ON" signal to the LCD driver 103E, as described with reference to FIG. 13. On the other hand, if "CONTROL code" has "OFF" code, the input-output control circuit 103C continuously outputs "OFF" signal to the LCD driver 103E.

In the case of the data signal sequence shown in FIG. 15, it is the black ink container 1K that is specified first, and its liquid crystal element 101 is kept turned on, as the leftmost portion of the data signal sequence shows. "COLOR information" of the second portion of the data signal sequence specifies the magenta ink M. "CONTROL code" indicates "ON". Therefore, the liquid crystal element 101 of the ink container for the ink M is turned on while the liquid crystal element 101 of the ink container for the black ink K remains turned on. The "CONTROL code" of the third portion the data signal sequence instructs "OFF". Therefore, the liquid crystal element 101 of only the ink container for ink K is turned off.

As will be evident from the description of the structure of the data signal sequence, the liquid crystal element 101 of a specific ink container is turned on or off by, the portion of "CONTROL code", which includes "ON" or "OFF" code, and which the control circuit 300 on the main assembly side sends to the specified ink container. In this case, the intervals with which the liquid crystal element 101 transmits or blocks light, that is, the intervals with which the light projecting portion 122 is lit or unlit, can be controlled by controlling the intervals with which the data signal sequence described above is sent.

Figure 16:
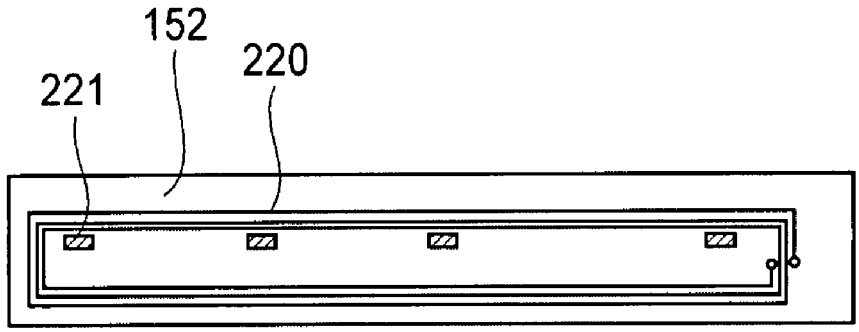
FIGS. 16(*a*), 16(*b*), and 16(*c*) are schematic plan views of three examples, one for one, of the antenna chip on the main assembly side, which are in accordance with the present invention, showing the structure of the light emitting portion on the main assembly side.
Figure 16:
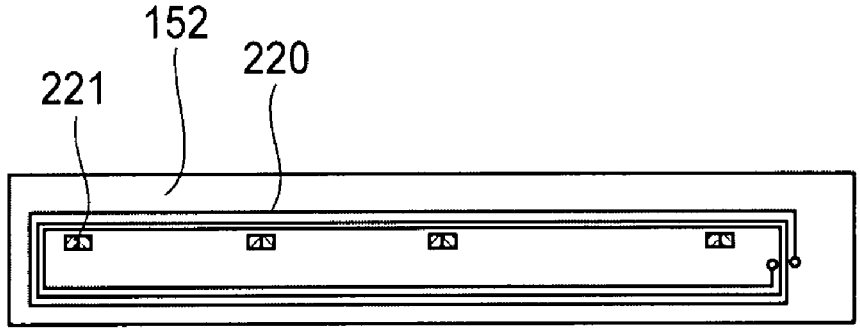
Figure 16:
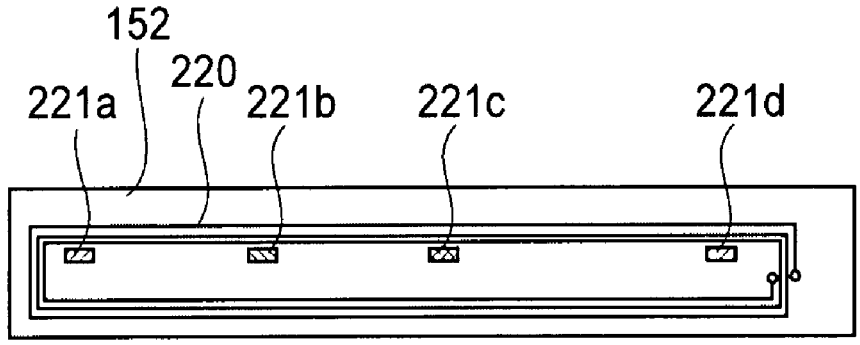
Figure 17:
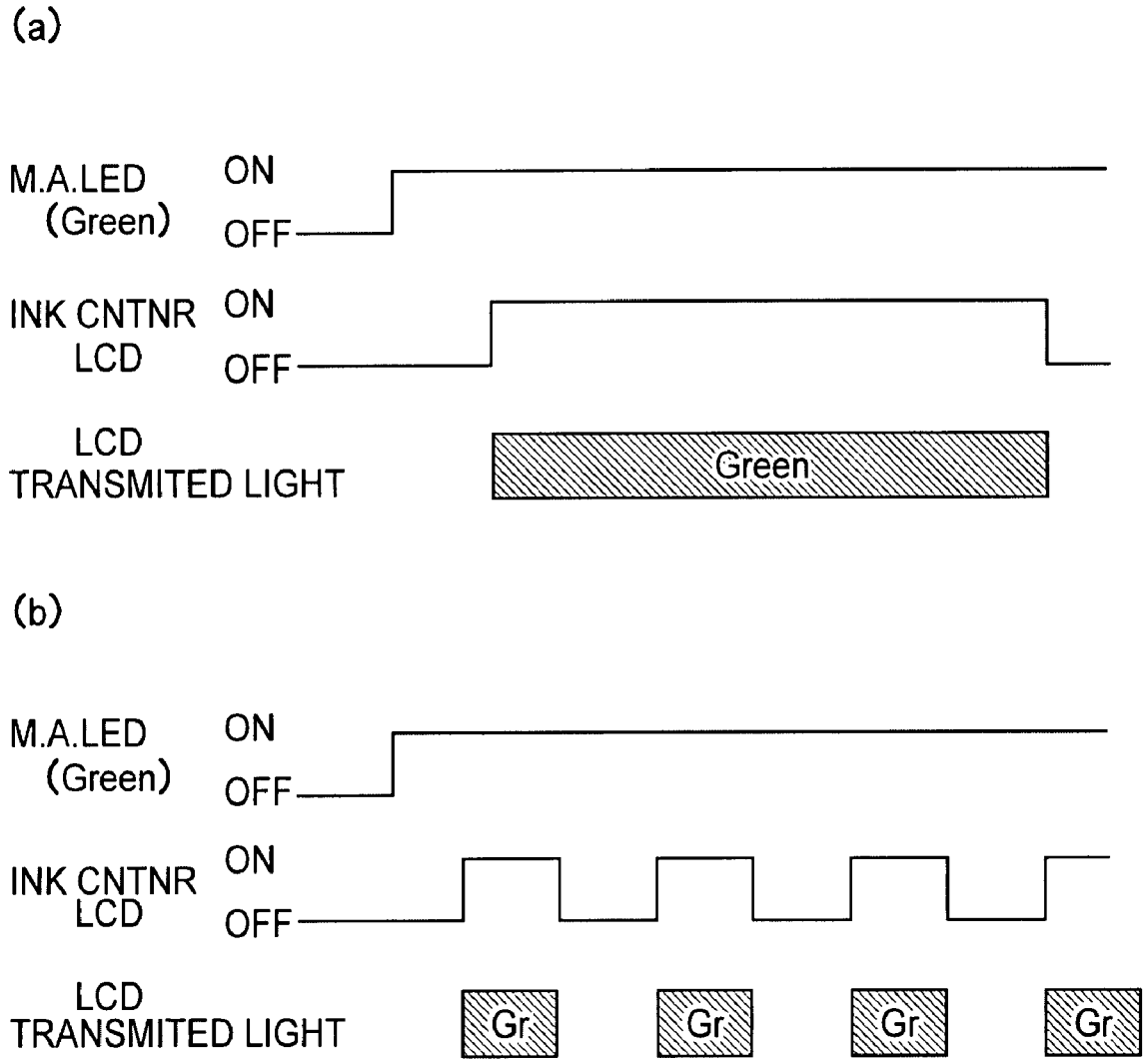
FIG. 17 is a timing chart for driving the light emitting portion of the main assembly, which is structured as shown in FIG. 16(*a*), and the liquid crystal element of the ink container.
Figure 18:
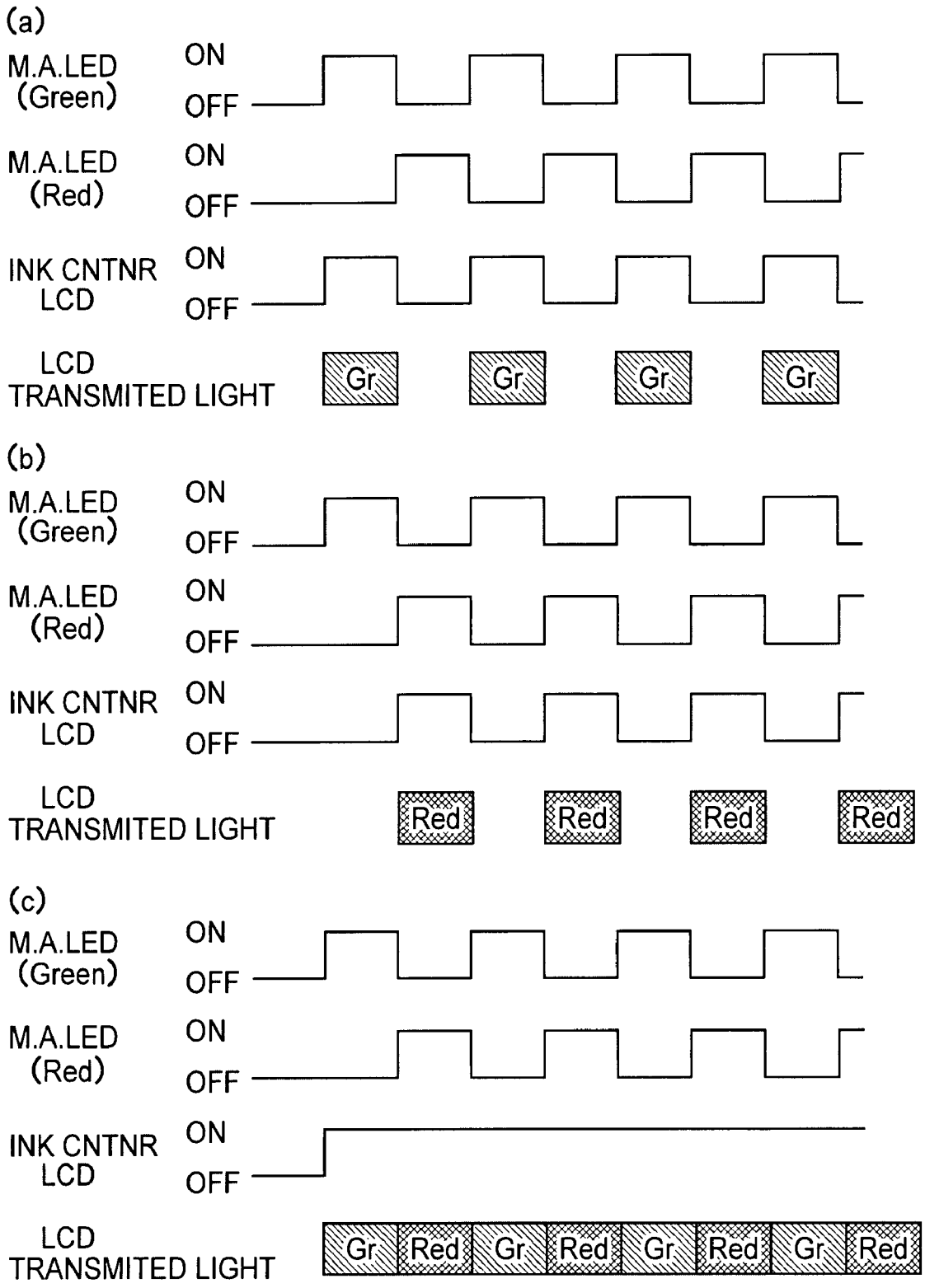
FIGS. 18(*a*)-18(*c*) are timing charts for driving the light emitting portion of the main assembly, which is structured as shown in FIG. 16(*b*), and the liquid crystal element of the ink container.

Next, referring to FIGS. 16-18, the structure of the light emitting portion on the main assembly side, the light emitting timing of the light emitting portion, and the method for controlling the lighting of the light projecting portion 122 or stopping of the lighting of the light projecting potion 122, and the color in which the light projecting portion 122 is lit, by changing the timing with which the liquid crystal element of the ink container is turned on or off, in this embodiment, will be described. FIGS. 16(*a*)-(*c*) show three different antenna chips 152 mountable on the carriage 205. Each antenna chip 152, which is designed to four ink containers 1, has four light emitting portions, which correspond one for one to four ink containers. However, the three antenna chips 152 are different in the selection of LED employed as the light emitting means for the light emitting portion.

FIG. 16(*a*) shows the structure of the antenna chip 152 which employs a single green LED 221 for each of the four light emitting portions. FIGS. 17(*a*) and 17(*b*) are timing charts for driving the LED 221, and the liquid crystal element 101 of the ink container 1, respectively. The antenna chip 152 is provided with the antenna 220, that is, the antenna on the main assembly side, which is in the form of a loop and is a part of the patterned wiring, as described before. In this embodiment, the LED 221 which emits green light (which hereafter will be referred to as green LED) is positioned so that it opposes the liquid crystal element 101 on the ink container 1, as shown in FIG. 3(*b*).

Referring to FIG. 17(*a*), first, the green LED of the main assembly is made to emit light, and then, the liquid crystal element 101, which was off, is turned on. As a result, the light emitted by the green LED transmits through the liquid crystal element 101, and makes the light projecting portion 122 appear as if the light projecting portion 122 is emitting green light. Next, referring to FIG. 17(*b*), the liquid crystal element 101 is turned on and off with short intervals while the green LED is kept on. Therefore, it appears as if green light is flickering in the light projecting portion 122.

FIG. 16(*b*) is a schematic drawing of an example of the antenna chip 152, which employs two LEDs 222 (LED which emits green light and LED which emits red light) as the light emitting means for each light emitting portion. Referring to FIG. 18(*a*), in this case, the green LED and red LED are made to alternately emit light, and the liquid crystal element 101 is turned on (and kept on) in synchronism with the period in which the green LED is kept on. Therefore, the light projecting portion 122 is made to appear as if green light is turned on in the light projecting portion 122, by the light which is transmitted through the liquid crystal element 101. In this case, if the intervals with which the green and red lights are emitted is made very short (for example, no more than 20 μs), it does not appear that they are turned on or off; they appear as if they are continuously on. FIG. 18(*b*) shows the case in which the liquid crystal element 101 is turned on (and kept on) in synchronism with the period in which the red LED is kept on, and therefore, the light projecting portion 122 appears as if red light were turned on therein. FIG. 18(*c*) shows the case in which the liquid crystal element 101 is turned on (and kept on). In this case, the green light and red light alternately and repeatedly transmit through the liquid crystal element 101. However, if the intervals with which the green and red LEDs are turned on or off is made very short, the light projecting portion 122 appears as if light of orange color, that is, the color resulting from the mixture of the green and red light, were turned on therein. In other words, providing each of the light emitting portions of the main assembly with two LEDs, which are different in the color of the light they emit, makes it possible to provide the light projecting portion 122 with three different colors, that is, two primary (monochromatic) colors and one synthetic color, in which it can be lit. Therefore, it makes it possible to increase the number of choices of information which can be expressed by the illumination of the light projecting portion 122, and/or makes it easier to interpret the information.

FIG. 16(*c*) shows an example of the antenna chip 152 which has four LEDs 221*a*-221*d*, which correspond one for one to the four light emitting portions and are different in the color of the light they emit. In this case, the four ink containers can be made different in the color of the light emitted by the LED 221; the color of the ink in each ink container and the color of the light emitted by the LED 221 can be matched to make it easier to identify each ink container.

2.3. Control Sequence (FIG. 19-25)

Figure 19:
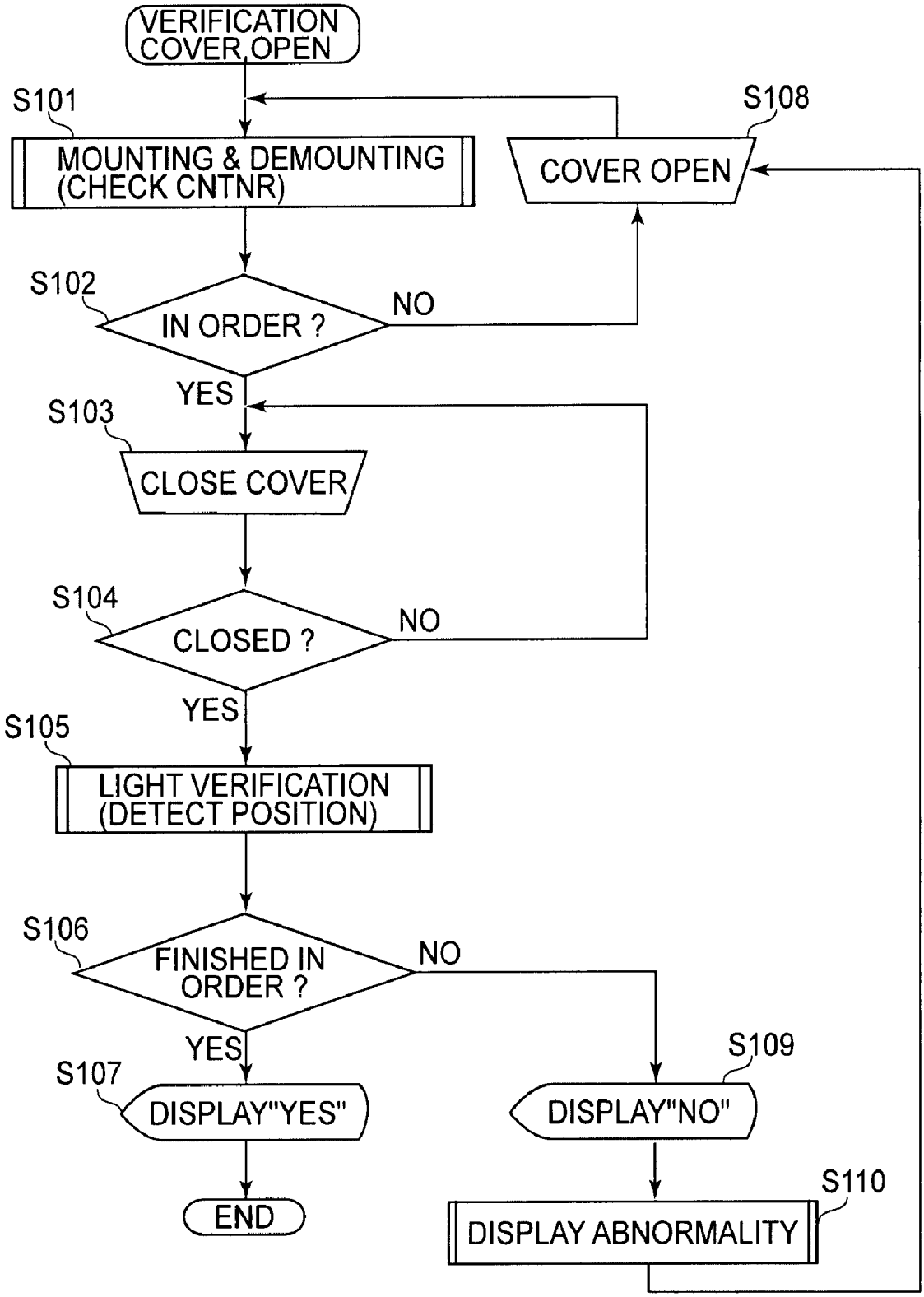
FIG. 19 is a flowchart of the control sequence for the operation for verifying the ink container, in the first embodiment of the present invention.

FIG. 19 is a flowchart of the control sequence for the operation for mounting the ink container(s) in this embodiment, which is structured as described above, in particular, the portion of the control sequence, in which the liquid crystal element 101 of each ink container 1 is turned on or off by the control circuit 300 on the main assembly side.

The portion of the control sequence, to which the flowchart in FIG. 19 is related, is the portion which is started up and carried out as soon as it is detected by a preset sensor that a user has opened the main assembly cover 201, in this embodiment. As this portion of the control sequence is started up, first, the portion of the control sequence, which is related to the mounting or dismounting of the ink container, is carried out in Step S101.

Figure 20:
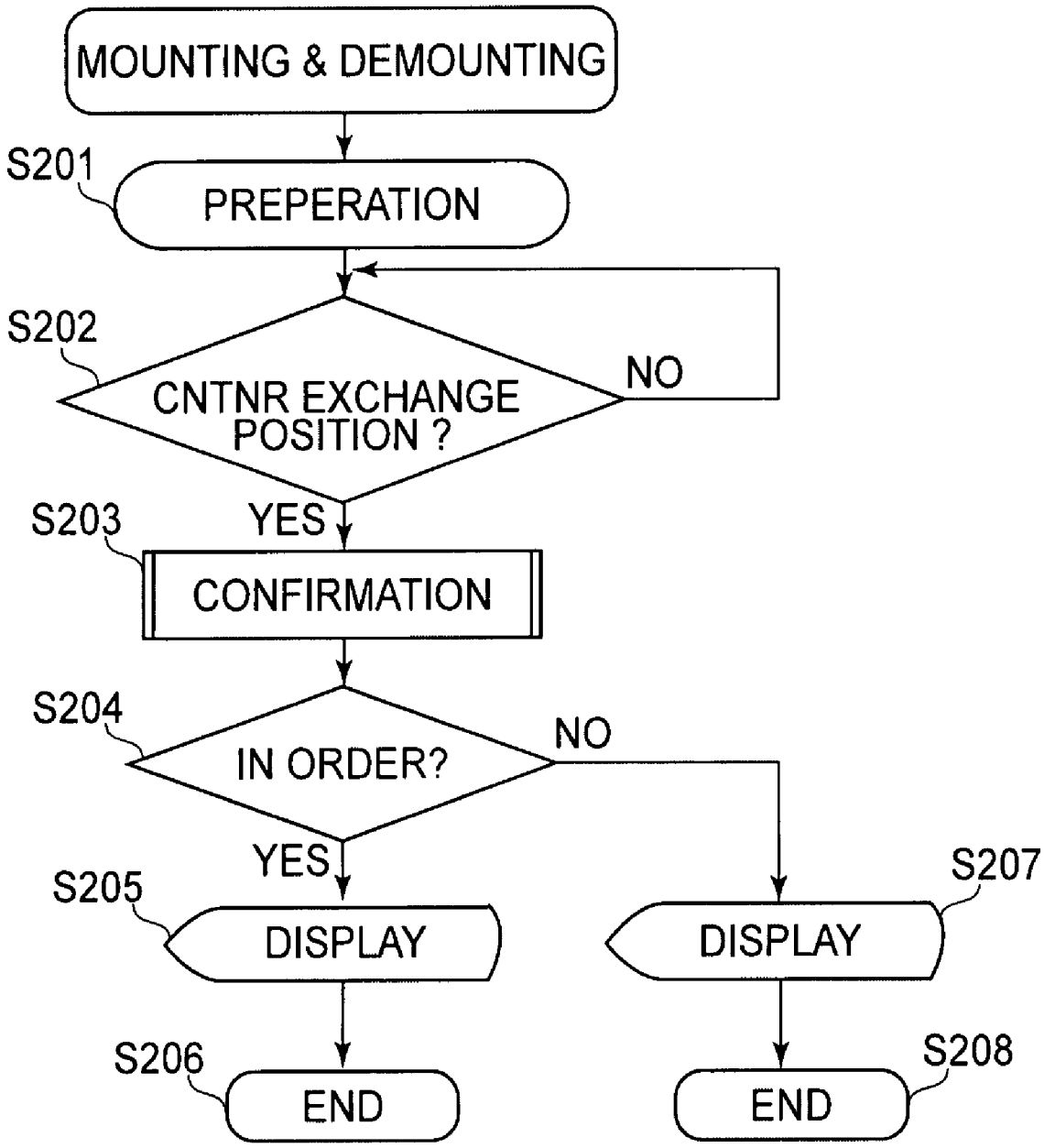
FIG. 20 is a detailed flowchart of the control sequence for Step S101 shown in FIG. 19, that is, the step in which the ink containers are mounted or dismounted, in the first embodiment.

FIG. 20 is a flowchart which shows the details of the portion of the control sequence, which is related to the mounting or dismounting of the ink container 1. In this portion of the control sequence, first, the carriage 205 is moved, and the information (information unique to each ink container) regarding the condition of each ink container on the carriage 205 is obtained, in Step S201. The information obtained in this step is the amount of ink remainder, for example. This information is read out of the memory array 103D, together with the number unique to each ink container. Then, it is checked in Step S202 whether or not the carriage 205 has reached the ink container replacement position described with reference to FIG. 8.

If it is determined that the carriage 205 has reached the ink container replacement position, the portion of the control sequence, which is for confirming whether or not the ink container(s) has been mounted, is carried out in Step S203.

Figure 21:
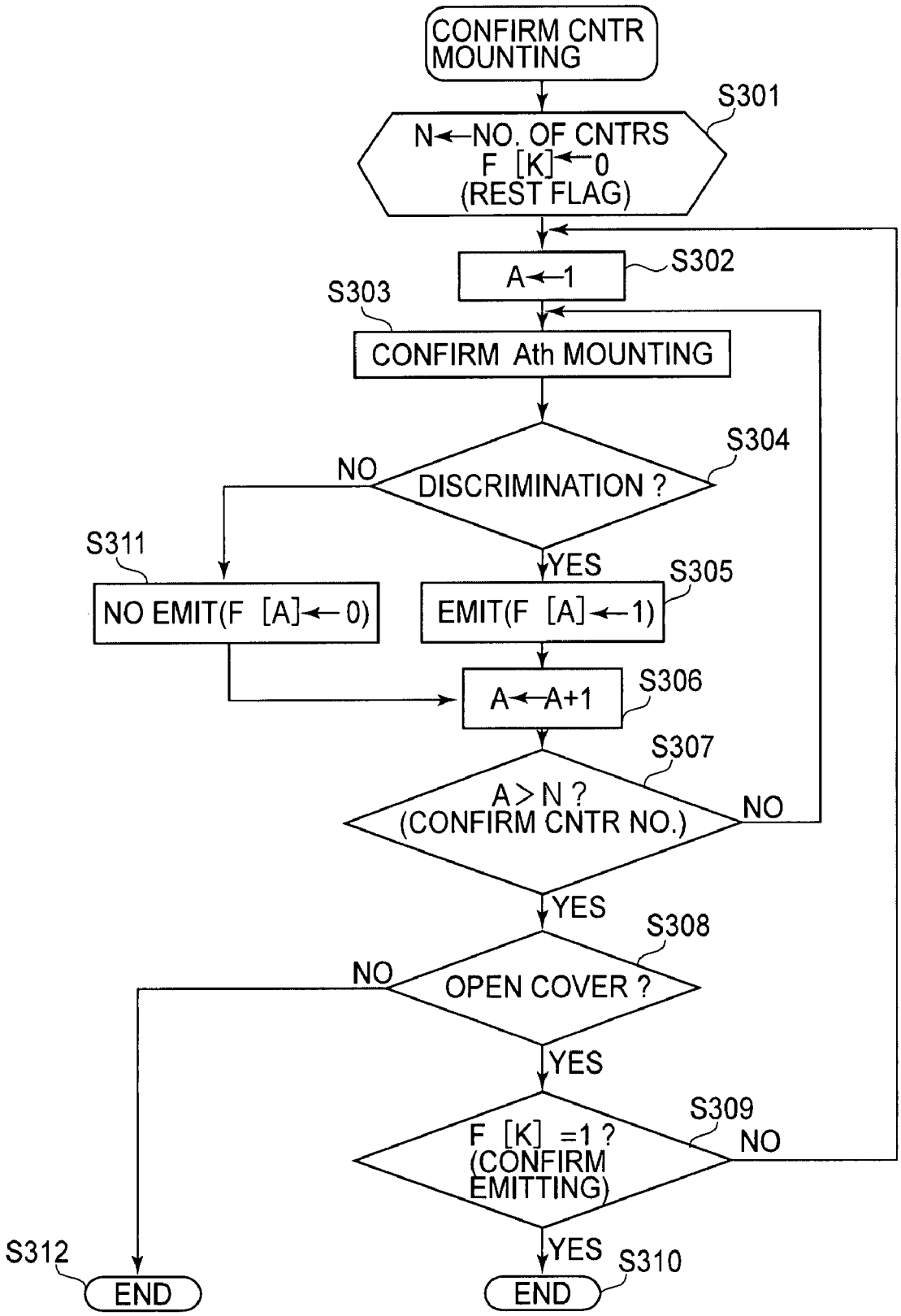
FIG. 21 is a detailed flowchart of the control sequence for Step S203 shown in FIG. 20, that is, the step in which the position and condition of the ink container are confirmed, in the first embodiment.

FIG. 21 is a flowchart which shows the details of the portion of the control sequence, which is for confirming whether or not the ink container(s) has been mounted. First, in Step S301, a parameter N, which indicates the number of ink containers which are to be on the carriage 205, is set, and a flag F(k) for confirming the light projection by the light projecting portion 122, according to the number of ink containers indicated by the parameter N, is initialized. In this embodiment, the number of ink containers (1K, 1C, 1M, and 1Y) is four, and therefore, the parameter N is set to 4. Therefore, four flags F(k) (k=1-4) are prepared, and all four flags F(k) are initialized; their contents become "0".

Next, in Step S302, a variable A of the abovementioned flag, which is related to the order in which the ink containers are mounted, is set to "1", and in Step S303, the portion of the control sequence, which is for confirming the mounting of the ink container(s), is carried out for the A-th ink container. In this portion of the control sequence, as a user mounts a given ink container into its proper position in the carriage 205, the main assembly and the given ink container communicate with each other, and the control circuit 300 selects (specifies) the ink container, using the "COLOR information", and reads the color information in the memory array 103*d*D of the selected (specified) ink container. The color information for selecting a specific ink container is not used for the ink containers, from which data had been already read, which is obvious. Also in this portion of the control sequence, after this portion is started up, it is checked whether or not the read color information is different from the color information which were read before this point.

Next, in Step S304, if the read color information is different from the color information which was read before this point, it is determined that the ink container having this color information has just been mounted as the A-th ink container. Otherwise, it is determined that the A-th ink container is not on the carriage 205; the ink container which has just been mount is not the A-th ink container. Incidentally, "A-th" is an arbitrary ordinal number just for describing the order in which the ink containers are to be selected (specified), and is not the order in which the ink containers are to be mounted. After it is checked whether or not the A-th ink container has just been mounted, the content of the flag F(A), that is, one of the four flags F(k) (k=1-4), which matches (k=A), is changed to "1", in Step S305, whereby the light projecting portion 122 of this ink container, that is, the ink container which matched in color information, is lit. If it is determined that the A-th ink container is not on the carriage 205, the content of this flag F(A) is changed to "0" in Step S311.

Next, in Step S306, the variable A is increased by an increment of 1, and in Step S307, it is checked whether or not the new value of the variable A is greater than N (which is 4 in this embodiment), the value of which was set in S301. If it is determined that the variable A is no more than N, Step 303 and the steps thereafter, are repeated. If it is determined that the variable A is greater than N, it is determined that the operation for confirming the mounting of an ink container has been completed for all four ink containers. Then, it is checked in Step S308 whether or not the main assembly cover 201 is open or not, based on the output of the aforementioned sensor. If it is determined that the main assembly cover 201 is closed, it is presumed that it is possible that a user would have closed the main assembly cover before mounting all four ink containers, that is, leaving some of them out. Thus, it is determined in Step S312 that the ink container mounting operation abnormally ended, and this portion of the control sequence is ended, to go back to the portion of the control sequence shown in FIG. 20.

If it is determined in Step S308 that the main assembly cover 201 is open, it is checked in Step S309 whether or not the content of each of the four flags F(k) (k=1-4) is "1". In other words, it is checked whether or not all the light emitting portions 122 have been lit (are lit). If it is determined that one or more of the light emitting portions 122 are not lit, Step S302 and the steps thereafter, are repeated. That is, a user is to mount the ink container, which corresponds to the light projecting portion 122, which is not projecting light, or to remount the ink container. In other words, the above descried portion of the control sequence is repeated until all the light projecting portions 122 are lit.

Figure 22:
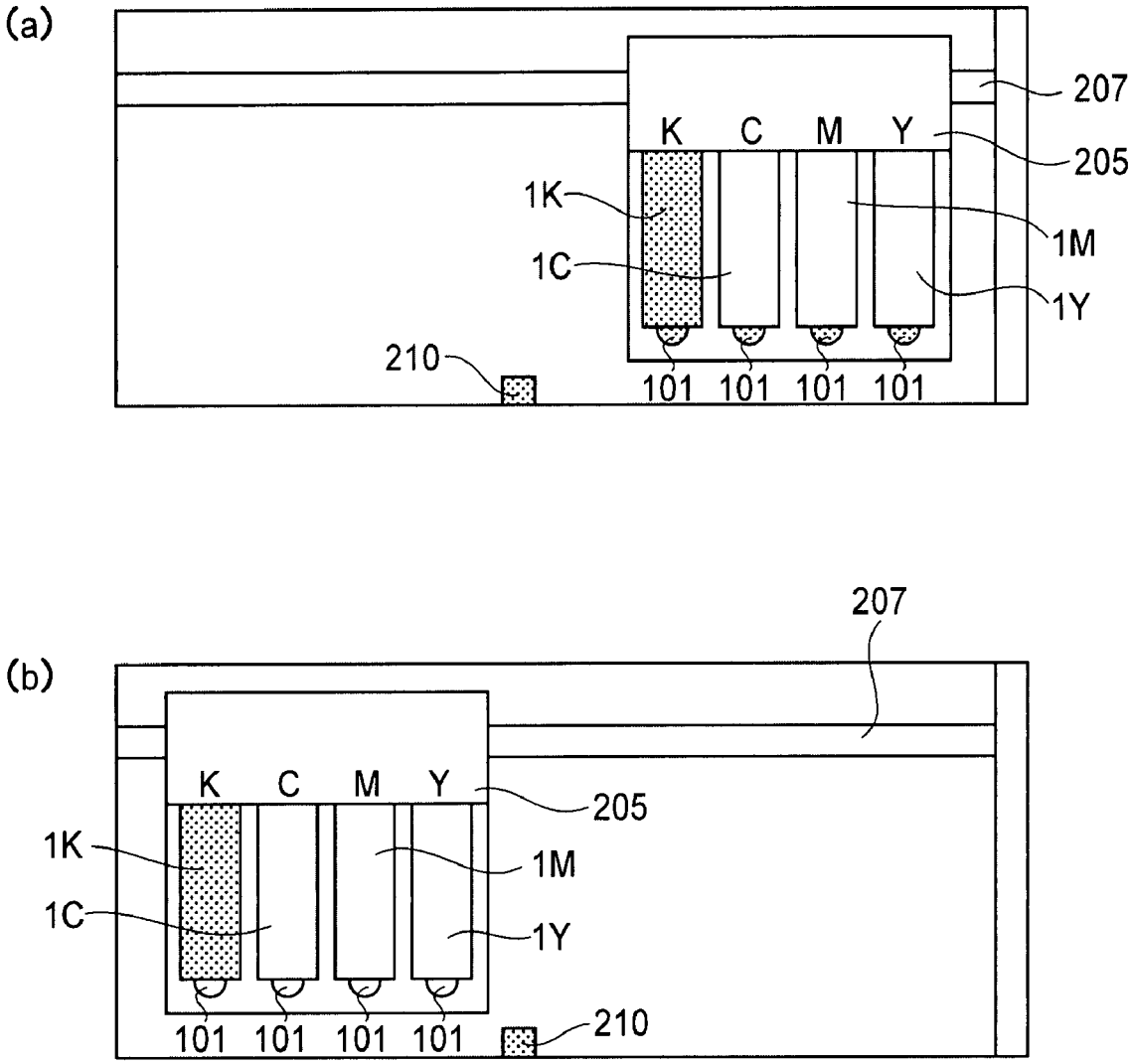
FIGS. 22(*a*) and 22(*b*) are schematic drawing of the carriage and the ink containers in the carriage, FIG. 22(*a*) showing the case in which all the ink containers are in their correct positions, and therefore, their light projection portion is lit, and FIG. 22(*b*) showing the case in which the carriage is in the optical ink container verification position, to which the carriage was moved after the light projection portions were lit.

If it is determined that all the light projecting portions 122 are lit, the normal process for ending this portion of the control sequence is carried out in Step S310, and the routine shown in FIG. 20 is taken. FIG. 22(*a*) is a drawing which shows that all ink containers are in their proper positions in the carriage, and their light projecting portions 122 are lit.

Referring again to FIG. 20, after the portion of the control sequence, which is for confirming the mounting of the ink containers is carried out in Step S203, it is checked in Step S204 whether or not this portion of the control sequence was normally ended, that is, whether or not the ink containers were normally mounted. If it is determined that the mounting was normal, a green light, for example, is turned on in the display portion (FIGS. 9 and 10) of the control panel, in Step S205, and this portion of the control sequence is ended (normal ending) in Step S206, and the routine shown in FIG. 19 is taken. On the other hand, if it is determined that the mounting was abnormal, an orange light, for example, is turned on in the display portion of the control panel 213, in Step S207, and this portion of control sequence is ended (abnormal ending) in Step S208, and the routine shown in FIG. 19 is taken. If the printer is in connection with a host PC, it is possible to display on the monitor of the PC a message indicating the anomaly in the mounting of the ink containers, at the same time as the indicator light of the control panel is turned on.

Referring to FIG. 19, as the portion of the control sequence, which is for controlling the operation for mounting or dismounting of the ink containers, is completed in Step S101, it is checked in Step S102 whether or not the abovementioned ink container mounting-dismounting operation, has normally ended. If it is determined that the ending was abnormal, the control waits until a user opens the main assembly cover 201, in Step S108. Then, the opening of the cover 201 starts up the process to be carried out in Step S101, and the portion of the control sequence, which was described with reference to FIG. 20 is repeated.

If it is determined in Step S102 that the mounting-dismounting operation has normally ended, the control waits in step S103 until the uses closes the main assembly cover 201. Then, it is checked in Step S104 whether or not the cover 201 has been closed. If it is determined here that the main assembly cover has been closed (it is closed), Step S105 is taken, in which an optical ink container position verification operation is carried out. If it is detected in this step that the main assembly cover 210 is closed, with the carriage remaining in the position shown in FIG. 22(*b*), the carriage 205 is moved to the optical ink container position verification position, and the liquid crystal element 101 is controlled so that each of the lit light projecting portions becomes unlit.

The optical ink container position verification operation is an operation for checking whether or not each of the ink containers in the carriage 205, which is normal in mounting, that is, is correct in the position (ink container slot) relative to the carriage 205. In this embodiment, the carriage and ink containers are not shaped according to the color of the ink in an ink container so that an ink container to be mounted into a specific ink container slot in the carriage cannot be mounted into the slots for other ink containers. That is, the ink container slots of the carriage are not rendered different in shape, according to the color of the ink in an ink container so that an ink container mountable in one of the ink container slots, which is for the ink container for the ink of a specific color, cannot be mounted into the ink container slots for others. Therefore, it is possible that an ink container which contains ink of a given color will be mounted into the slot which is reserved for the ink container for the ink of a different color. Therefore, the optical verification operation is carried out. If it is determined that an ink container is in the wrong slot, a user is informed of the mistake. Therefore, it is unnecessary to make ink containers different in the color of the ink their in, different in shape, making it possible to increase the efficiency with which ink containers are manufactured, and also, to reduce the ink container cost.

Figure 23:
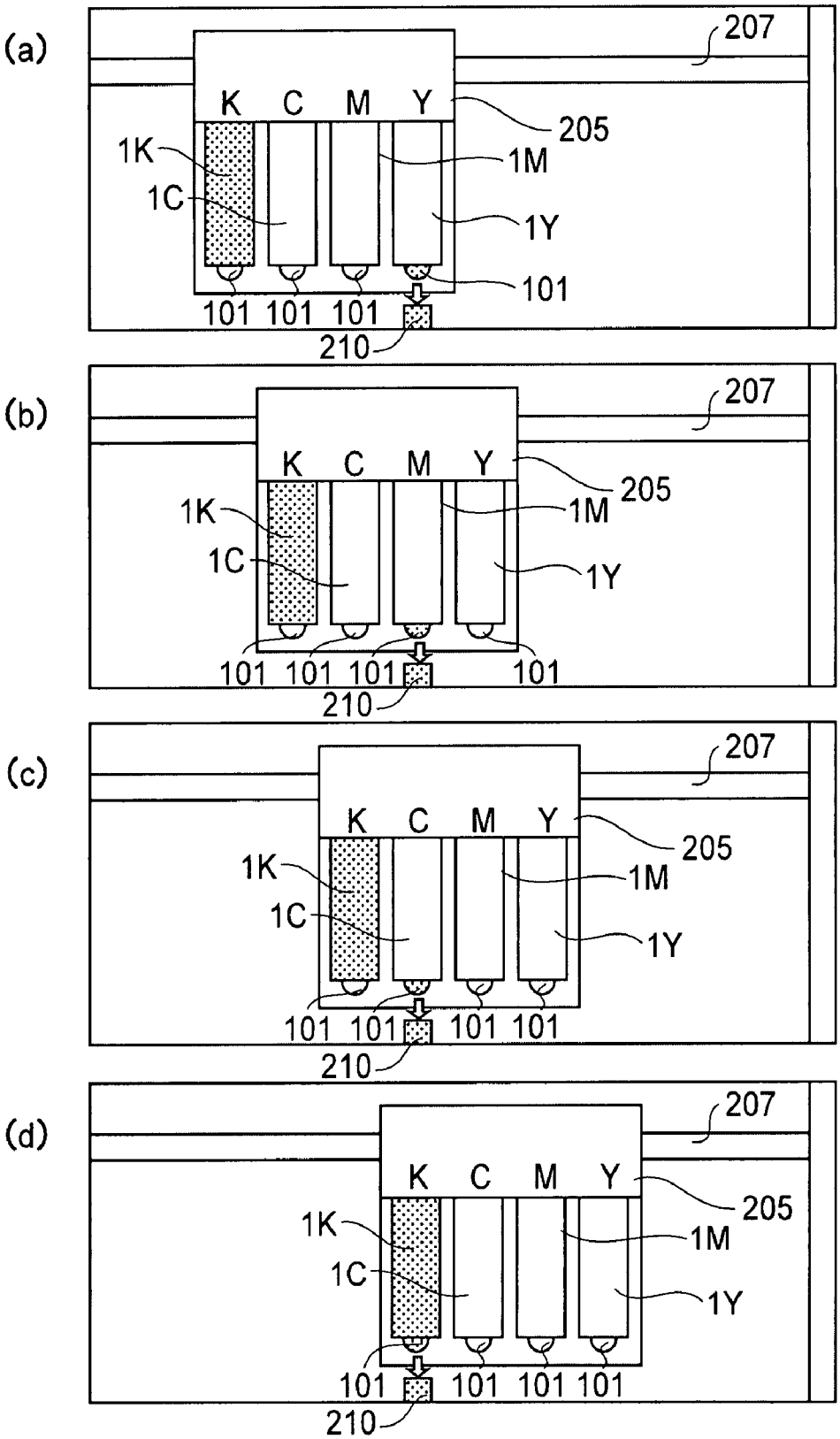
FIGS. 23(*a*)-23(*d*) are schematic drawings showing the various stages in the operation for optically verifying the ink container.
Figure 24:
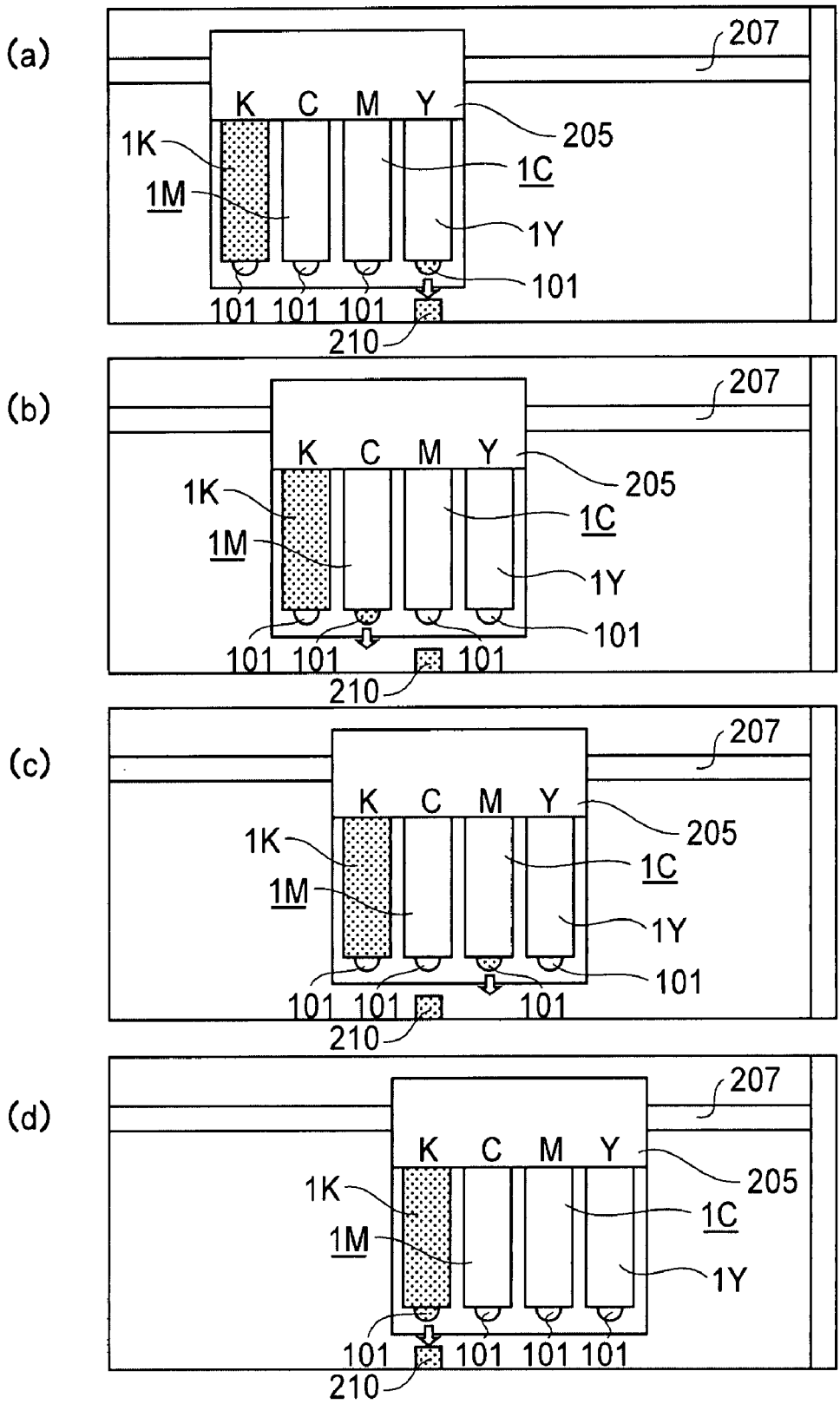
FIGS. 24(*a*)-24(*d*) are also schematic drawings showing the various stages in the operation for optically verifying the ink container.

FIGS. 23(*a*)-23(*d*), and FIGS. 24(*a*)-24(*d*) are drawings for describing this optical ink container position verification operation.

Referring to FIG. 23(*a*), first, the carriage 205 is placed in the leftmost position in its moving range, and then, is moved rightward relative to the first light receiving portion 210. Then, when the carriage 205 is at the location where the ink container which is in the slot for the ink container 1Y opposes the first light receiving portion 210, the light projecting portion 122 of the ink container in the ink container slot for the ink container 1Y is lit. In reality, this operation includes the steps from the step in which the light receiving portion 210 is lit, to the step in which it is unlit after a preset length of time. This is true throughout the entirety of the optical ink container position verification operation. If the ink container in the ink container slot for the ink container 1Y is a correct one, that is, the ink container 1Y, the first light receiving portion 210 can receive the light projected by the light projecting portion 122, and therefore, the control circuit 300 determines that the ink container in the ink container slot for the ink container 1Y is correct one, that is, the ink container 1Y.

While the carriage 205 is moved, the light projecting 122 is made to project light when the carriage 205 is at the location where the ink container in the ink container slot for the ink container 1M opposes the first light receiving portion 210, as shown in FIG. 23(*b*). FIG. 23(*b*) shows the case in which the ink container in the ink container slot for the ink container 1M is a correct one, that is, the ink container 1M, and therefore, the first light receiving portion 210 receives the light. Then the carriage 205 is continuously moved further rightward to switch the ink container slot which opposes the first light receiving portion 210, as shown in FIGS. 23(*b*)-23(*d*), which show the case in which the ink containers in the ink container slots are correct ones.

On the other hand, if the ink container in the ink container slot for the ink container 1M is a wrong one, for example, the ink container 1C, or the cyan ink container, as shown in FIG. 24(*b*), light is not projected from the light projecting portion 122 of the ink container, that is, the ink container 1C, which is opposing the first light receiving portion 210. Instead, the light projecting portion 122 of the ink container 1M, which is in the different ink container slot, is lit. In other words, when the carriage 205 is at this location, the first light receiving portion 210 cannot receive light, and therefore, the control portion 300 determines that the ink container in the ink container slot for the ink container 1M is not the ink container 1M. Correspondingly, the ink container in the ink container slot for the ink container 1C is also a wrong one, which in this case is the ink container 1M, as shown in FIG. 24(*c*), and therefore, the light projecting portion 122 of the ink container 1M which is opposing the first light receiving portion 210 is not lit. Instead, the light projecting portion 122 of the ink container 1C which is in the different ink container slot is lit.

By carrying out the above described optical ink container position verification operation, the control circuit 300 can find an ink container or ink containers which are not in their designated ink container slots. Further, if the ink container in a given ink container slot is not the correct one, the identity of the incorrect one, in terms of the color of the ink therein, can be obtained by making the other three ink containers, different in color, sequentially emit light.

Referring to FIG. 19, after the completion of the optical ink container position verification operation in Step S105, it is checked in Step S106 whether or not this operation was normally ended. If it is determined that the optical ink container position verification operation normally ended, the information dissemination device of the control panel 213 is lit green, for example, in Step S107, and this operation is ended (normal ending). On the other hand, if it is determined that the optical ink container position verification operation was not normally ended, the information dissemination device of the control panel 213 is lit orange, in Step S109. At the same time, a control is executed so that the light projecting portion 122 of the other ink container which is also in the wrong ink container slot, flickers or kept turned on, in Step S105. Therefore, as the user opens the main assembly cover 201 in Step S108, the user can find out which ink container(s) is not in the correct ink container slot, being thereby prompted to remount the ink container(s) into the correct slot.

Figure 25:
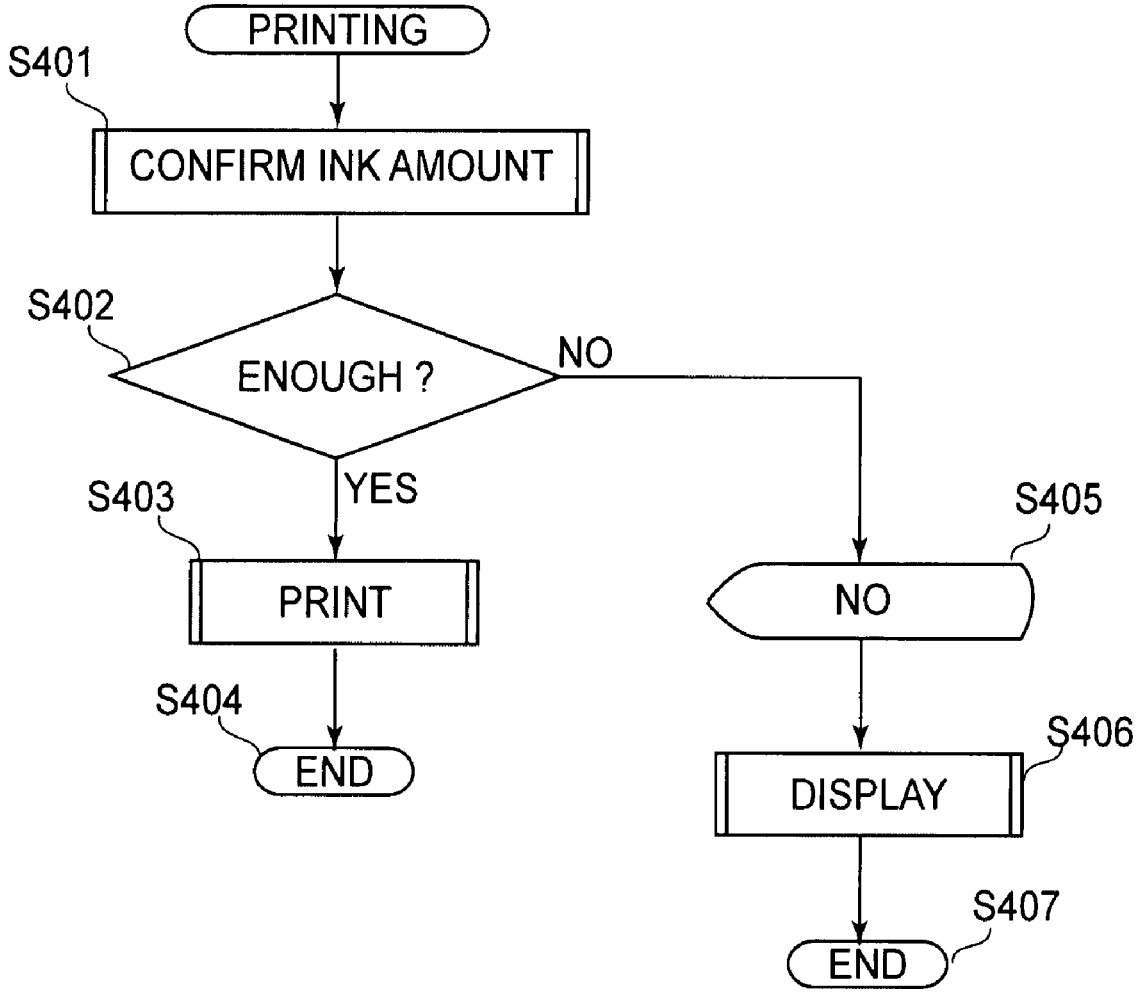
FIG. 25 is a flowchart of the recording operation in the first embodiment.

FIG. 25 is a flowchart of the recording operation of the ink jet printer in this embodiment. In this operation, first, the amount of the ink remainder in each ink container is checked in Step S 401. In this step, the amount of recording to be made in the job which is about to be started is obtained based on the recording data, and then, the obtained amount of recording to be made is compared with the amount of ink remainder in each ink container, to find out whether or not the amount of ink remainder in each ink container is sufficient for this printing job. Incidentally, the amount of ink remainder in each ink container, which was obtained by the control circuit 300 from the cumulative number of the ink droplets jetted prior to this job, may be used in place of the amount of the ink remainder obtained using the method described above.

In Step S402, it is checked whether or not the amount of ink remainder in each ink container is sufficient for the job, based on the ink remainder amount obtained by the above described ink remainder amount confirmation step. If all the ink containers are sufficient in the amount of ink remainder therein, the recording operation is carried out in Step S403. Then, as the recording operation is normally completed, the information disseminating device of the control panel 213 is lit green, and the operation is ended (normal ending), in Step S404. On the other hand, if it is determined in Step S402 that the amount of ink remainder is insufficient, the information disseminating device of the control panel 213 is flickered in orange color in Step S405, and the light projecting portion 122 of the ink container which is insufficient in the amount of ink remainder is intermittently lit or kept lit in Step S406, and the recording operation is ended (abnormal ending) in Step S407. If the printer is in connection with a host PC which controls the printer, it is possible to display the amount of ink remainder on the monitor of the PC at the same time as the light projecting portion 122 is intermittently lit or kept on.

3. Effects of Embodiment 1

In the structural arrangement described above, the operation for turning on or off the liquid crystal element 101 of each ink container 1, and the manner in which the light projecting portion 122 of the ink container, are controlled based on the signals inputted through the antenna 102 of each ink container, and the antenna 220 on the printer main assembly side, through which each container communicates with the printer main assembly, and the information unique to each ink container. Therefore, even through the common (same) control signal sequence (signals) is received by the multiple ink containers through the common antenna on the main assembly side, only the liquid crystal element 101 of the ink container whose unique information matches the color information portion in the common control signal is turned on or off to control the manner in which the light projecting portion 122 of the ink container is lit. In other words, it is possible to selectively control the ink containers in terms of the manner in which the light projecting portion 122 of an ink container is lit.

The structural arrangement, such as the one described above, which makes it possible to selectively control each of the multiple ink containers on the carriage, makes it possible to sequentially control the information disseminating portions of the multiple ink containers, at the preselected point in the moving range of the carriage, while the carriage is moved. Further, according to the structural arrangement described above, whether or not the light projecting portion 122 of a given ink container is lit is detected while the carriage is at the point which is preset for the given ink container. Therefore, if the light projecting portion of the ink container in a given ink container slot is not lit at this point, the ink container in this ink container slot is a wrong one. In such a case, it is possible to prompt the user to remount the ink container so that the ink container will be mounted into the correct ink container slot. Consequently, each ink container is specified in terms of the ink container slot into which it can be mounted.

Also in this embodiment, the light emitting portion made up of an LED or the like is placed on the main assembly side, instead of the ink container side, and the manner in which the information is disseminated, that is, the manner in which the light projecting portion (information disseminating) is lit, is controlled by turning on or off the liquid crystal element as the means for transmitting or blocking the light from the light emitting portion. A liquid crystal element can be driven by a substantially smaller amount of power compared to the light emitting portion made of an LED or the like. Therefore, it is unnecessary for the liquid crystal element of each ink container to be supplied with a large amount of power by the printer main assembly, or to provide each ink container with a power circuit which is relatively large in capacity. In other words, the employment of the liquid crystal element as the means for controlling the manner in which the light projecting portion is lit is advantageous, because the liquid crystal element can be satisfactorily driven even by the amount of power generated by the electromagnetic wave inputted by the wireless communication system, such as the one described above.

Further, in this embodiment, the information can be disseminated by intermittently light the light projecting portion by turning on and off the liquid crystal element while keeping the LED turned on. Therefore, the on/off cycle of the LED, that is, the frequency with which the LED is driven is minimized. Therefore, the noises generated when an LED is turned on or off is minimized. In addition, it is possible to simplify the means for driving the LED and the control for the LED driving means.

4. Other Embodiments

The structural arrangement in the first preferred embodiment of the present invention described above is an example of the structural arrangements in accordance with the present invention, and is not intended to limit the present invention in scope. That is, the structural arrangement described above may be modified as necessary as long as the modification allows liquid crystal element 101 to be used to control the manner in which the information regarding each ink container is displayed to provide the printer main assembly and a user with the preselected information regarding each ink container 1. Incidentally, in the description of the following embodiments (or modifications of preceding embodiments) of the present invention, and the drawings used for describing the following embodiments, the portions which are similar in structure or function to those in the preceding embodiment, will be designated with the same referential symbols as those used for the counterparts in the preceding embodiment. The definition of a terminology of "front surface" is also the same as that in the preceding embodiment, that is, it means the surface which is to be faced toward a user so that the items which belong to the surface can be operated (mounted, dismounted, or the like operation), and also, so that the information regarding the items can be presented to the user.

4.1. Embodiment 2 (FIGS. 26-30)

Figure 26:
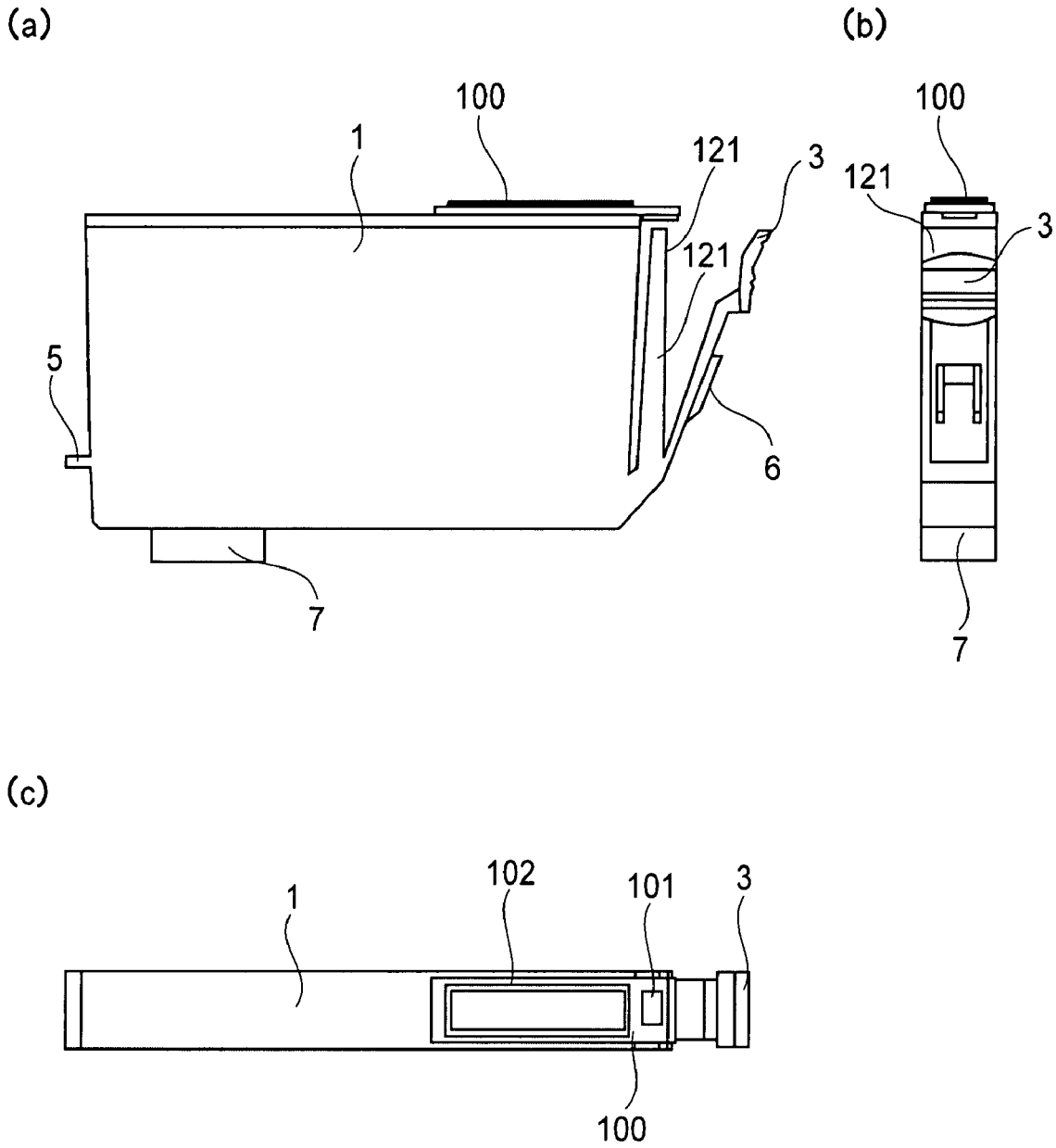
FIGS. 26(*a*), 26(*b*), and 26(*c*) are side, front, and top views, respectively, of the ink container in the second embodiments of the present invention.

FIGS. 26(*a*), 26(*b*), and 26(*c*) are side, front, and top plan views of the ink container 1 in the second embodiment of the present invention. The ink containers 1 in this embodiment are roughly the same in structure as those in the first embodiment, except that in this embodiment, the control chip 100, which is in the form of a piece of plate, is on the top surface of each ink container 1.

Figure 27:
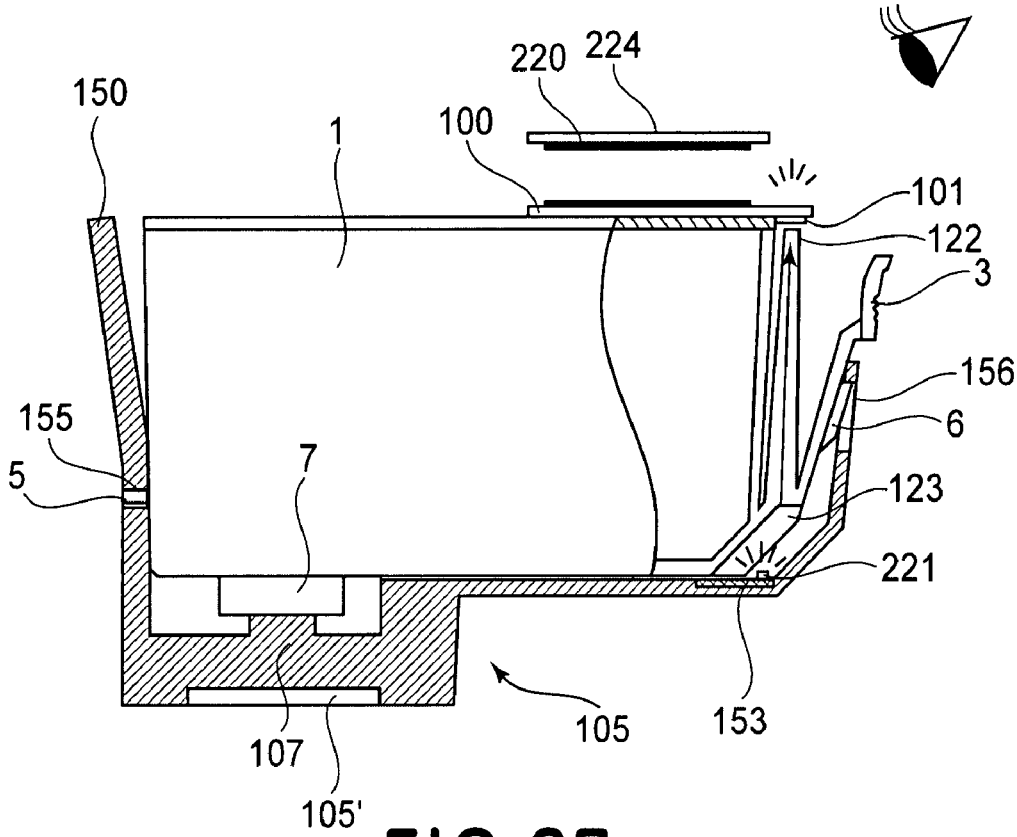
FIG. 27 is a sectional view of the ink container, at a plane parallel to the lateral walls of the ink container, showing the gist of the function of the control circuit chip with which the ink container in the second embodiment is provided.
Figure 28:
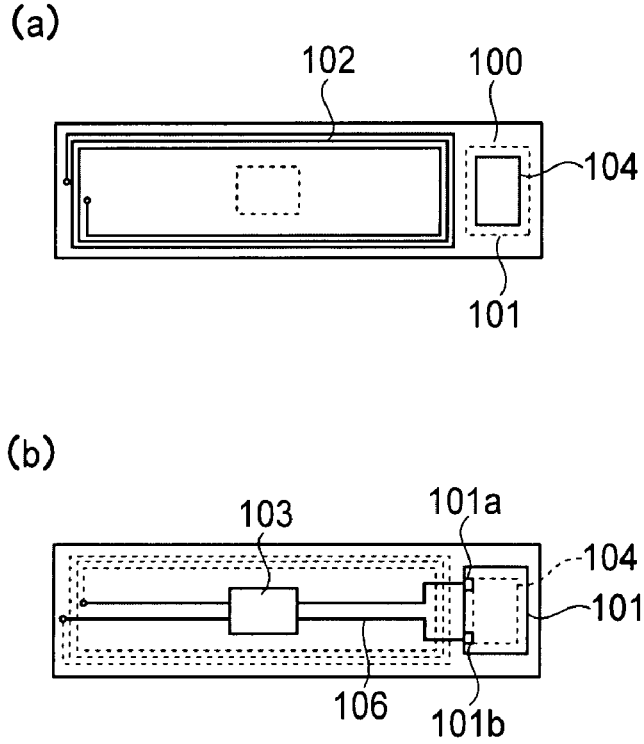
FIGS. 28(*a*) and 28(*b*) are top and back plan views of the control circuit chip which is to be attached to the ink container, in the second embodiment.

Next, referring to FIGS. 27 and 28, the control chip 100, which is the main concern of the second embodiment, will be described regarding its structure and functions. FIG. 27 is a schematic sectional view of the ink container in the second embodiment, at a plane parallel to the lateral walls of the ink container, which was drawn to describe the outline of the functions of the control chip 100 attached to each ink container 1. FIGS. 28(*a*) and 28(*b*) are top and bottom views of an example of the control chip 100 to be attached to each ink container in the second embodiment.

The light receiving portion 123 of the light guiding member 121 is at the bottom end of the supporting member 3, and is next to the intersection of the bottom and front walls of the ink container 1. The light receiving portion 123 opposes the LED 221 on the LED chip 153 with which the holder 150 is provided. As light is emitted by the LED 221, the light is received by the light receiving portion 123, is guided through the light guiding member 121 to a light projecting portion 122, which is the top end portion of the light guiding member 121, and is projected from the light projecting portion 122. The light projecting portion 122 opposes the liquid crystal element 101 on the control chip 100. Further, an antenna chip 224 on the main assembly side, which will be described later, and an antenna 102 (FIG. 28(*a*)), which is a part of the patterned wiring, is in the form of a loop, and is on the surface of the control chip 100 of the ink container 1, which faces outward of the ink container 1, oppose each other, making it possible for the control chip 100 to wirelessly communicate with the main assembly.

The control chip 100 is provided with a liquid crystal element 101 and a control element 103. The liquid crystal element 100 has the function of transmitting or blocking light, and is on the back surface of the control chip 100, that is, the surface which is facing inward of the ink container 1. The control element 103 controls the liquid crystal element 101. Incidentally, although, in FIG. 27, the liquid crystal element 100 is on the back surface of the control chip 100, it may be placed on the top surface of the control chip 100.

The control element 103 controls the operation for turning on or off the liquid crystal element 101 in response to the electrical signals supplied thereto from the antenna chip 224 through the antenna 102 on the ink container side. As light is emitted by the LED 221, the light is guided to the light projecting portion 122, and is projected therefrom. However, the projected light is transmitted or blocked by the liquid crystal element 101 as the liquid crystal element 101 is turned on or off. That is, preselected information regarding each ink container 1 can be directly displayed to a user by controlling the liquid crystal element 101, that is, turning on or off the liquid crystal element 101. In other words, in this embodiment, the light guiding member 121, which projects light from its light projecting portion 122 by guiding the light, which the LED 221 emits, to the light projecting portion 122, and the liquid crystal element 101, which transmits or blocks the light projected from the light projecting portion 122, make up the information disseminating means.

As described above, the control executed in this embodiment is similar to that in the first embodiment, and the effects of this embodiment are roughly the same as those of the first embodiment. In this embodiment, however, the control chip 100 is on the top surface of each ink container 1. Therefore, the antenna 101 can be increased in size to improve the wireless communication between the ink container 1 and main assembly side through the antenna 220 on the main assembly side.

Figure 29:
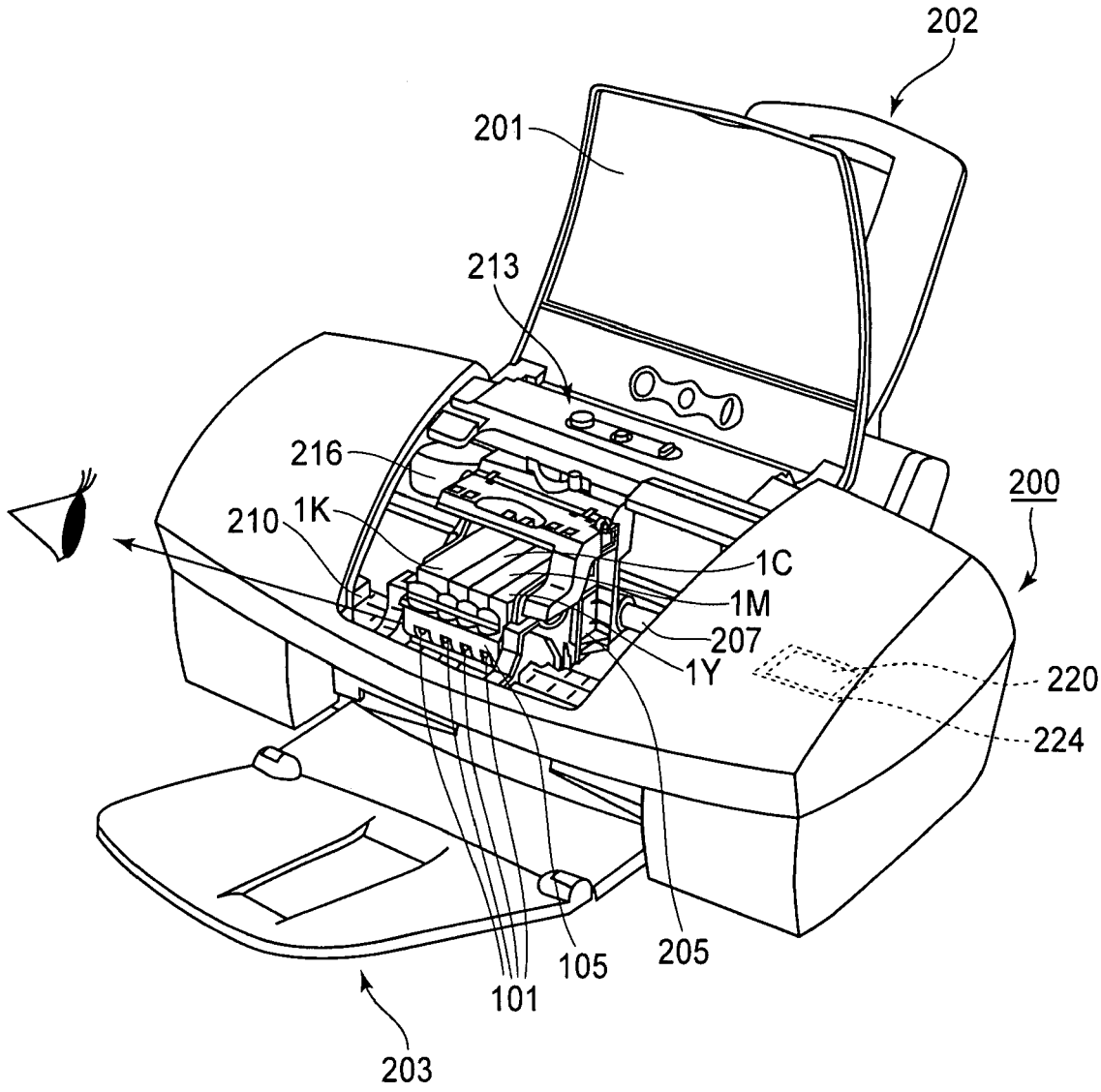
FIG. 29 is an external perspective view of the ink jet printer in which the ink containers in the second embodiment are mounted, and the cover of the main assembly of which is open.
Figure 30:
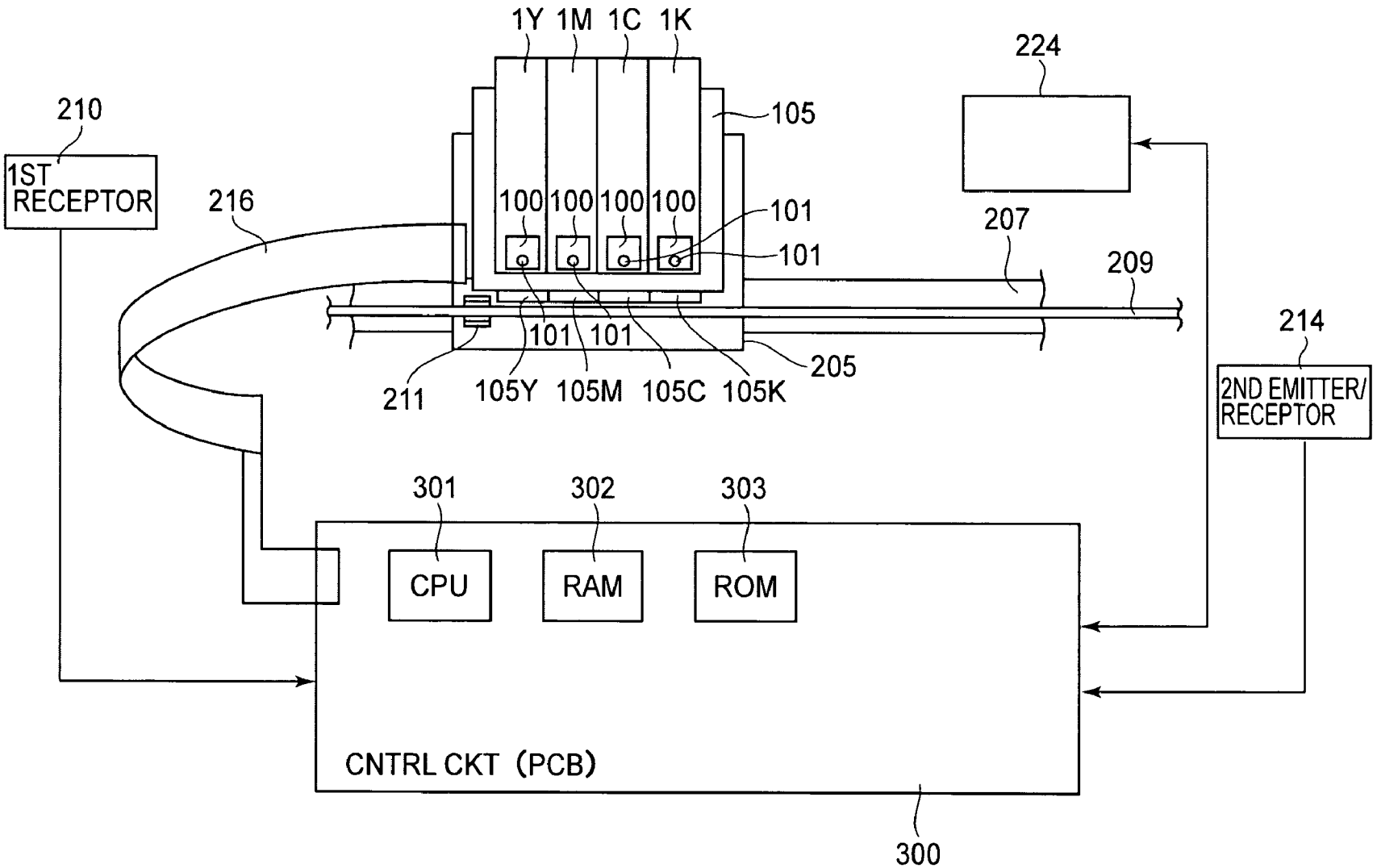
FIG. 30 is a block diagram of the control system of the ink jet printer in which the ink containers in the second embodiment are mounted, showing the structure of the control system.

FIG. 29 is a perspective view of the printer in this embodiment, the main assembly cover 201 of which is open. FIG. 30 is a block diagram of the control system of the main assembly of the ink jet printer in this embodiment, and shows the structure thereof. This embodiment makes it possible to increase the antenna 102 in size, making it therefore possible to make relatively long the wireless communication range between each ink container 1 and the main assembly. Therefore, this embodiment can afford greater latitude in the placement of the antenna 220 in the main assembly of the ink jet printer. FIG. 29 shows the example in which the antenna 220 is roughly above the home position of the carriage. However, the antenna 220 may be placed on the opposite side of the moving range of the carriage from the home position. Further, it may be placed on the carriage as it is in the first embodiment.

Figure 31:
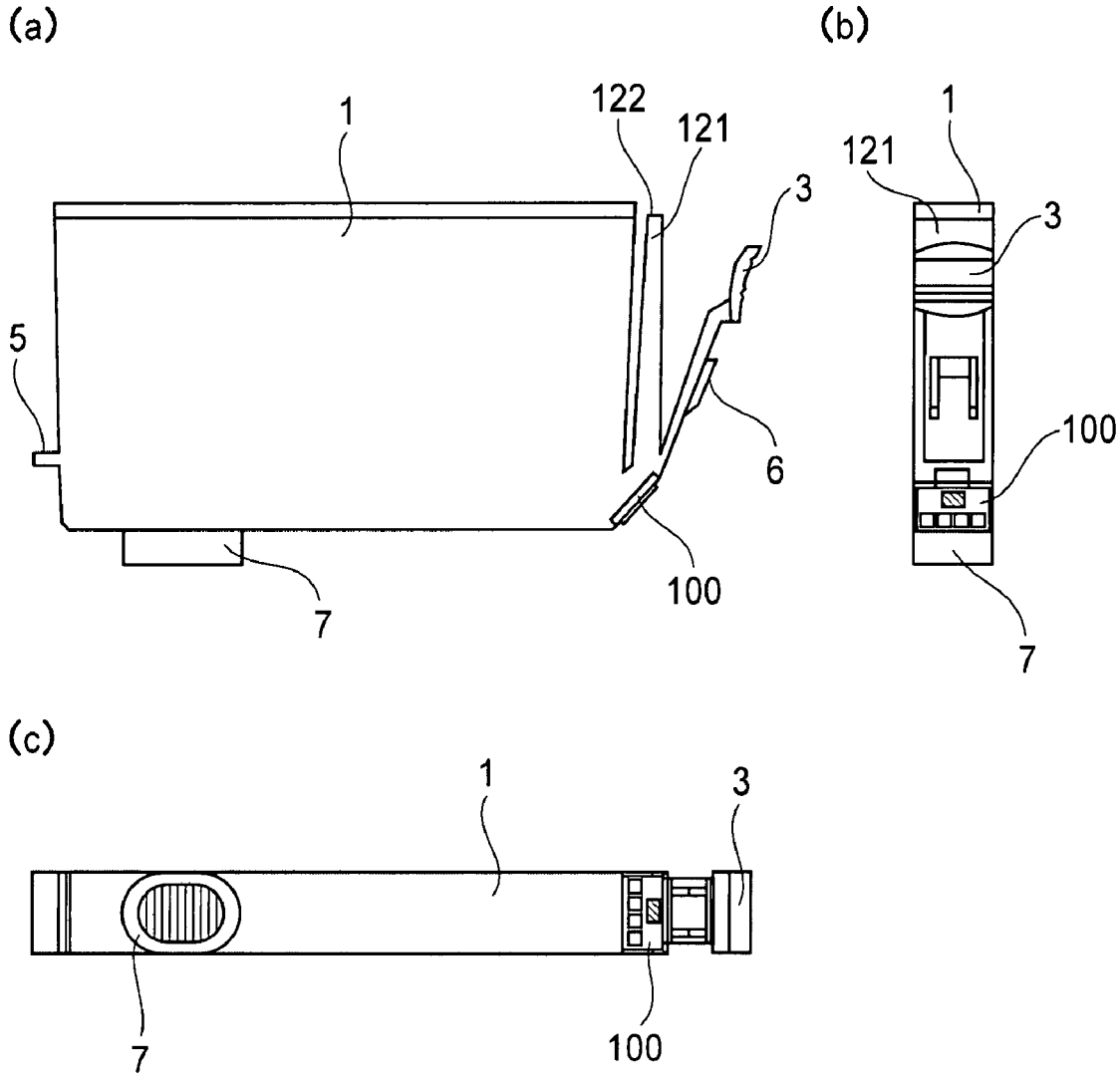
FIG. 31(*a*), 31(*b*), and 31(*c*) are side, front, and bottom views, respectively, of the ink container in the third embodiment of the present invention.

4.2. Embodiment 3 (FIGS. 31-33)

In the first and second embodiments, each ink container 1 and the main assembly of the printer were structured so that the control signals, etc., were wirelessly transmitted between the communicating portion of each ink container, which has an antenna, and the communicating portion of the main assembly, which also has an antenna. However, the communication between each ink container and the main assembly may be made through direct connection, for example, a connector or the like. FIGS. 31(*a*), 31(*b*), and 31(*c*) are side, front, and bottom views, respectively, of the ink container, as a liquid container, in the third embodiment of the present invention.

A control chip 100, which is the primary concern of this embodiment, is located where the bottom and front walls of the ink container 1 intersect, that is, where a supporting member 3 branches diagonally upward from the ink container shell.

Figure 32:
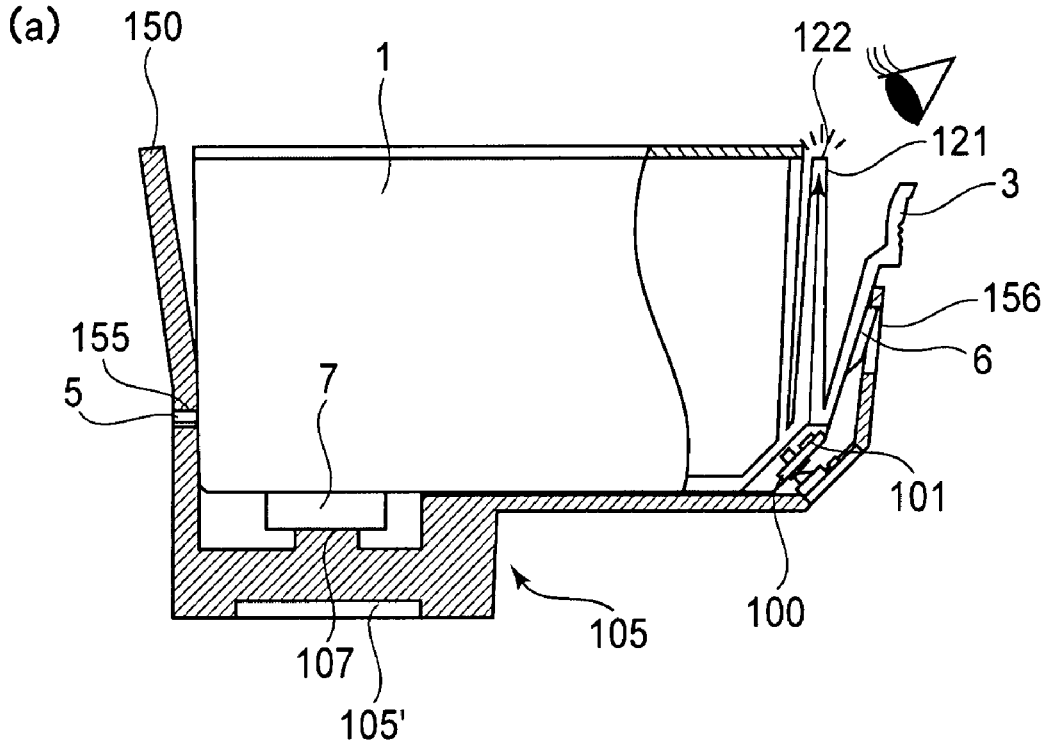
FIG. 32 is a sectional view of the ink container in the third embodiment of the present invention, which is in the proper position in the ink container holder, at a plane parallel to the lateral walls of the ink container, showing the general functions of the control chip with which the ink container is provided, and FIG. 3(*b*) is an enlargement of the essential portion of FIG. 3(*a*).
Figure 32:
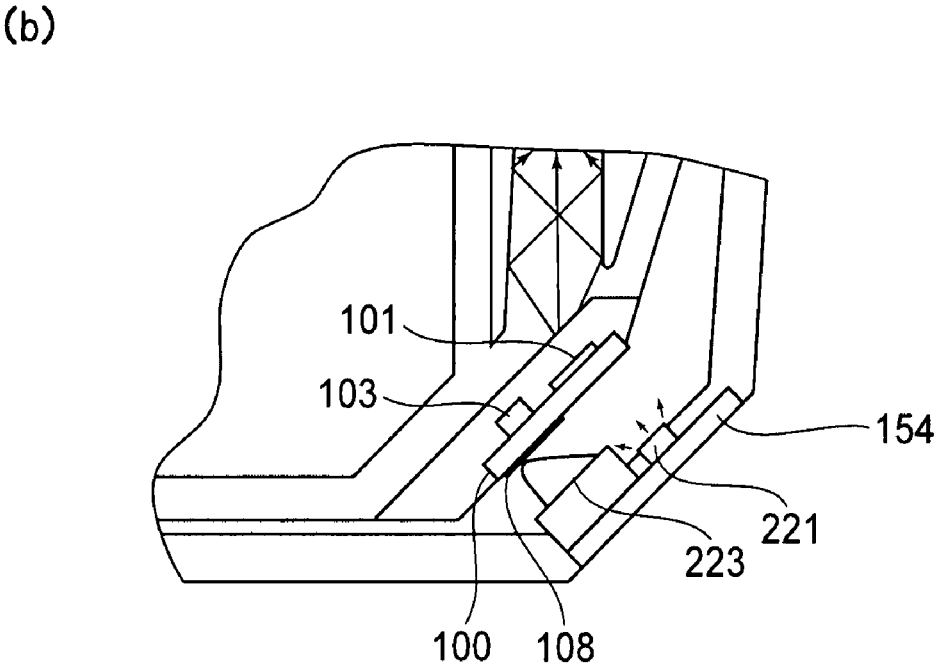
Figure 33:
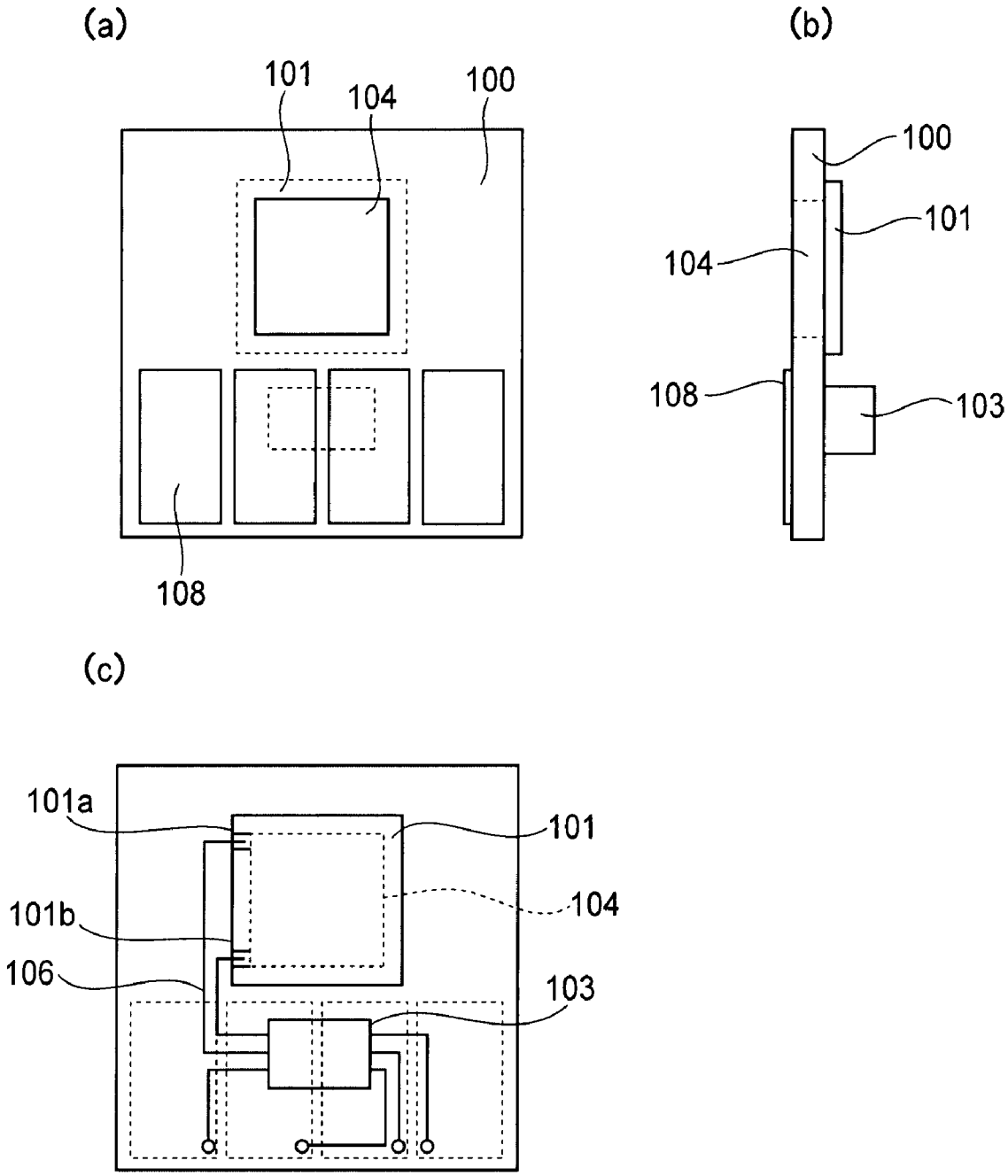
FIGS. 33(*a*), 33(*b*), and 33(*c*) are front, side, and back views, respectively, of the control circuit chip which is to be attached to the ink container, in the third embodiment, showing the gist of the functions of the chip.

Referring to FIGS. 32 and 33, the structure and functions of the control chip 100, which is the primary concern of this embodiment, will be described. FIG. 32(*a*) is a schematic sectional view of the ink container in this embodiment, and roughly shows the functions of the control chip 100 of the ink container, and FIG. 32(*b*) is an enlargement of the essential portion of the ink container. FIGS. 33(*a*), 33(*b*), and 33(*c*) are front, side, and back views, respectively, of the control chip 100 which is attached to each ink container, in this embodiment.

A recording head unit 105 is provided with an ink container holder 150, which is an integral part of a recording head unit 105 having first and second engaging portions 155 and 156. As the ink container 1 is mounted into the holder 150, the first and second engaging portions 5 and 6 of the ink container 1 engage with the first and second engaging portions 155 and 156 of the holder 150, firmly securing thereby the ink container 1 to the holder 150. The holder 150 is provided with a connector chip 154, which has a connector 223, and the control chip 100 of the ink container 1 is provided with a contact pad 108, which is on the surface of the control chip 100, which faces outward of the ink container 1. Thus, as the ink container 1 is mounted into the ink container holder 150, the connector 223 and contact pad 108 come into contact with each other, making it possible for the control chip 100 to communicate with the counterpart on the main assembly side.

The control chip 100 is also provided with a liquid crystal element 101, and a control element 103. The liquid crystal element 101 is an element which can transmit or block light, and is on the surface of the control chip 100, which faces inward of the ink container 1. The control element 103 controls the liquid crystal element 101. More specifically, it turns on or off the liquid crystal element 101, in response to electrical signals which are supplied thereto through the connector 223 of the main assembly and the contact pad 108 of the ink container 1.

The connector chip 154 is provided with a connector 223 and an LED 221, which are on the surface which faces the ink container 1. The LED 221 is positioned so that when the corresponding ink container 1 is in the proper position in the holder 150 (FIG. 32(*b*)), it squarely opposes the liquid crystal element 101 of the control chip 100 of the corresponding ink container 1. The control chip 100 is provided with a hole 104, the position of which is such that when the ink container 1 is in the proper position in the holder 150, it opposes the liquid crystal element 101. Thus, the light from the LED 221 is directly projected onto the liquid crystal element 101. When the liquid crystal element 101 is in the state in which it transmits light, the light from the LED 221 enters the bottom portion of the light guiding member 121, reaches the light projecting portion 122, that is, the tip portion of the light guiding member 121, and is projected therefrom, disseminating thereby the preselected information.

Referring to FIG. 33(*a*), there is the contact pad 108 on the surface (front) surface of the control chip 100, which faces outward of the ink container 1. Referring to FIG. 33(*b*), the surface (back) of the control chip 100, which faces inward of the ink container 1, is provided with the control element 103 and liquid crystal 101 (single bit element). The control element 103 is in connection with the contact pad 108. The liquid crystal element 101 is in connected to the control element 103 and is controlled by the control element 103. The control chip 100 is provided with the hole 104, which is on the back side of the liquid crystal element 101. Thus, the light from the LED 221 can be received by the liquid crystal element 101. The liquid crystal element 101 is provided with connective terminals 101*a* and 101*b*, which are connected to the patterned wiring 106 of the control chip 100, with the use of electrically conductive connective members (unshown), or the like. In this embodiment, the liquid crystal element 101 is on the back side of the control chip 100. However, it may be placed on the front side of the control chip 100.

In this embodiment, the communication between each ink container 1 and the printer main assembly is made through an actual connection. The connector 223 is in connection with a common signal line, that is, a bus, which is for transmitting control signals, such as "DATA" signal, "CLK" signal, etc., sent by the control circuit 300, and also, the signals for supplying each ink container with electric power. Otherwise, the means which makes possible the communication between each ink container and the main assembly is similar in structure to that in the first embodiment.

Therefore, effects which are roughly the same as those in the first embodiment can be obtained by executing control sequence similar to that in the first embodiment. That is, the structural arrangement, in this embodiment, which uses the light which the light emitting portion emits, for disseminating the information regarding the condition of each liquid container, is smaller in the number of signal wires, and yet, is capable of disseminating the information regarding the ink container in a specified in container slot. Further, the light emitting portion, which is made up of a LED or the like, is placed on the printer main assembly side, and the means for transmitting or blocking the light from the light emitting portion is placed on each ink container. Further, the liquid crystal element is employed as the means for transmitting or blocking the light from the light emitting portion. Therefore, the amount of power which each ink container needs to be supplied is very small.

4.3. Miscellanies

In each of the embodiments of the present invention described above, the printer main assembly is provided with multiple light emitting portions (LEDs), which correspond one for one to the multiple ink containers on the carriage. However, the gist of the present invention is to individually drive (turn on or off) the multiple liquid crystal elements which belong to the multiple ink containers one for one, to keep the information displaying means continuously or intermittently illuminated, in order to disseminating the information regarding the condition of each ink container. Therefore, as long as it is possible to shed light in a proper manner onto the structural element (liquid crystal element in first and third embodiments, and light receiving portion of light guiding member in second embodiment) of the information disseminating means of each of the multiple ink containers on the carriage, it is unnecessary to provide the printer main assembly with multiple light emitting portions which correspond one for one to the multiple ink containers on the carriage. For example, instead of providing the printer main assembly with multiple LEDs which oppose, one for one, the multiple liquid crystal elements, or light receiving portions, which belong one for one to the multiple ink containers on the carriage, a combination of a single light emitting means and multiple light guiding passages made up of optical fiber or the like may be employed to transmit or block light to control the manner in which the information disseminating means is illuminated to disseminate the information regarding each of the ink containers on the carriage, provided that the light from the single light emitting means can be properly shed on each of the multiple liquid crystal elements or light receiving portions. In other words, this embodiment makes it possible to reduce the number of the LEDs, power consumption, and also, afford greater latitude in the placement of the LEDs.

The choice of the means as the portion for transmitting or blocking light is optional. However, in consideration of the requirement that the portion for transmitting or blocking light can transmit or block light without being mechanically displaced, and also, can be driven with a very small amount of power, it is desired that a liquid crystal element is employed, as in the preceding embodiments.

Further, in each of the embodiments described above, each ink container was provided with the light guiding member for guiding light to its light projecting portion. However, as long as the information regarding each ink container can be displayed so that the light projected from the light projecting portion is visible to a user, and also, is receivable by the printer main assembly, the provision of light guiding members, such as those described above, is not mandatory.

Also in each of the embodiments described above, the ink container holder was an integral part of a recording head cartridge which is integral with its recording head portion. However, the application of the present invention is not limited to the ink container holder such as those in the preceding embodiments. That is, the present invention is also compatible with an ink container holder, which is independent from a recording head, as long as the ink container holder is structured so that as an ink container is mounted into the ink container holder, the ink container becomes connected to a recording head to supply the recording head with ink.

Further, the number of ink containers, number of ink container holders, manner in which ink is held in an ink container, structure of a recording head to which an ink container is attached, structure of an ink jet printer, do not need to be limited to those described above. Further, the present invention is just as effectively applicable to a monochromatic ink jet printer as it is to a multicolor ink jet printer, such as those described above. Further, regarding the liquid to be stored in an ink container, not only is the present invention compatible with an ink container which stores ink as coloring agent, but also, an ink container which stores liquid for processing recording medium and/or an image on recording medium, in order to improve the image in fixation, color development, durability, etc.

Further, in the embodiments described above, the ink container as a liquid container, was independent from the recording head. Needless to say, the concept of the present invention is also compatible with a recording head unit (liquid storage cartridge), which is an integral combination an ink container and a recording head.

Figure 34:
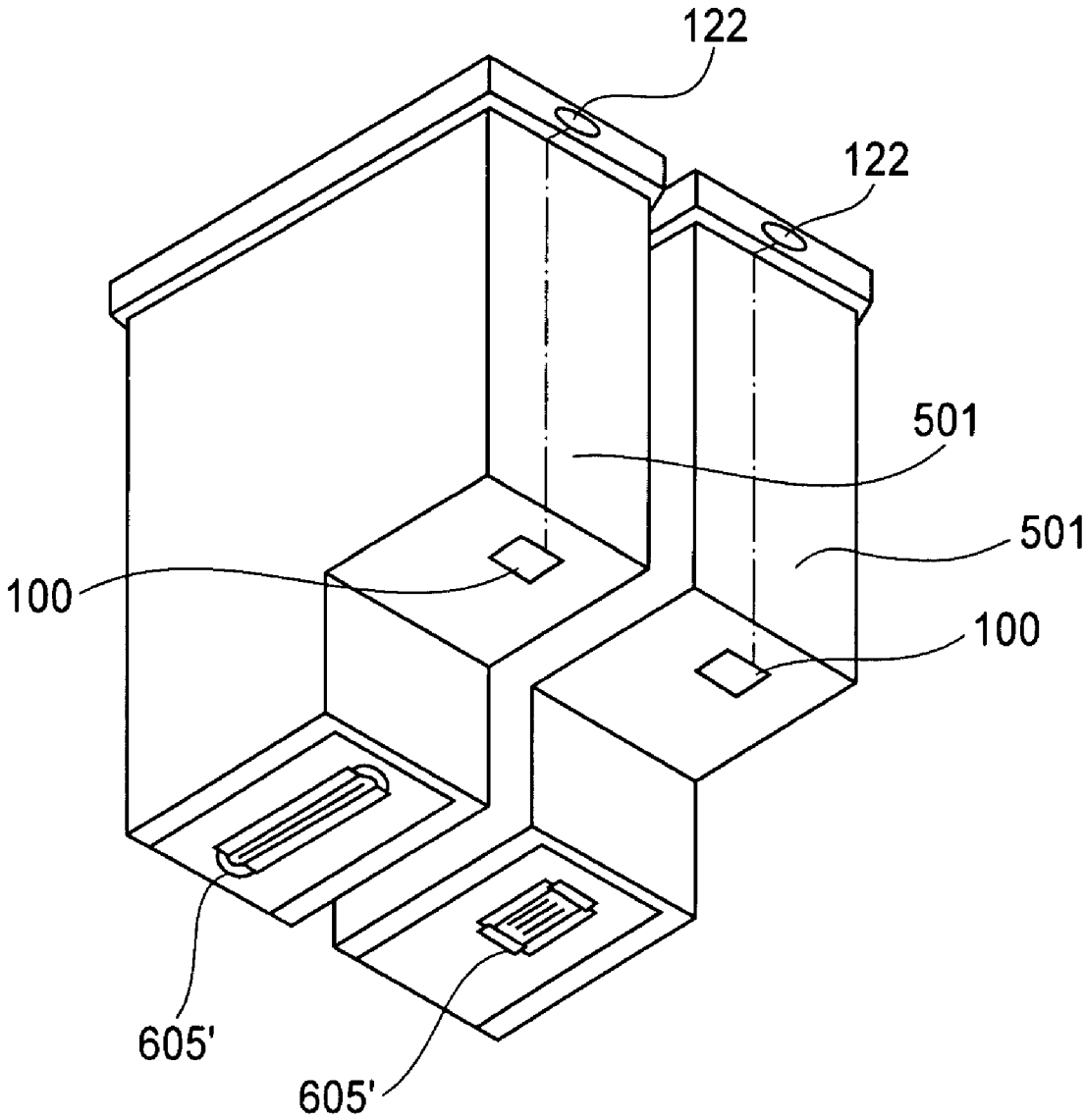
FIG. 34 is a perspective view of another embodiment of the present invention.

FIG. 34 is a perspective view of an example of a recording head unit, or an integral combination of an ink container and a recording head. FIG. 34 shows two recording head units (liquid storage cartridges), each of which is made up of an ink container 501 and a recording head 605'. One of the recording head units (cartridges) in the drawing is for black ink, and the other is for yellow, magenta, and cyan inks. Each of the two cartridges may be provided with a control chip 100, such as the one in the first embodiment, and a light guiding member (unshown), which guides light to a light projecting portion 122, as indicated by a single-dot chain line. In this case, all that is necessary is to structure each of the liquid storage cartridge slots on the main assembly side so that each slot matches in structure the liquid container to be mounted therein, and provide each slot with an antenna chip, such as the antenna chip 152 in the first embodiment.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Application No. 140086/2006 filed May 19, 2006 which is hereby incorporated by reference.

What is claimed is:

1. A liquid container detachably mountable to a recording apparatus to which a plurality of liquid containers are mountable at different positions, an apparatus side communicating portion, a light emitting portion, position detecting means for detecting a position of said liquid container where liquid container is mounted by receiving light from said liquid container, said liquid container comprising:

a container side communicating portion capable of information communication with the apparatus side communicating portion;

an information storing portion capable of storing at least individuality information of the liquid container;

displaying means, including a light passing/blocking portion for passing or blocking the light from the light emitting portion provided in said apparatus, for releasing the light passed by the light passing/blocking portion; and a controller for releasing the light by said displaying means by controlling said light passing/blocking portion when information indicated by a signal relating to the individuality information inputted from said communicating portion and the individuality information stored in said information storing portion, are the same.

2. A container according to claim 1, wherein said light passing/blocking portion includes a liquid crystal element.

3. A container according to claim 1, wherein said container side communicating portion and said apparatus side communicating portion include respective antennas which are capable of wireless communication with each other.

4. A container according to claim 1, wherein said container side communicating portion and said apparatus side communicating portion include respective contacts which are electrically connectable with each other to permit the communication therebetween.

5. A container according to claim 1, wherein the light emitting portion of said apparatus is capable of light emission in different colors, and wherein said controller controls timing of light passing and light blocking of the light passing/blocking portion in synchronism with light emission timing of the colors of the light emitting portion to release the light in the plurality of colors by said displaying means.

6. A liquid container according to claim 1, further comprising ink therein.

7. A liquid supplying system comprising a recording apparatus to which a plurality of liquid containers are mountable at different positions, an apparatus side communicating portion, a light emitting portion, position detecting means for detecting a position of said liquid container where liquid container is mounted by receiving light from said liquid container, and a liquid container detachably mountable to a carriage of said recording apparatus, said liquid supplying system comprising:

a container side communicating portion capable of information communication with the apparatus side communicating portion;

an information storing portion capable of storing at least individuality information of the liquid container;

displaying means, including a light passing/blocking portion for passing or blocking the light from the light emitting portion provided in said apparatus, for releasing the light passed by the light passing/blocking portion; and a controller for releasing the light by said displaying means by controlling said light passing/blocking portion when information indicated by a signal relating to the individuality information inputted from said communicating portion and the individuality information stored in said information storing portion, are the same.

8. A manufacturing method for a liquid container detachably mountable to a recording apparatus to which a plurality of liquid containers are mountable at different positions, an apparatus side communicating portion, a light emitting portion, position detecting means for detecting a position of said liquid container where liquid container is mounted by receiving light from said liquid container, said manufacturing method comprising:

a step of preparing a liquid container including a container side communicating portion capable of information communication with the apparatus side communicating portion; an information storing portion capable of storing at least individuality information of the liquid container; displaying means, including a light passing/blocking portion for passing or blocking the light from the light emitting portion provided in said apparatus, for releasing the light passed by the light passing/blocking portion; and a controller for releasing the light by said displaying means by controlling said light passing/blocking portion when information indicated by a signal relating to the individuality information inputted from said communicating portion and the individuality information stored in said information storing portion, are the same; and a step of injecting ink into the liquid container.

9. A circuit board for a liquid container detachably mountable to a recording apparatus to which a plurality of liquid containers are mountable at different positions, an apparatus side communicating portion, a light emitting portion, position detecting means for detecting a position of said liquid container where liquid container is mounted by receiving light from said liquid container, said circuit board comprising:

a container side communicating portion capable of information communication with the apparatus side communicating portion;

an information storing portion capable of storing at least individuality information of the liquid container;

displaying means, including a light passing/blocking portion for passing or blocking the light from the light emitting portion provided in said apparatus, for releasing the light passed by the light passing/blocking portion; and a controller for releasing the light by said displaying means by controlling said light passing/blocking portion when information indicated by a signal relating to the individuality information inputted from said communicating portion and the individuality information stored in said information storing portion, are the same.

10. A circuit board according to claim 9, wherein said light passing/blocking portion is provided on said circuit board.

11. A recording apparatus to which a liquid container as defined in any one of claims 1-6 is detachably mountable, said apparatus comprising said apparatus side communicating portion, said light emitting portion, said position detecting means.

12. An apparatus according to claim 11, further comprising a carriage capable of carrying said liquid container, wherein said carriage is capable of moving to a position where said light receiving portion is capable of receiving the released light.

13. A liquid container comprising a mounting portion for mounting a circuit board as defined in claim 9 or 10.

* * * * *